US011518960B2

(12) United States Patent
McMillen et al.

(10) Patent No.: US 11,518,960 B2
(45) Date of Patent: Dec. 6, 2022

(54) ALKALINE MOLYBDENUM CATION AND PHOSPHONATE-CONTAINING CLEANING COMPOSITION

(71) Applicant: PPG Industries Ohio, Inc., Cleveland, OH (US)

(72) Inventors: Mark W. McMillen, Cabot, PA (US); Steven J. Lemon, Lower Burrell, PA (US); Kevin T. Sylvester, Lawrence, PA (US); Justin J. Martin, Irwin, PA (US); Michel Sudour, Sebourg (FR)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 15/685,241

(22) Filed: Aug. 24, 2017

(65) Prior Publication Data

US 2018/0057773 A1 Mar. 1, 2018

Related U.S. Application Data

(60) Provisional application No. 62/378,751, filed on Aug. 24, 2016.

(51) Int. Cl.

| | |
|---|---|
| ***C11D 9/06*** | (2006.01) |
| ***C11D 3/06*** | (2006.01) |
| ***C23G 1/14*** | (2006.01) |
| ***C23C 22/80*** | (2006.01) |
| ***C23C 22/36*** | (2006.01) |
| ***C23C 22/73*** | (2006.01) |
| ***C23C 22/83*** | (2006.01) |
| ***C23C 22/60*** | (2006.01) |
| ***C23C 22/34*** | (2006.01) |
| ***C23C 22/18*** | (2006.01) |
| ***C23C 22/78*** | (2006.01) |
| ***C23G 1/20*** | (2006.01) |
| ***C11D 3/00*** | (2006.01) |
| ***C25D 5/34*** | (2006.01) |

(52) U.S. Cl.

CPC ..... *C11D 3/06* (2013.01); *C11D 3/0015* (2013.01); *C11D 3/0047* (2013.01); *C23C 22/184* (2013.01); *C23C 22/34* (2013.01); *C23C 22/364* (2013.01); *C23C 22/60* (2013.01); *C23C 22/73* (2013.01); *C23C 22/78* (2013.01); *C23C 22/80* (2013.01); *C23C 22/83* (2013.01); *C23G 1/14* (2013.01); *C23G 1/20* (2013.01); *C25D 5/34* (2013.01)

(58) Field of Classification Search

CPC . C11D 11/0023; C11D 11/0047; C11D 3/361; C11D 3/02; C11D 3/1213; C11D 3/1226

See application file for complete search history.

(56) References Cited

U.S. PATENT DOCUMENTS

| | | | | |
|---|---|---|---|---|
| 400,101 | A | 3/1889 | McLemore et al. | |
| 2,132,438 | A | 10/1938 | Romig | |
| 2,164,042 | A | 6/1939 | Romig | |
| 3,007,817 | A | 11/1961 | Cavanagh et al. | |
| 3,288,655 | A | 11/1966 | Harwell et al. | |
| 3,455,731 | A | 7/1969 | Nielsen et al. | |
| 3,455,806 | A | 7/1969 | Spoor et al. | |
| 3,491,011 | A | 1/1970 | Le Bras et al. | |
| 3,502,511 | A | 3/1970 | Forsberg | |
| 3,620,949 | A | 11/1971 | Morrison et al. | |
| 3,625,777 | A | 12/1971 | Masanaga et al. | |
| 3,635,826 | A | 1/1972 | Hamilton | |
| 3,663,389 | A | 5/1972 | Koral et al. | |
| 3,669,765 | A | 6/1972 | Bradshaw et al. | |
| 3,726,774 | A | 4/1973 | Difford et al. | |
| 3,749,657 | A | 7/1973 | Le Bras et al. | |
| 3,793,278 | A | 2/1974 | De Bona | |
| 3,912,548 | A | 10/1975 | Faigen | |
| 3,928,157 | A | 12/1975 | Suematsu et al. | |
| 3,929,514 | A * | 12/1975 | Houlihan | C23C 22/60 148/273 |
| 3,947,338 | A | 3/1976 | Jerabek et al. | |
| 3,947,339 | A | 3/1976 | Jerabek et al. | |

(Continued)

FOREIGN PATENT DOCUMENTS

| | | |
|---|---|---|
| AU | 6824265 | 6/1967 |
| CA | 1309315 | 10/1992 |

(Continued)

OTHER PUBLICATIONS

Light et al., "Determination of fluoride in toothpaste using an ion-selective electrode", Journal of Chemical Education, Apr. 1975, vol. 52, Issue 4, pp. 247-250.

(Continued)

*Primary Examiner* — Charles I Boyer

(74) *Attorney, Agent, or Firm* — Alicia M. Passerin; Ashley N. Crane

(57) ABSTRACT

The present invention is directed towards an aqueous alkaline cleaner composition comprising: an iron cation, a molybdenum cation, a cobalt cation, or combinations thereof; and an alkaline component; wherein the pH of the aqueous alkaline composition is at least 10, and the aqueous alkaline composition includes no more than 50 ppm of phosphate. Also disclosed are treatment systems comprising an aqueous alkaline composition for treating at least a portion of a substrate, and a pretreatment composition for treating at least a portion of a substrate. Also disclosed are substrates treated according to the disclosed treatment systems.

34 Claims, No Drawings

(56) References Cited

U.S. PATENT DOCUMENTS 3,959,106 A 5/1976 Bosso et al.
3,962,165 A 6/1976 Bosso et al.
3,975,346 A 8/1976 Bosso et al.
3,984,299 A 10/1976 Jerabek
3,984,922 A 10/1976 Rosen
4,001,101 A 1/1977 Bosso et al.
4,009,115 A 2/1977 Binns
4,063,969 A 12/1977 Howell, Jr.
4,104,147 A 8/1978 Marchetti et al.
4,116,900 A 9/1978 Belanger
4,134,866 A 1/1979 Tominaga et al.
4,134,932 A 1/1979 Kempter et al.
4,148,670 A 4/1979 Kelly
4,148,772 A 4/1979 Marchetti et al.
4,238,594 A 12/1980 Pampouchidis
4,264,378 A 4/1981 Oppen et al.
4,273,592 A 6/1981 Kelly
4,313,769 A 2/1982 Frelin et al.
4,332,711 A 6/1982 Kooymans et al.
4,370,177 A 1/1983 Frelin et al.
4,416,705 A 11/1983 Siemund et al.
4,468,307 A 8/1984 Wismer et al.
4,668,421 A 5/1987 Dollman
4,715,898 A 12/1987 Johnson
4,728,456 A 3/1988 Yamasoe et al.
4,931,157 A 6/1990 Valko et al.
5,080,814 A 1/1992 Awad
5,104,577 A 4/1992 Ikeda et al.
5,112,395 A 5/1992 Ngo
5,149,382 A 9/1992 Gray
5,209,788 A 5/1993 McMillen et al.
5,261,973 A 11/1993 Sienkowski et al.
5,328,525 A 7/1994 Musingo et al.
5,342,456 A 8/1994 Dolan
5,344,504 A 9/1994 Deck et al.
5,441,580 A 8/1995 Tomlinson
5,449,414 A 9/1995 Dolan
5,449,415 A 9/1995 Dolan
5,584,946 A 12/1996 Karmaschek et al.
5,597,465 A 1/1997 Pedrazzini
5,641,542 A 6/1997 Melzer et al.
5,653,790 A 8/1997 Fotinos et al.
5,653,823 A 8/1997 McMillen et al.
5,662,746 A 9/1997 Affinito
5,683,816 A 11/1997 Goodreau
5,700,334 A 12/1997 Ishii et al.
5,712,236 A 1/1998 Bolkan et al.
5,759,244 A 6/1998 Tomlinson
5,797,987 A 8/1998 Rossio
5,868,819 A 2/1999 Guhde et al.
5,902,473 A 5/1999 Harris et al.
5,908,512 A 6/1999 Shirahata et al.
5,932,292 A 8/1999 Nagashima et al.
5,952,049 A 9/1999 Tomlinson
5,962,145 A 10/1999 Matsukawa
5,985,047 A 11/1999 Buxton et al.
6,019,858 A 2/2000 Sienkowski et al.
6,068,879 A * 5/2000 Pasch ..... H01L 21/02074 216/18
6,083,309 A 7/2000 Tomlinson
6,168,868 B1 1/2001 Hauser et al.
6,206,982 B1 3/2001 Hughes et al.
6,214,132 B1 4/2001 Nakayama et al.
6,248,225 B1 6/2001 Palaika et al.
6,287,394 B1 9/2001 Buxton et al.
6,361,622 B1 3/2002 McCormick et al.
6,361,623 B1 3/2002 Ishikura et al.
6,432,224 B1 8/2002 Minevski et al.
6,447,662 B1 9/2002 Brouwer et al.
6,458,219 B2 10/2002 Chihara et al.
6,478,860 B1 11/2002 Nakayama et al.
6,530,999 B2 3/2003 Meagher et al.
6,558,480 B1 5/2003 Rochfort et al.
6,562,148 B1 5/2003 Wendel et al.
6,616,868 B1 9/2003 Gotoh et al.
6,723,178 B1 4/2004 Bannai et al.
6,733,896 B2 5/2004 Dolan et al.
6,749,694 B2 6/2004 Greene et al.
6,753,039 B2 6/2004 Heimann et al.
6,761,933 B2 7/2004 Warburton et al.
6,774,168 B2 8/2004 Jennings et al.
6,777,034 B2 8/2004 Berger et al.
6,797,387 B2 9/2004 Ambrose et al.
6,875,800 B2 4/2005 Vanier et al.
6,894,086 B2 5/2005 Munro et al.
7,204,871 B2 4/2007 Holden
7,208,054 B2 4/2007 Nakazawa
7,250,076 B2 7/2007 Maze et al.
7,291,402 B2 11/2007 Kazuhisa et al.
7,294,362 B2 11/2007 Tanaka et al.
7,402,214 B2 7/2008 Greene et al.
7,432,333 B2 10/2008 Duffy et al.
7,470,752 B2 12/2008 Duffy et al.
7,531,051 B2 5/2009 Nakayama et al.
7,588,801 B2 9/2009 Endo et al.
7,605,194 B2 10/2009 Ferencz et al.
7,608,337 B2 10/2009 Tanaka et al.
7,612,124 B2 11/2009 Polk et al.
7,615,257 B2 11/2009 Jung et al.
7,635,727 B2 12/2009 Faler et al.
7,671,109 B2 3/2010 Cheng et al.
7,691,854 B2 4/2010 Gielen-Haertwig et al.
7,695,771 B2 4/2010 Ostrovsky
7,699,926 B2 4/2010 Huang
7,736,730 B2 6/2010 Jung et al.
7,745,514 B2 6/2010 Cheng et al.
7,749,368 B2 7/2010 McMurdie et al.
7,749,582 B2 7/2010 Kurokawa et al.
7,754,786 B2 7/2010 Ferencz et al.
7,819,989 B2 10/2010 Ishikura et al.
7,879,157 B2 2/2011 Drexler
7,883,616 B2 2/2011 Shoji et al.
7,919,181 B2 4/2011 Wilke et al.
7,947,333 B2 5/2011 Eriksson et al.
8,097,093 B2 1/2012 Brent et al.
8,153,344 B2 4/2012 Faler et al.
8,192,556 B2 6/2012 Giordani et al.
8,221,559 B2 7/2012 Inbe et al.
8,293,029 B2 10/2012 Jueptner et al.
8,298,350 B2 10/2012 Cano-Iranzo et al.
8,309,177 B2 11/2012 Cape
8,318,256 B2 11/2012 Ishii et al.
8,349,092 B2 1/2013 Specht et al.
8,506,728 B2 8/2013 Katsura et al.
8,507,054 B2 8/2013 Zhou et al.
8,549,746 B2 10/2013 Wehling et al.
8,557,096 B2 10/2013 Schmidt et al.
8,557,895 B2 10/2013 Ferencz et al.
8,673,091 B2 3/2014 McMillen et al.
8,679,586 B2 3/2014 Czika et al.
8,715,403 B2 5/2014 Brouwer et al.
8,764,916 B2 7/2014 Donsbach et al.
8,815,021 B2 8/2014 Brouwer et al.
8,923,334 B2 12/2014 McConnell et al.
9,228,088 B2 1/2016 Brouwer et al.
9,234,283 B2 1/2016 Bryden et al.
9,284,460 B2 3/2016 Vonk et al.
9,309,602 B2 4/2016 Wolpers et al.
9,347,134 B2 5/2016 Morris
9,970,115 B2 5/2018 Vonk et al.
2002/0106978 A1 8/2002 Michaud et al.
2002/0179189 A1 12/2002 Homma et al.
2003/0041778 A1* 3/2003 Zaid ..... C09K 8/04 106/286.3
2003/0185990 A1 10/2003 Bittner et al.
2003/0198605 A1* 10/2003 Montgomery ..... A61C 5/00 424/53
2004/0009300 A1 1/2004 Shimakura et al.
2004/0011429 A1 1/2004 Miyamoto et al.
2004/0020564 A1 2/2004 Schenzle et al.
2004/0020567 A1 2/2004 Baldwin
2004/0079188 A1 4/2004 Mori et al.
2004/0144451 A1 7/2004 Matsukawa et al.
2004/0163736 A1 8/2004 Matsukawa et al.

(56) References Cited

U.S. PATENT DOCUMENTS

2004/0167266 A1 8/2004 Hasegawa et al.
2004/0170840 A1 9/2004 Matsukawa et al.
2004/0187967 A1 9/2004 Matsukawa et al.
2004/0244875 A1 12/2004 Yasuda et al.
2005/0121113 A1 6/2005 Quellhorst et al.
2005/0181139 A1 8/2005 Jones et al.
2005/0187326 A1 8/2005 Nakazawa
2005/0252578 A1 11/2005 Tarlowski et al.
2005/0287348 A1 12/2005 Faler et al.
2006/0060265 A1 3/2006 Church et al.
2006/0086282 A1 4/2006 Zhang et al.
2006/0094637 A1* 5/2006 Liang ..... C11D 7/10 510/499
2006/0173099 A1 8/2006 Jueptner et al.
2006/0185769 A1 8/2006 Nakayama et al.
2006/0251896 A1 11/2006 Ferencz et al.
2006/0278307 A1 12/2006 Nitschke et al.
2007/0017602 A1 1/2007 Koch et al.
2007/0026254 A1 2/2007 Ben-Malek et al.
2007/0122701 A1 5/2007 Yamaguchi
2007/0240604 A1 10/2007 Inbe et al.
2007/0272900 A1 11/2007 Yoshida et al.
2008/0008902 A1 1/2008 Takakuwa et al.
2008/0041498 A1 2/2008 Inbe et al.
2008/0057336 A1 3/2008 Kurokawa et al.
2008/0112909 A1 5/2008 Faler et al.
2008/0145678 A1 6/2008 McMurdie et al.
2008/0280046 A1 11/2008 Bryden et al.
2008/0283152 A1 11/2008 Greene et al.
2008/0302448 A1 12/2008 Frey et al.
2009/0004863 A1* 1/2009 Kamimura ..... C23F 3/04 438/692
2009/0032144 A1 2/2009 McMillen et al.
2009/0032145 A1 2/2009 Diaddario, Jr. et al.
2009/0035577 A1 2/2009 Inbe et al.
2009/0214883 A1 8/2009 De Zeeuw et al.
2009/0220773 A1 9/2009 Laudenklos
2009/0223407 A1 9/2009 Inbe et al.
2009/0223601 A1 9/2009 Katsura et al.
2009/0289033 A1* 11/2009 Dysard ..... C09G 1/02 216/53
2009/0326098 A1 12/2009 Ferencz et al.
2010/0031851 A1 2/2010 Inbe et al.
2010/0159258 A1 6/2010 Rakiewicz et al.
2010/0167066 A1 7/2010 Yoo et al.
2010/0170594 A1 7/2010 Inbe et al.
2010/0176000 A1 7/2010 Inbe et al.
2010/0243108 A1 9/2010 Karabin et al.
2010/0291307 A1 11/2010 McGee et al.
2010/0292126 A1* 11/2010 Smith ..... C11D 3/0047 510/376
2010/0314004 A1 12/2010 Manavbasi
2011/0024298 A1 2/2011 Nishiguchi et al.
2011/0031126 A1 2/2011 Wang et al.
2011/0062026 A1 3/2011 Nishiguchi et al.
2011/0132497 A1 6/2011 Greber
2011/0206844 A1 8/2011 Wiles et al.
2011/0305840 A1 12/2011 Ishii
2012/0018053 A1 1/2012 Nagaya et al.
2012/0064369 A1 3/2012 Tachiki et al.
2012/0076940 A1 3/2012 Brent et al.
2012/0118434 A1 5/2012 Konishi et al.
2012/0160129 A1 6/2012 Inbe et al.
2012/0183806 A1 7/2012 McMillen et al.
2012/0244280 A1 9/2012 Hecht
2012/0282404 A1 11/2012 Rosenkranz et al.
2012/0301739 A1 11/2012 Vonk et al.
2013/0084453 A1 4/2013 Imokawa et al.
2013/0126050 A1 5/2013 Wagh et al.
2013/0142941 A1 6/2013 Damiani et al.
2013/0146460 A1 6/2013 Silvernail et al.
2013/0202911 A1 8/2013 Kapic et al.
2013/0206285 A1 8/2013 Suzuki et al.
2013/0209827 A1 8/2013 Suzuki et al.
2013/0209829 A1 8/2013 Suzuki et al.
2013/0216714 A1 8/2013 Suzuki et al.
2013/0216858 A1 8/2013 Suzuki et al.
2013/0284049 A1 10/2013 Miura et al.
2013/0345109 A1* 12/2013 Miralles ..... C11D 3/044 510/488
2014/0023882 A1 1/2014 Brouwer
2014/0038933 A1* 2/2014 Polson et al. ..... A01N 25/22 514/188
2014/0272583 A1 9/2014 Hellring et al.
2015/0064445 A1 3/2015 McMillen et al.
2015/0232996 A1 8/2015 Sudour et al.
2016/0020087 A1* 1/2016 Liu ..... C11D 3/2075 510/175
2016/0108286 A1* 4/2016 Sikma ..... C09G 1/02 216/53
2016/0351388 A1* 12/2016 Liu ..... C11D 7/34
2017/0240844 A1* 8/2017 Cabanas ..... C11D 3/0073

FOREIGN PATENT DOCUMENTS

CA 2087352 A1 1/1994
CN 1242436 1/2000
CN 1814860 8/2006
CN 101285184 10/2008
CN 100447301 12/2008
CN 101400826 4/2009
CN 101560655 10/2009
CN 101603174 12/2009
CN 101736336 6/2010
CN 101701336 4/2011
CN 102199766 9/2011
CN 101376958 1/2012
CN 102666922 9/2012
DE 2038105 6/1976
DE 2043085 3/1979
DE 2044903 10/1979
DE 19854091 5/2000
DE 69732102 3/2006
DE 102009047523 6/2011
EP 0056675 7/1982
EP 0564287 10/1993
EP 1242193 8/2003
EP 1378586 1/2004
EP 1566466 8/2005
EP 1959031 8/2008
EP 1027170 11/2008
EP 1493498 6/2009
EP 2243863 10/2010
EP 2287358 2/2011
EP 2217742 5/2011
EP 2302097 11/2014
GB 677895 8/1952
GB 1042108 A 9/1966
GB 1125230 8/1968
GB 1274769 5/1972
GB 1507816 4/1978
GB 2152955 A 8/1985
GB 2259920 3/1993
JP H04268092 9/1992
JP H07126859 5/1995
JP H10176281 6/1998
JP 2968118 10/1999
JP 2974518 11/1999
JP 2000199074 7/2000
JP 2001049451 2/2001
JP 3278475 4/2002
JP 2002356784 12/2002
JP 2003105555 4/2003
JP 2003226982 8/2003
JP 2004051725 2/2004
JP 2004052056 2/2004
JP 2004052057 2/2004
JP 2004068067 3/2004
JP 2004068068 3/2004
JP 2004183015 7/2004
JP 2004238638 8/2004
JP 2004263252 9/2004
JP 2004263280 9/2004

(56) References Cited

FOREIGN PATENT DOCUMENTS

| | | | |
|---|---|---|---|
| JP | 2004331941 | | 11/2004 |
| JP | 2005264230 | | 9/2005 |
| JP | 2006255540 | | 9/2006 |
| JP | 2006328445 | | 12/2006 |
| JP | 2006342419 | | 12/2006 |
| JP | 2007177314 | | 7/2007 |
| JP | 2008000910 | | 1/2008 |
| JP | 4098669 | | 6/2008 |
| JP | 4099218 | | 6/2008 |
| JP | 2008163364 | | 7/2008 |
| JP | 4167046 | | 10/2008 |
| JP | 2008240042 | | 10/2008 |
| JP | 4223313 | | 2/2009 |
| JP | 2009114500 | | 5/2009 |
| JP | 2009174010 | | 8/2009 |
| JP | 2009174011 | | 8/2009 |
| JP | 2009209391 | | 9/2009 |
| JP | 2009248460 | | 10/2009 |
| JP | 2009249690 | | 10/2009 |
| JP | 2009280887 | | 12/2009 |
| JP | 2009280889 | | 12/2009 |
| JP | 2009287078 | | 12/2009 |
| JP | 2009287079 | | 12/2009 |
| JP | 2009287080 | | 12/2009 |
| JP | 4521010 | | 8/2010 |
| JP | 4534592 | | 9/2010 |
| JP | 4579715 | | 11/2010 |
| JP | 4607969 | | 1/2011 |
| JP | 2011001623 | | 1/2011 |
| JP | 2011032512 | | 2/2011 |
| JP | 2011042834 | | 3/2011 |
| JP | 2011067737 | | 4/2011 |
| JP | 2011068996 | | 4/2011 |
| JP | 2011153740 | | 8/2011 |
| JP | 2011225967 | | 11/2011 |
| JP | 5201916 | | 6/2013 |
| JP | 5217508 | | 6/2013 |
| JP | 5345874 | | 11/2013 |
| JP | 5391092 | | 1/2014 |
| KR | 20040065936 | | 7/2004 |
| KR | 20070069169 | | 7/2007 |
| KR | 20080007657 | | 1/2008 |
| KR | 20100064509 | | 6/2010 |
| RU | 2392353 | C2 | 6/2010 |
| WO | 9315154 | | 8/1993 |
| WO | 9315155 | | 8/1993 |
| WO | 9502660 | | 1/1995 |
| WO | 95/33869 | A1 | 2/1995 |
| WO | 9929927 | | 6/1999 |
| WO | 0005066 | | 2/2000 |
| WO | 0014301 | | 3/2000 |
| WO | 0068325 | | 11/2000 |
| WO | 0071626 | | 11/2000 |
| WO | 0112341 | A1 | 2/2001 |
| WO | 0148264 | | 7/2001 |
| WO | 0175190 | | 10/2001 |
| WO | 0186016 | | 11/2001 |
| WO | 0192598 | | 12/2001 |
| WO | 2005000914 | | 1/2005 |
| WO | 2006043727 | | 4/2006 |
| WO | 2007080849 | | 7/2007 |
| WO | 2007097139 | | 8/2007 |
| WO | 2011013360 | | 2/2011 |
| WO | 2011145594 | | 11/2011 |
| WO | 2012001981 | | 1/2012 |
| WO | 2012003983 | | 1/2012 |
| WO | 2012078788 | | 6/2012 |
| WO | 2012109339 | A2 | 8/2012 |
| WO | 2012167889 | | 12/2012 |
| WO | 2013033372 | A1 | 3/2013 |
| WO | 2015115036 | | 8/2015 |

OTHER PUBLICATIONS

U.S. Appl. No. 10/876,031, filed Jun. 24, 2004, Faler et al., Abandoned.

U.S. Appl. No. 60/482,167, filed Jun. 24, 2003, Faler et al., Expired.

Notification of Transmittal of the International Search Report and the Written Opinion of the International Searching Authority dated Dec. 4, 2017, International Application No. PCT/US2017/048430.

ASTM International, "Standard Practice for Operating Salt Spray (Fog) Apparatus", Standard, Dec. 15, 2007, 5 pages, B 117-07a, ASTM International, West Conshohocken, PA.

General Motors Corporation, "Scab Corrosion Creepback of paint Systems on Metal Substrates", General Motors Engineering Standards, Mar. 1998, 2 pages, GM9511P.

Molybdenum, Wikipedia, 16 pages.

Hu et al., "Composite anticorrosion coatings for AZ91D magnesium alloy with molybdate conversion coating and silicon sol-gel coatings", Progress in Organic Coatings, 66, (2009), 199-205.

Sodium molybdate, Wikipedia, 3 pages.

Vukasovich et al., "Molybdate in Corrosion Inhibition—A Review", Polyhedron, vol. 5, No. 1/2, 1986, pp. 551-559.

Almeida et al., "Oxidising alternative species to chromium VI zinc galvanized steel surface treatment. Part 1-A morphological and chemical study", Surface and Coatings Technology, 106, (1998), pp. 8-17.

* cited by examiner

ALKALINE MOLYBDENUM CATION AND PHOSPHONATE-CONTAINING CLEANING COMPOSITION

CROSS-REFERENCE TO RELATED APPLICATION

This application claims priority to U.S. Provisional Application No. 62/378,751 filed on Aug. 24, 2016 and entitled "Iron-Containing Cleaning Composition."

FIELD OF THE INVENTION

The present invention is directed towards a cleaner composition.

BACKGROUND INFORMATION

Zinc phosphate pretreatments are well known to improve the corrosion resistance and paint adhesion of metal surfaces. Zinc phosphate chemistry performs on a wide variety of metals, with some well-known and widely used examples being ferrous metals, zinc and aluminum metals and many alloys. When applied, these pretreatments form a crystalline inorganic phosphate layer which may incorporate some elements from the metal substrate surface. In order to improve the robustness of the zinc phosphate coating in demanding environments, the elements nickel and manganese are commonly added to zinc phosphating solutions. These elements modify the surface of the exposed substrate and incorporate into the deposited zinc phosphate crystals, reducing their solubility and refining the crystal size and shape, which results in a denser coating. The aforementioned tri-cationic zinc phosphate chemistry is particularly effective in promoting paint adhesion and providing corrosion resistance to substrates possessing zinc surfaces such as galvanized or electrogalvanized steels.

Chrome containing seals in combination with zinc phosphate pretreatments are known to drive performance further. These seals reduce the porosity of the coating and form a protective layer on exposed substrate. While effective, the widespread use of chrome has given rise to environmental and public health concerns leading the coatings industry to transition from chrome wherever possible. More recently, nickel has gone under the microscope due to public health concerns. This focus on nickel has led to interest in developing nickel free zinc phosphate technology while maintaining performance on zinc and has helped facilitate the proliferation of zirconium based pretreatment technologies. Nickel free zinc phosphate has been explored in the past, but paint systems applied to the technology have always suffered from poor adhesion on zinc surfaces. There exists a need to achieve additional performance in nickel free phosphate systems when paint is applied to zinc surfaces.

Zirconium oxide pretreatments provide a green alternative to zinc phosphate pretreatments. Some operational advantages include: reduction of water usage, the ability to run the process at ambient temperatures and greatly reduced sludge formation. Zirconium based pretreatments are not formulated with nickel and are chrome free. Furthermore, in regions of the world which have phosphorous regulations to prevent eutrophication, zirconium oxide pretreatments are an excellent choice. While zirconium oxide is a proven technology, there exists a need to further improve the adhesion and corrosion protection of paint systems stressed under certain types of cyclic conditioning on zinc surfaces.

Some approaches to improving pretreatment performance on zinc surfaces have been proposed. In one example, an alkaline solution containing iron (III) ions is proposed in combination with 100 ppm to 4000 ppm orthophosphate or phosphate, ($PO_4^{3-}$), complexing agents and a pH of at least 10.5 in order to deposit a thin iron phosphate passivating layer on zinc surfaces prior to pretreatment. The requirement of orthophosphate in the composition to produce iron phosphate is undesirable as regulatory bodies around the globe look to curb the eutrophication associated with orthophosphate usage. It is especially undesirable for zirconium oxide technologies as they are the only pretreatment technology able to comply with the strictest of phosphate regulations when used in conjunction with a phosphate free cleaner. It would be desirable to provide an approach to improving phosphate or zirconium oxide pretreatment performance on zinc surfaces in a system which limits the usage of orthophosphate as much as possible. Another approach to improving pretreatment performance on zinc surfaces is the use of an alkaline pre-rinse composition containing 5 to 400 ppm of iron (III) ions, a minimum of 0.5 g/L hydroxide ions (approximately 12.5 pH), 0.0 to 4.0 g/L of cobalt ions, complexing agents and optionally a source of silicate in a contact time of 2 to 60 seconds. In all cases, the pre-rinse follows an alkaline cleaning step with Parco Cleaner 1533, a high phosphate medium to heavy duty cleaner as described by the manufacturer, and occurs before the pretreatment step. This sequence is typical of a pretreatment process utilizing a pre-rinse as known in the art. In this approach, the best results were generally obtained with cobalt addition to the highly alkaline iron containing pre-rinse for zinc surfaces. Cobalt, a transition metal, faces an uncertain future under REACH and thus may not be a preferred solution for industry. Due to the alkalinity of the solution, the authors state that the etching of aluminum makes the pre-rinse unsuitable for aluminum articles and substrates. It would be desirable to develop a system for improving the adhesion and corrosion performance of zirconium oxide pretreatments on zinc that did not contain orthophosphate or cobalt and could be used in processes using aluminum articles and substrates, thus enabling a robust multimetal treatment solution.

SUMMARY OF THE INVENTION

The present invention is directed towards an aqueous alkaline cleaner composition comprising: an iron cation, a molybdenum cation, a cobalt cation, or combinations thereof; and an alkaline component; wherein the pH of the aqueous alkaline composition is at least 10, and the aqueous alkaline composition includes no more than 50 ppm of phosphate based on a total weight of the composition.

The present invention also is directed towards a treatment system for treating metal substrates comprising: (a) an aqueous alkaline composition comprising: an iron cation, a molybdenum cation, a cobalt cation, or combinations thereof; and an alkaline component; wherein the pH of the aqueous alkaline composition is at least 10, and the aqueous alkaline composition includes no more than 50 ppm of phosphate based on a total weight of the composition; and (b) a pretreatment composition for treating at least a portion of the substrate, comprising a Group IVB metal cation.

The present invention also is directed towards a treatment system for treating metal substrates comprising: (a) an aqueous alkaline composition comprising: an iron cation, a molybdenum cation, a cobalt cation, or combinations thereof; and an alkaline component; wherein the pH of the aqueous alkaline composition is at least 10, and the aqueous alkaline composition includes no more than 50 ppm of phosphate based on a total weight of the composition; and (b) a pretreatment composition for treating at least a portion of the substrate, comprising a metal phosphate.

Also disclosed are substrates treated with the systems disclosed herein.

DETAILED DESCRIPTION OF THE INVENTION

Alkaline Cleaner Composition

As stated above, the present invention is directed to an aqueous alkaline cleaner composition comprising, or in some cases consisting essentially of, or in some cases consisting of, an iron cation, a molybdenum cation, and/or a cobalt cation and an alkaline component, wherein the pH of the aqueous alkaline composition is at least 10, and the aqueous alkaline composition comprises no more than 50 ppm of phosphate based on a total weight of the aqueous alkaline composition. As used herein, the term "phosphate" refers to the anion $PO_4^{3-}$ and includes orthophosphates, but excludes phosphonates (defined below). As used herein, the term "cleaner composition" refers to a composition comprising a source of alkalinity, builders, chelators and surfactants, and optionally defoamers, corrosion inhibitors, and organic solvents/carriers other than water and that is used to treat a metal substrate with the purpose of removing oils and other soils from at least a portion of a surface of the metal substrate prior to any subsequent treatment steps such as contacting the cleaned substrate surface with prerinse composition(s), pretreatment compositions(s), postrinse composition(s), and/or electrocoat, powder coat, or liquid compositions. In contrast to a cleaner, a "prerinse" composition does not include chelators or surfactants and is used to treat a cleaned metal surface, i.e., a substrate surface that is substantially, essentially, or completely free of oils and other soils.

According to the present invention, the iron cation of the cleaner composition may comprise iron (II) and/or iron (III) and may be in the form of a salt. Nonlimiting examples of anions suitable for forming a salt with the iron cation include nitrate, sulfate, acetate, chloride, citrate, gluconate, sulfamate, or combinations thereof.

According to the present invention, the iron cation may be present in the aqueous alkaline cleaner composition, if at all, in an amount of at least 50 ppm based on a total weight of the alkaline cleaner composition, such as at least 100 ppm, such as at least 250 ppm, and in some instances, may be present in an amount of no more than 500 ppm based on a total weight of the alkaline cleaner composition, such as no more than 400 ppm, such as no more than 300 ppm. The iron cation may be present in the aqueous alkaline cleaner composition, if at all, in an amount of 50 ppm to 500 ppm based on a total weight of the alkaline cleaner composition, such as 100 ppm to 400 ppm, such as 250 ppm to 300 ppm.

As mentioned above, according to the present invention, the aqueous alkaline cleaner composition may comprise a molybdenum cation. The molybdenum cation may be present in the cleaner composition in the form of a salt. Nonlimiting examples of anions suitable for forming a salt with the molybdenum cation include molybdic acid, sodium molybdate, ammonium molybdate, or combinations thereof.

Molybdate can undergo condensation reactions when the pH of the solution changes. It is well established that molybdate exists as discrete $MoO_4^{2-}$ units in alkaline solution (pH 7-12). In the pH range of 6-7, the molybdenum species are mainly present as protonated molybdate (i.e.: $HMoO_4^{1-}$). For more acidic pH ranges (e.g.: pH of 3-5), molybdate will form a mixture of $HMoO_4$ and $HMoO_4^{1-}$ which will undergo multiple condensation reactions at a high concentrations (i.e.: greater than $10^{-3}$ M $Mo^{6+}$). At pH values less than 3, the species that forms is octamolybdate (i.e.: $Mo_8O_{26}^{4-}$) in concentrated solutions. In contrast in dilute solutions of molybdate (less than $10^{-5}$ M $Mo^{6+}$) at pH less than 3, the monomeric species of protonated molybdate will form. These include $H_2MoO_4$ or $H_3MoO_4^{1+}$ Given the differences in the extent of condensation of $MoO_4^{2-}$ depending on the concentration of Mo(VI) and the solution pH, it is not surprising that the reduction potential of molybdate can be variable. Thus, the species that deposits onto a metal substrate can have a range of oxidation states. However, molybdenum will deposit in a reduced oxidation state relative to $MoO_4^{2-}$, which has Mo present in the 6+ oxidation state.

According to the present invention, the molybdenum cation may be present in the cleaner composition, if at all, in an amount of at least 10 ppm based on a total weight of the alkaline composition, such as at least 50 ppm, such as at least 100 ppm, and in some instances, may be present in an amount of no more than 400 ppm based on a total weight of the alkaline composition, such as no more than 300 ppm, such as no more than 200 ppm. According to the present invention, the molybdenum cation may be present in the alkaline composition, if at all, in an amount of 10 ppm to 400 based on a total weight of the alkaline composition, such as 50 ppm to 300 ppm, such as 100 ppm to 200 ppm.

As mentioned above, according to the present invention, the aqueous alkaline cleaner composition may comprise a cobalt cation. The cobalt cation may be present in the cleaner composition in the form of a salt. Nonlimiting examples of anions suitable for forming a salt with the cobalt cation include nitrate, sulfate, acetate, chloride, citrate, gluconate, sulfamate, or combinations thereof.

According to the present invention, the cobalt cation may be present in the aqueous alkaline cleaner composition, if at all, in an amount of at least 50 ppm based on a total weight of the cleaner composition, such as at least 100 ppm, such as at least 250 ppm, and in some instances, may be present in an amount of no more than 500 ppm based on a total weight of the cleaner composition, such as no more than 400 ppm, such as no more than 300 ppm. According to the present invention, the cobalt cation may be present in the aqueous cleaner alkaline composition, if at all, in an amount of 50 ppm to 500 ppm based on a total weight of the cleaner composition, such as 100 ppm to 400 ppm, such as 250 ppm to 300 ppm.

According to the present invention, the aqueous alkaline cleaner composition may comprise an alkaline component. The alkaline component is not limited so long as it provides a source of hydroxide ions to the aqueous alkaline cleaner composition. For example, the alkaline component may be sodium hydroxide, potassium hydroxide, and like compounds, or combinations thereof.

According to the present invention, the alkaline component may be present in the aqueous alkaline cleaner composition in an amount sufficient to adjust the pH of the cleaner composition to at least 10. According to the present invention, the pH of the aqueous alkaline cleaner composition may be at least 10, such as at least 10.5, such as at least 11, such as at least 12, and in some instances, may be no more than 14, such as no more than 12.5, such as no more than 12. According to the present invention, the pH of the aqueous alkaline cleaner composition may be 10 to 14, such as 10.5 to 12.5, such as 11 to 12.

According to the present invention, the cleaner composition may comprise phosphonates or phosphonic acids, which are defined herein as chemical species that have at least one carbon phosphorus bond and three phosphorus oxygen bonds. These species can be written in the general form as $R—PO_3X_2$ where R presents a species with at least one carbon atom connected to the phosphorus atom and X represents hydrogen or metal cations. Nonlimiting examples of phosphonic acid or phosphonates, where R is a carbon chain include: methyl phosphonic acid, ethyl phosphonic acid, butyl phosphonic acid, vinyl phosphonic acid, and docosylphosphonic acid. Other non-limiting examples may have phosphonic acid or phosphonates that include heteroatoms other than phosphorus bound to carbon, such as etridronic acid (present in Dequest 2010), iminodi(methylphosphonic acid), N,N-Bis(phosphonomethyl)glycine, N-(phosphonomethyl)iminodiacetic acid, nitrilotri(methylphosphonic acid) (present in Dequest 2000), and diethylenetriaminepentakis(methylphosphonic acid). Exemplary phosphonic acids or phosphonates that are polydentate, and do not include heteroatoms other than phosphorus bound to carbon are methylenebis(phosphonic acid), methanetriyltris (phosphonic acid) and methanetetrayltetrakis(phosphonic acid). The properties of phosphonic acids or phosphonates are highly dependent upon the molecular structure. Non limiting properties include but are not limited to hydrophobicity, hydrophilicity, and binding strength to metal cations or substrate surfaces. While not wishing to be bound by theory, when phosphonic acids or phosphonates are added to the alkaline cleaning composition of the present invention, not all phosphonates would be expected to produce identical results. For example, monodentate phosphonates (e.g.: $CH_3CH_2CH_2CH_2PO_3^{2-}$) are not expected to bind as strongly to the substrate surface or metal cations in solution as polydentate phosphonates (e.g.: etridonate, which is bidentate). The higher binding strength of polydentate phosphonates can better stabilize metal ions in solution or modify the etch rate of a substrate. Moreover, all polydentate phosphonates are not expected to deliver equal performance since the ring size of the chelate formed is expected to change the stability of the phosphonate-metal ion complexes formed in solution. For example, etridonate will form a six-membered ring with the metal center compared to iminodi(methylphosphonate) which will form an eight-membered ring with metal ions in solution. The former species is likely more stable than the latter given the difference in ring size as 6-membered rings are more thermodynamically favored than eight-membered rings. These previously described properties are not meant to be exhaustive, but rather illustrative that one skilled in the art would not expect identical performance from any phosphonic acid or phosphonate.

Phosphonates or phosphonic acids may be characterized by the ratio of phosphorous to carbon which is defined herein as the "P-C ratio" and is the total atomic percent phosphorus in a phosphonate divided by the total atomic percent carbon in a given molecule. For example, docosylphosphonic acid has a P-C ratio of 0.12. Etidronate has a P-C ratio of 2.58. One of the properties that the P-C ratio describes is hydrophilicity with lower P-C ratios indicating more hydrophobic phosphonic acids. According to the present invention, the P-C ratio for the phosphonate in the alkaline cleaning composition may be at least 0.10, such as at least 0.20, such as at least 0.30, such as at least 0.40, and in some instances may be no more than 3.20, such as no more than 5.25, such as no more than 7.75, such as no more than 10.3. According to the present invention, the P-C ratio may be from 0.10 to 10.3, such as from 0.20 to 7.75, such as 0.30 to 5.25, such as 0.40 to 3.20.

As stated above, according to the present invention, the cleaner composition comprises no more than 50 ppm of phosphate based on a total weight of the aqueous alkaline composition. In some instances, according to the present invention, cleaner composition and/or layers deposited from the same may be substantially free, or in some cases may be essentially free, or in some cases may be completely free, of one or more of phosphate. A cleaner composition and/or layers deposited from the same that is substantially free of phosphate means that phosphate is not intentionally added, but may be present in trace amounts, such as because of impurities or unavoidable contamination from the environment, municipal water sources, and the like. In other words, the amount of material is so small that it does not affect the properties of the composition; this may further include that phosphate is not present in the cleaner compositions and/or layers deposited from the same in such a level that they cause a burden on the environment. The term "substantially free" means that the cleaner compositions and/or layers deposited from the same contain less than 25 ppm of any phosphate based on total weight of the cleaner composition or the layer, respectively, if any at all. The term "essentially free" means that the cleaner compositions and/or layers comprising the same contain less than 10 ppm of any phosphate. The term "completely free" means that the cleaner compositions and/or layers comprising the same contain less than 1 ppb of any phosphate.

According to the present invention, the aqueous alkaline cleaner composition also may further comprise a chelator. The chelator may comprise, for example, carboxylates such as tartrates, citrates or gluconates, acetate based complexes such as methylglycine acetate, ethylenediaminetetraacetate or nitrilotriacetate, phosphates such as pentasodium triphosphate or tetrapotassium pyrophosphate, phosphonates, polycarboxylates, the acids, esters, or salts of any of the aforementioned, or combinations thereof. The chelator may be present in the aqueous alkaline cleaner composition in an amount of at least 10 ppm, such as at least 50 ppm, such as at least 100 ppm, and in some instances may be present in an amount of no more than 10,000 ppm, such as no more than 5,000 ppm, such as no more than 2,500 ppm, based on a total weight of the cleaner composition. The chelator may be present in the aqueous alkaline cleaner composition in an amount of 10 ppm to 10,000 ppm, such as 50 ppm to 5,000 ppm, such as 100 ppm to 2,500 ppm, based on a total weight of the composition.

According to the present invention, the aqueous alkaline cleaner composition may further comprise an oxidizing agent. The oxidizing agent may comprise, for example, peroxides, persulfates, perchlorates, hypochlorite, nitrite, sparged oxygen, bromates, peroxi-benzoates, ozone, sodium nitrobenzene sulfonate, or combinations thereof. The oxidizing agent may be present in the aqueous alkaline cleaner composition in an amount of at least 10 ppm, such as at least 50 ppm, such as at least 100 ppm, and in some instances, may be present in an amount of no more than 5,000 ppm, such as no more than 2,500 ppm, such as no more than 1,000 ppm, based on a total weight of the cleaner composition. The oxidizing agent may be present in the aqueous alkaline cleaner composition in an amount of 10 ppm to 5,000 ppm, such as 50 ppm to 2,500 ppm, such as 100 ppm to 1,000 ppm, based on a total weight of the composition.

According to the present invention, the aqueous alkaline cleaner composition also may further comprise a surfactant. The surfactant may be, anionic, non-ionic, cationic, or amphoteric. The surfactant may comprise, for example, alcohol ethoxylates (such as Tomadol-1-n or Tomadol 91-6 available from Evonik Industries or SEACO 9AE available from Sea-Land Chemical Company), alkyl phenolethoxylates (such as Makon NF-12 available from Surfachem), alkyl diphenyl sulfonates (such as Dowfax 2A1 available from The Dow Chemical Company), sulfates (such as Niaproof 08 available from Niacet), phosphate esters (such as Triton H-66 available from The Dow Chemical Company), ethers (such as Triton DF20 available from The Dow Chemical Company), styrene maleic anhydride (SMA) polymers, alkyl sultaines (such as Mirataine ASC and Mirataine CBS available from Rhodia), or combinations thereof. The surfactant may be present in the aqueous alkaline composition in an amount of at least 25 ppm based on total weight of the alkaline composition, such as at least 100 ppm, such as at least 200 ppm, such as at least 500 ppm, and in some instances, may be present in an amount of no more than 10,000 ppm based on a total weight of the alkaline composition, such as no more than 5,000 ppm, such as no more than 3,000 ppm, such as no more than 2,000 ppm. The surfactant may be present in the aqueous alkaline composition in an amount of 25 ppm to 10,000 ppm based on total weight of the alkaline composition, such as 100 ppm to 5,000 ppm, such as 200 ppm to 3,000 ppm, such as 500 ppm to 2,000 ppm.

According to the present invention, the alkaline cleaner composition also optionally may comprise a corrosion inhibitor, such as a corrosion inhibitor to prevent flash rusting of steel substrates processed through a treatment line. The corrosion inhibitor may comprise, for example, sodium nitrite, Hostacor 2098, Halox 515, amines, or combinations thereof. According to the present invention, the corrosion inhibitor may be present in the cleaner composition, if at all, in an amount of at least 10 ppm based on total weight of the cleaner composition, such as at least 25 ppm, such as at least 75 ppm, and in some instances may be present in an amount of no more than 10,000 ppm based on total weight of the cleaner composition, such as no more than 5,000 ppm, such as no more than 1,500 ppm, such as no more than 1,000 ppm. According to the present invention, the corrosion inhibitor may be present in the cleaner composition, if at all, in an amount of 10 ppm to 10,000 ppm based on total weight of the cleaner composition, such as 25 ppm to 5,000 ppm, such as 75 ppm to 1,500 ppm, such as 100 ppm to 1,000 ppm.

According to the present invention, the aqueous alkaline cleaner composition may further comprise a depositable species. The depositable species may comprise, for example, silicate, silanes, phosphonic acids, anhydrides, or combinations thereof. The depositable species may be present in the aqueous alkaline cleaner composition in an amount of at least 25 ppm, such as at least 50 ppm, such as at least 100 ppm, and in some instances, may be present in an amount of no more than 5,000 ppm, such as no more than 2,500 ppm, such as no more than 1,000 ppm, based on a total weight of the composition. The depositable species may be present in the aqueous alkaline composition in an amount of 25 ppm to 5,000 ppm, such as 50 ppm to 2,500 ppm, such as 100 ppm to 1,000 ppm, based on a total weight of the composition.

According to the present invention, the aqueous alkaline cleaner composition may further comprise a defoamer. Suitable defoamers include, for example, BYK-011, BYK-20, BYK-32, and BYK 34, commercially available from BYK-Chemie GmbH, Drewplus L-419, commercially available from Ashland, and FOAM BAN HV-820G, available from Munzing Chemie GmbH. The defoamer may be present in the aqueous alkaline composition in an amount of at least 100 ppm, such as at least 250 ppm, such as at least 500 ppm, and in some instances, may be present in an amount of no more than 10,000 ppm, such as no more than 5,000 ppm, such as no more than 2,500 ppm, based on a total weight of the composition. The defoamer may be present in the aqueous alkaline composition in an amount of 100 ppm to 10,000 ppm, such as 250 ppm to 5,000 ppm, such as 500 ppm to 2,500 ppm, based on a total weight of the composition.

According to the present invention, the aqueous alkaline composition may comprise an aqueous medium and may optionally contain other materials such as auxiliaries conventionally used in the art of cleaner compositions. In the aqueous medium, water dispersible organic solvents, for example, alcohols with up to about 8 carbon atoms such as methanol, isopropanol, and the like, may be present; or glycol ethers such as the monoalkyl ethers of ethylene glycol, diethylene glycol, or propylene glycol, and the like. When present, water dispersible organic solvents are typically used in amounts up to about two percent by volume, based on the total volume of aqueous medium.

Treatment Systems

According to the present invention, the aqueous alkaline cleaner composition described above may be part of a treatment system for treating a metal substrate. The treatment system may comprise, or in some instances consist essentially of, or in some instances consist of, the aqueous alkaline composition for treating a portion of the substrate, as described above, and a pretreatment composition for treating at least a portion of the substrate treated with the aqueous alkaline composition.

For example, the treatment system may comprise, or in some instances consist of, or in some instances consist essentially of: a) an aqueous alkaline cleaner composition comprising, or in some instances, consisting essentially of, or in some instances, consisting of, an iron cation, a molybdenum cation, and/or a cobalt cation and an alkaline component, wherein the pH of the aqueous alkaline cleaner composition is at least 10, and the aqueous alkaline cleaner composition comprises no more than 50 ppm of phosphate based on a total weight of the aqueous alkaline cleaner composition; and b) a Group IVB metal pretreatment composition for treating at least a portion of the substrate, comprising, or in some instances, consisting essentially of, or in some instances, consisting of, a Group IVB metal cation, described in more detail below.

Alternatively, for example, the treatment system for treating metal substrates may comprise, or in some instances consist of, or in some instances consist essentially of: a) an aqueous alkaline cleaning composition comprising, or in some instances, consisting essentially of, or in some instances, consisting of, an iron cation, a molybdenum cation, and/or a cobalt cation and an alkaline component, wherein the pH of the aqueous alkaline composition is at least 10, and the aqueous alkaline composition comprises no more than 50 ppm of phosphate based on a total weight of the aqueous alkaline composition; b) optionally, an activating rinse for treating at least a portion of a substrate; and c) a metal phosphate pretreatment composition for treating at least a portion of the substrate. According to the present invention, the metal phosphate pretreatment composition may comprise, for example, a zinc ion and/or an iron ion and a phosphate ion.

According to the present invention, the aqueous alkaline cleaner composition of the treatment system may be as described above and may be brought into contact with the substrate by any of a variety of known techniques, such as dipping or immersion, spraying, intermittent spraying, dipping followed by spraying, spraying followed by dipping, brushing, or roll-coating. According to the present invention, the aqueous alkaline cleaner composition when applied to the metal substrate may be at a temperature ranging from 10° C. to 90° C., such as from 25° C. to 75° C. For example, the contact with the substrate may be carried out at ambient or room temperature. The contact time is often at least 60 seconds, such as at least 90 seconds, such as at least 120 seconds. According to the present invention, the contact time is often 60 seconds to 120 seconds, such as 75 seconds to 100 seconds.

As mentioned above, according to the present invention, the treatment system also may comprise a pretreatment composition. As used herein, the term "pretreatment composition" refers to a composition that, upon contact with a substrate, reacts with and chemically alters the substrate surface and binds to it to form a protective layer. For example, the pretreatment composition of the treatment system may be a metal phosphate pretreatment composition or a Group IVB pretreatment composition such as those described below.

Metal Phosphate Pretreatment Composition

According to the present invention, the pretreatment composition may be a metal phosphate pretreatment composition comprising a metal ion and a phosphate ion. As used herein, the term "metal phosphate pretreatment composition" refers to a composition comprising phosphates of zinc, iron, and/or other divalent metals known in the art that, upon contact with a substrate, reacts with and chemically alters the substrate surface and binds to it to form a protective layer.

According to the present invention, the metal ion of the metal phosphate pretreatment composition may be zinc and the zinc ion content of the pretreatment composition may be, if present at all, at least 500 ppm, such as at least 800 ppm, and in some instances, may be no more than 1,500 ppm, such as no more than 1,200 ppm, based on total weight of the pretreatment composition. According to the present invention, the zinc ion content of the pretreatment composition may be, if present at all, 500 ppm to 1,500 ppm, such as at least 800 ppm to 1,200 ppm, based on total weight of the pretreatment composition. The source of the zinc ion may be conventional zinc ion sources, such as zinc nitrate, zinc oxide, zinc carbonate, zinc metal, and the like.

According to the present invention, the metal ion of the metal phosphate pretreatment composition may be iron and the iron ion content of the pretreatment composition may be, if present at all, at least 5 ppm, such as at least 8 ppm, such as at least 10 ppm, and in some instances, may be no more than 550 ppm, such as no more than 250 ppm, such as no more than 100 ppm based on total weight of the pretreatment composition. According to the present invention, the zinc ion content of the pretreatment composition may be, if present at all, 5 ppm to 550 ppm, such as 8 ppm to 250 ppm, such as 10 ppm to 100 ppm, based on total weight of the pretreatment composition.

According to the present invention, the phosphate content of the pretreatment composition may be at least 8,000 ppm, such as at least 12,000 ppm, and in some cases may be no more than 20,000 ppm, such as no more than 14,000 ppm, based on total weight of the pretreatment composition. According to the present invention, the phosphate content of the pretreatment composition may be 8,000 ppm to 20,000 ppm, such as 12,000 ppm to 14,000 ppm, based on total weight of the pretreatment composition. The source of phosphate ion may be phosphoric acid, monosodium phosphate, disodium phosphate, and the like.

According to the present invention, in addition to the cations described above, the metal phosphate pretreatment composition also may contain sodium, potassium and/or ammonium ions to adjust the free acid and/or total acid. Free acid and total acid may be determined as described in the Examples below. According to the present invention, the metal phosphate pretreatment composition may have a free acid value of 0.1 points to 2 points, such as 0.5 points to 1.5 points, such as 0.7 points to 1.1 points. According to the present invention, the metal phosphate pretreatment composition may have a total acid value of 5 points to 40 points, such as 7.5 points to 10.5 points, such as 10 points to 30 points, such as 15 points to 24 points.

According to the present invention, the metal phosphate pretreatment composition may have a pH of 3.0 to 6.5, such as 3.0 to 4.0, such as 4.5 to 6.0.

According to the present invention, the metal phosphate pretreatment composition may also comprise an accelerator. The accelerator may be present in an amount sufficient to accelerate the formation of the metal phosphate coating and may be present in the pretreatment composition in an amount of at least 500 ppm, such as at least 1,000 ppm, such as at least 2,500 ppm, and in some instances may be present in an amount of no more than 20,000 ppm, such as no more than 10,000 ppm, such as no more than 5,000 ppm, based on total weight of the pretreatment composition. According to the present invention, the accelerator may be present in the pretreatment composition in an amount of 500 ppm to 20,000 ppm, such as 1,000 ppm to 10,000 ppm, such as 2,500 ppm to 5,000 ppm, based on total weight of the pretreatment composition. Useful accelerators may include oximes such as acetaldehyde oxime and acetoxime, nitrites such as sodium nitrite and ammonium nitrite, peroxides such as hydrogen peroxide, chlorates such as sodium chlorate, or sulfonates such as sodium nitro benzene sulfonate, or combinations thereof.

According to the present invention, the metal phosphate pretreatment composition may also comprise (free) fluoride ion, nitrate ion, and various metal ions, such as nickel ion, cobalt ion, calcium ion, magnesium ion, manganese ion, iron ion, copper ion, and the like.

Fluoride present in the metal phosphate pretreatment composition can be supplied as ammonium and alkali metal fluorides, acid fluorides, fluoroboric, fluorosilicic, and/or other inorganic fluorides. Nonexclusive examples fluoride include: zinc fluoride, zinc aluminum fluoride, nickel fluoride, ammonium fluoride, sodium fluoride, potassium fluoride, and hydrofluoric acid, as well as other similar materials known to those skilled in the art.

Fluoride present in the metal phosphate pretreatment composition that is not bound to metals ions or hydrogen ion, defined herein as "free fluoride," may be measured as an operational parameter in the metal phosphate bath using, for example, an Orion Dual Star Dual Channel Benchtop Meter equipped with a fluoride ion selective electrode ("ISE") available from Thermoscientific, the Symphony® Fluoride Ion Selective Combination Electrode supplied by VWR International, or similar electrodes. See, e.g., Light and Cappuccino, *Determination of fluoride in toothpaste using an ion-selective electrode*, J. Chem. Educ., 52:4, 247-250, April 1975. The fluoride ISE may be standardized by immersing the electrode into solutions of known fluoride concentration and recording the reading in millivolts, and then plotting these millivolt readings in a logarithmic graph. The millivolt reading of an unknown sample can then be compared to this calibration graph and the concentration of fluoride determined. Alternatively, the fluoride ISE can be used with a meter that will perform the calibration calculations internally and thus, after calibration, the concentration of the unknown sample can be read directly.

Fluoride ion is a small negative ion with a high charge density, so in aqueous solution it is frequently complexed with metal ions having a high positive charge density or with hydrogen ion. Fluoride anions in solution that are ionically or covalently bound to metal cations or hydrogen ion are defined herein as "bound fluoride." The fluoride ions thus complexed are not measurable with the fluoride ISE unless the solution they are present in is mixed with an ionic strength adjustment buffer (e.g.: citrate anion or EDTA) that releases the fluoride ions from such complexes. At that point (all of) the fluoride ions are measurable by the fluoride ISE, and the measurement is known as "total fluoride". Alternatively, the total fluoride can be calculated by comparing the weight of the fluoride supplied in the metal phosphate pretreatment composition by the total weight of the pretreatment composition.

Free fluoride may be present in the metal phosphate pretreatment composition in an amount of at least 100 ppm, such as at least 150 ppm, at least 200 ppm and in some instances may be present in an amount of no more than 2000 ppm, such as no more than 1000 ppm, such as no more than 500 and in some cases may be present in an amount of 100 ppm to 3000 ppm, such as 150 ppm to 1,000 ppm, such as 200 to 500 ppm free fluoride based on total weight of the pretreatment composition.

Total fluoride may be present in the metal phosphate pretreatment composition in an amount of at least 200 ppm, such as at least 300 ppm, such as at least 400 ppm and in some instances may be present in an amount of no more than 2,500 ppm, such as no more than 1750 ppm, such as no more than 1250 ppm and in some cases may be present in an amount of 200 ppm to 2,500 ppm, such as 300 ppm to 1,750 ppm, such as 400 ppm to 1250 ppm total fluoride based on total weight of the pretreatment composition.

According to the present invention, nitrate ion may be present in the metal phosphate pretreatment composition in an amount of at least 1,000 ppm, such as at least 2,000 ppm, and in some instances may be present in an amount of no more than 10,000 ppm, such as no more than 5,000 ppm, and in some cases may be present in an amount of 1,000 ppm to 10,000 ppm, such as 2,000 ppm to 5,000 ppm, based on total weight of the pretreatment composition.

According to the present invention, calcium ion may be present in the metal phosphate pretreatment composition in an amount of at least 100 ppm, such as at least 500 ppm, and in some cases, no more than 4,000 ppm, such as no more than 2,500 ppm, and in some cases may be present in an amount of 100 ppm to 4,000 ppm, such as 500 ppm to 2,500 ppm, based on total weight of the pretreatment composition.

According to the present invention, manganese ion may be present in the metal phosphate pretreatment composition in an amount of at least 100 ppm, such as at least 200 ppm, such as at least 500 ppm, and in some cases no more than 1,500 ppm, such as no more than 1,000 ppm, such as no more than 800 ppm, and in some cases, in an amount of 100 ppm to 1,500 ppm, such as from 200 ppm to 1,000 ppm, such as 500 ppm to 800 ppm, based on total weight of the pretreatment composition.

According to the present invention, iron ion may be present in the metal phosphate pretreatment composition in an amount of at least 5 ppm, such as at least 10 ppm, such as at least 50 ppm, and in some cases, no more than 500 ppm, such as no more than 300 ppm, and in some cases, may be present in the pretreatment composition in an amount of 5 ppm to 500 ppm, such as 5 ppm to 20 ppm, such as 50 ppm to 300 ppm, based on total weight of the pretreatment composition.

According to the present invention, copper ion may be present in the metal phosphate pretreatment composition in an amount of at least 1 ppm, such as at least 3 ppm, and in some cases, no more than 30 ppm, such as no more than 15 ppm, and in some cases, may be present in the pretreatment composition in an amount of 1 ppm to 30 ppm, such as 3 ppm to 15 ppm, based on total weight of the pretreatment composition.

According to the present invention, nickel ion may be present in the metal phosphate pretreatment composition in an amount of at least 100 ppm, such as at least 200 ppm, such as at least 300 ppm, and in some instances, may be present in the pretreatment composition in an amount of no more than 1,800 ppm, such as no more than 1,200 ppm, such as no more than 800 ppm, and in some instances, may be present in the pretreatment composition in an amount of 100 ppm to 1,800 ppm, such as 200 ppm to 1,200 ppm, such as 300 ppm to 800 ppm, based on total weight of the pretreatment composition.

According to the present invention, the metal phosphate pretreatment composition may be substantially free, or in some cases, essentially free, or in some cases, completely free, of nickel. As used herein, the term "substantially free," when used with respect to the absence of nickel, means nickel, if present at all in the bath containing the pretreatment composition, the pretreatment composition, and/or layers formed from and comprising same, and, if present at all, only is present in a trace amount of 5 ppm or less, based on a total weight of the composition or layer(s), as the case may be, excluding nickel derived from drag-in, substrate(s), and/or dissolution of equipment. As used herein, the term "essentially free," when used with respect to the absence of nickel, means nickel, if present at all in the bath containing the pretreatment composition, the pretreatment composition, and/or layers formed from and comprising same, and, if present at all, only is present in a trace amount of 1 ppm or less, based on a total weight of the composition or layer(s), as the case may be, excluding nickel derived from drag-in, substrate(s), and/or dissolution of equipment. As used herein, the term "completely free," when used with respect to the absence of nickel, means nickel, is absent from the bath containing the pretreatment composition, the pretreatment composition, and/or layers formed from and comprising same (i.e., the bath containing the pretreatment composition, the pretreatment composition, and/or layers formed from and comprising same contain 0 ppm of nickel, excluding nickel derived from drag-in, substrate(s), and/or dissolution of equipment.

The metal phosphate pretreatment composition may be applied to the substrate by spray application or immersion of the substrate in an acidic phosphate bath comprising said pretreatment composition at a temperature typically ranging from 25° C. to 75° C. typically for 1 to 3 minutes, such as for 1 minute to 2 minutes, such as 1 minute to 90 seconds. The coating that results on the substrate following contacting the substrate with the metal phosphate pretreatment composition may have a thickness of 0.25 μm to 8 μm and a coating weight of 70 mg/ft$^2$ to 800 mg/ft$^2$.

It has been surprisingly discovered that cleaning a substrate with the alkaline cleaner composition of the present invention followed by pretreatment with a metal phosphate pretreatment composition produces a substrate that has a significantly increased fracture energy relative to a substrate cleaned with a cleaning composition that does not include iron and/or cobalt followed by pretreatment with a metal phosphate pretreatment composition, such as, for example a substrate that has a fracture energy of at least 1000 J/m2, such as at least 1500 J/m2, such as at least 2000 J/m2, as tested according to the protocol set forth in the examples. According to the present invention, cleaning a substrate with the alkaline cleaner composition of the present invention followed by pretreatment with a metal phosphate pretreatment composition produces a substrate that has at least a 2× increase in fracture energy relative to a substrate cleaned with a cleaner composition that does not include iron and/or cobalt followed by pretreatment with a metal phosphate pretreatment composition, such as at least a 5× increase in fracture energy, such as at least a 10× increase in fracture energy, as tested according to the protocol set forth in the examples.

Furthermore, it has been surprisingly discovered that in the absence of phosphate ions, iron will deposit as metallic iron on the surface of metals from an alkaline cleaner composition of the present invention. Previous art in this area had suggested that the deposition of iron phosphate from a cleaning composition is critical for improving the performance of pretreatment. In a system which does not contain orthophosphate or $PO_4^{3-}$, iron phosphate cannot form. The deposited metallic iron brings about improvements in corrosion protection as indicated by reductions in scribe creep and adhesion benefits in terms of reduced paint loss from dry and wet crosshatch adhesion or increased fracture energy from t-peel adhesion testing, as tested according to the protocol set forth in the examples.

Furthermore, it has been surprisingly discovered that cleaning a substrate with the alkaline cleaner composition of the present invention followed by pretreatment with a nickel-free metal phosphate pretreatment composition produces a substrate that has a corrosion performance that is comparable to a nickel-containing metal phosphate pretreatment composition treated with a conventional cleaner composition (i.e., a cleaner composition that does not include iron and/or cobalt), as tested according to the protocol set forth in the examples.

Furthermore, it has been surprisingly discovered that cleaning a substrate with the alkaline cleaner composition of the present invention followed by pretreatment with an iron phosphate pretreatment composition produces a substrate that has a corrosion performance that is significantly increased relative to a substrate cleaned with a cleaning composition that does not include iron and/or cobalt and then is followed by pretreatment with an iron phosphate pretreatment composition. According to the present invention, a substrate with the alkaline cleaner composition of the present invention followed by pretreatment with an iron phosphate pretreatment composition produces a substrate that has an average scribe creep of no more than 4.5 mm, such as no more than 4 mm, as tested according to the protocol set forth in the examples. According to the present invention, cleaning a substrate with the alkaline cleaner composition of the present invention followed by pretreatment with a metal phosphate pretreatment composition produces a substrate that has at least a 50% decrease in scribe creep relative to a substrate cleaned with a cleaner composition that does not include iron and/or cobalt followed by pretreatment with a metal phosphate pretreatment composition, such as at least a 55% decrease, such as at least a 60% decrease, such as at least a 65% decrease, such as at least a 70% decrease, as tested according to the protocol set forth in the examples.

Furthermore, it has been surprisingly discovered that the fracture energy can significantly change based on the identity of phosphonates, bisphosphonates, polyphosphonates and/or phosphonic acids used in the cleaner composition. Some of the cleaners produced with combinations of the aforementioned molecules showed large improvements in fracture energy in cleaner compositions containing iron and cobalt, as tested according to the protocol set forth in the examples. Molecules containing a P-C ratio in the ranges described herein were found to be especially effective in creating the increase in fracture energy.

Group IVB Pretreatment Composition

According to the present invention, the pretreatment composition of the present invention may be a Group IVB metal pretreatment composition comprising a Group IVB metal cation. For example, the Group IVB metal cation used in the Group IVB metal pretreatment composition may be a compound of zirconium, titanium, hafnium, scandium, or a mixture thereof. Suitable compounds of zirconium include, but are not limited to, hexafluorozirconic acid, alkali metal and ammonium salts thereof, ammonium zirconium carbonate, zirconyl nitrate, zirconyl sulfate, zirconium carboxylates and zirconium hydroxy carboxylates, such as zirconium acetate, zirconium oxalate, ammonium zirconium glycolate, ammonium zirconium lactate, ammonium zirconium citrate, and mixtures thereof. Suitable compounds of titanium include, but are not limited to, fluorotitanic acid and its salts. A suitable compound of hafnium includes, but is not limited to, hafnium nitrate.

According to the present invention, the Group IVB metal cation may be present in the Group IVB metal pretreatment composition in a total amount of at least 20 ppm metal based on total weight of the pretreatment composition, such as at least 50 ppm, or, in some cases, at least 70 ppm, and in some instances, may be present in the Group IVB metal pretreatment composition in a total amount of no more than 1,000 ppm metal based on total weight of the pretreatment composition, such as no more than 600 ppm metal, such as no more than 300 ppm metal. According to the present invention, the Group IVB metal cation may be present in the Group IVB metal pretreatment composition in a total amount of 20 ppm metal to 1,000 ppm metal based on total weight of the pretreatment composition, such as 50 ppm metal to 600 ppm metal, such as 70 ppm metal to 300 ppm metal. As used herein, the term "total amount," when used with respect to the amount of Group IVB metal means the sum of all Group IV metals present in the Group IVB metal pretreatment composition.

According to the present invention, the Group IVB metal pretreatment composition also may comprise an electropositive metal ion. As used herein, the term "electropositive metal ion" refers to metal ions that will be reduced by the metal substrate being treated when the pretreatment solution contacts the surface of the metallic substrate. As will be appreciated by one skilled in the art, the tendency of chemical species to be reduced is called the reduction potential, is expressed in volts, and is measured relative to the standard hydrogen electrode, which is arbitrarily assigned a reduction potential of zero. The reduction potential for several elements is set forth in Table 1 below (according to the CRC 82$^{nd}$ Edition, 2001-2002). An element or ion is more easily reduced than another element or ion if it has a voltage value, E*, in the following table, that is more positive than the elements or ions to which it is being compared.

TABLE 1

| Element | Reduction half-cell reaction | Voltage, E* |
|---|---|---|
| Potassium | $K^+ + e \rightarrow K$ | −2.93 |
| Calcium | $Ca^{2+} + 2e \rightarrow Ca$ | −2.87 |
| Sodium | $Na^+ + e \rightarrow Na$ | −2.71 |
| Magnesium | $Mg^{2+} + 2e \rightarrow Mg$ | −2.37 |
| Aluminum | $Al^{3+} + 3e \rightarrow Al$ | −1.66 |
| Zinc | $Zn^{2+} + 2e \rightarrow Zn$ | −0.76 |
| Iron | $Fe^{2+} + 2e \rightarrow Fe$ | −0.45 |
| Nickel | $Ni^{2+} + 2e \rightarrow Ni$ | −0.26 |
| Tin | $Sn^{2+} + 2e \rightarrow Sn$ | −0.14 |
| Lead | $Pb^{2+} + 2e \rightarrow Pb$ | −0.13 |
| Hydrogen | $2H^+ + 2e \rightarrow H_2$ | −0.00 |
| Copper | $Cu^{2+} + 2e \rightarrow Cu$ | 0.34 |
| Mercury | $Hg_2^{2+} + 2e \rightarrow 2Hg$ | 0.80 |
| Silver | $Ag^+ + e \rightarrow Ag$ | 0.80 |
| Gold | $Au^{3+} + 3e \rightarrow Au$ | 1.50 |

Thus, as will be apparent, when the metal substrate comprises one of the materials listed earlier, such as cold rolled steel, hot rolled steel, steel coated with zinc metal, zinc compounds, or zinc alloys, hot-dipped galvanized steel, galvanealed steel, steel plated with zinc alloy, aluminum alloys, aluminum plated steel, aluminum alloy plated steel, magnesium and magnesium alloys, suitable electropositive metal ions for deposition thereon include, for example, nickel, copper, silver, and gold, as well mixtures thereof.

According to the present invention, when the electropositive metal ion comprises copper, both soluble and insoluble compounds may serve as a source of copper ions in the pretreatment compositions. For example, the supplying source of copper ions in the pretreatment composition may be a water soluble copper compound. Specific examples of such compounds include, but are not limited to, copper sulfate, copper nitrate, copper thiocyanate, disodium copper ethylenediaminetetraacetate tetrahydrate, copper bromide, copper oxide, copper hydroxide, copper chloride, copper fluoride, copper gluconate, copper citrate, copper lauroyl sarcosinate, copper lactate, copper oxalate, copper tartrate, copper malate, copper succinate, copper malonate, copper maleate, copper benzoate, copper salicylate, copper amino acid complexes, copper fumarate, copper glycerophosphate, sodium copper chlorophyllin, copper fluorosilicate, copper fluoroborate and copper iodate, as well as copper salts of carboxylic acids such as in the homologous series formic acid to decanoic acid, and copper salts of polybasic acids in the series oxalic acid to suberic acid.

When copper ions supplied from such a water-soluble copper compound are precipitated as an impurity in the form of copper sulfate, copper oxide, etc., it may be desirable to add a complexing agent that suppresses the precipitation of copper ions, thus stabilizing them as a copper complex in the composition.

According to the present invention, the copper compound may be added as a copper complex salt such as or Cu-EDTA, which can be present stably in the pretreatment composition on its own, but it is also possible to form a copper complex that can be present stably in the pretreatment composition by combining a complexing agent with a compound that is difficult to solubilize on its own. An example thereof includes a Cu-EDTA complex formed by a combination of $CuSO_4$ and EDTA.2Na.

According to the present invention, the electropositive metal ion may be present in the pretreatment composition in an amount of at least 2 ppm (calculated as metal ion), based on the total weight of the pretreatment composition, such as at least 4 ppm, such as at least 6 ppm, such as at least 8 ppm, such as at least 10 ppm. According to the present invention, the electropositive metal ion may be present in the pretreatment composition in an amount of no more than 100 ppm (calculated as metal ion), based on the total weight of the pretreatment composition, such as no more than 80 ppm, such as no more than 60 ppm, such as no more than 40 ppm, such as no more than 20 ppm. According to the present invention, the electropositive metal ion may be present in the pretreatment composition in an amount of from 2 ppm to 100 ppm (calculated as metal ion), based on the total weight of the pretreatment composition, such as from 4 ppm to 80 ppm, such as from 6 ppm to 60 ppm, such as from 8 ppm to 40 ppm, The amount of electropositive metal ion in the pretreatment composition can range between the recited values inclusive of the recited values. According to the present invention, a source of fluoride may be present in the Group IVB pretreatment composition. As used herein the amount of fluoride disclosed or reported in the pretreatment composition is referred to as "free fluoride," as measured in part per millions of fluoride. Free fluoride is defined herein as being able to be measured by a fluoride-selective ISE. In addition to free fluoride, a pretreatment may also contain "bound fluoride, which is described above. The sum of the concentrations of the bound and free fluoride equal the total fluoride, which can be determined as described herein. The total fluoride in the pretreatment composition can be supplied by hydrofluoric acid, as well as alkali metal and ammonium fluorides or hydrogen fluorides. Additionally, total fluoride in the pretreatment composition may be derived from Group IVB metals present in the pretreatment composition, including, for example, hexafluorozirconic acid or hexafluorotitanic acid. Other complex fluorides, such as $H_2SiF_6$ or $HBF_4$, can be added to the pretreatment composition to supply total fluoride. The skilled artisan will understand that the presence of free fluoride in the pretreatment bath can impact pretreatment deposition and etching of the substrate, hence it is critical to measure this bath parameter. The levels of free fluoride will depend on the pH and the addition of chelators into the pretreatment bath and indicates the degree of fluoride association with the metal ions/protons present in the pretreatment bath. For example, pretreatment compositions of identical total fluoride levels can have different free fluoride levels which will be influenced by the pH and chelators present in the pretreatment solution.

According to the present invention, the free fluoride of the pretreatment composition may be present in an amount of at least 15 ppm, based on a total weight of the pretreatment composition, such as at least 50 ppm free fluoride, such as at least 100 ppm free fluoride, such as at least 200 ppm free fluoride. According to the present invention, the free fluoride of the pretreatment composition may be present in an amount of no more than 2500 ppm, based on a total weight of the pretreatment composition, such as no more than 1000 ppm free fluoride, such as no more than 500 ppm free fluoride, such as no more than 250 ppm free fluoride. According to the present invention, the free fluoride of the pretreatment composition may be present in an amount of 15 ppm free fluoride to 2500 ppm free fluoride, based on a total weight of the pretreatment composition, such as 50 ppm fluoride to 1000 ppm, such as no more than 200 ppm free fluoride to 500 ppm free fluoride, such as no more than 100 ppm free fluoride to 250 ppm free fluoride.

According to the present invention, the Group IVB metal pretreatment composition may comprise a source of molybdenum. According to the present invention, the source of molybdenum used in the Group IVB metal pretreatment composition may be in the form of a salt. Suitable molybdenum salts may include sodium molybdate, calcium molybdate, potassium molybdate, ammonium molybdate, molybdenum chloride, molybdenum acetate, molybdenum sulfamate, molybdenum formate, or molybdenum lactate.

According to the present invention, molybdenum may be present in the Group IVB metal pretreatment composition in an amount of at least 5 ppm (calculated as elemental metal), such as at least 20 ppm, such as at least 50 ppm, and may be present in an amount of no more than 500 ppm, such as no more than 300 ppm, such as no more than 150 ppm, based on the total weight of the Group IVB metal pretreatment composition. Molybdenum may be present in the Group IVB metal pretreatment composition is an amount of 5 ppm to 500 ppm, such as 5 ppm to 150 ppm, based on the total weight the Group IVB metal pretreatment composition. According to the present invention, the molar ratio of the Group IVB metal to molybdenum may be between 100:1 and 1:10, such as between 30:1 and 1:1.

According to the present invention, the Group IVB metal pretreatment compositions also may comprise lithium. According to the present invention, the source of lithium used in the pretreatment composition may be in the form of a salt. Suitable lithium salts may include lithium nitrate, lithium sulfate, lithium fluoride, lithium chloride, lithium hydroxide, lithium carbonate, and lithium iodide.

According to the present invention, lithium may be present in the Group IVB metal pretreatment composition in an amount of 5 to 500 ppm, such as 25 to 125 ppm, based on the total weight of the pretreatment composition. According to the present invention, lithium may be present in the pretreatment composition in an amount of less than 200 ppm. The amount of lithium in the pretreatment composition can range between the recited values inclusive of the recited values. According to the present invention, the molar ratio of the Group IVB metal to lithium may be between 100:1 and 1:100, for example, between 12:1 and 1:50.

According to the present invention, the Group IVB metal pretreatment composition also may comprise a resinous binder. Suitable resins include reaction products of one or more alkanolamines and an epoxy-functional material containing at least two epoxy groups, such as those disclosed in U.S. Pat. No. 5,653,823. In some cases, such resins contain beta hydroxy ester, imide, or sulfide functionality, incorporated by using dimethylolpropionic acid, phthalimide, or mercaptoglycerine as an additional reactant in the preparation of the resin. Alternatively, the reaction product may be that of the diglycidyl ether of Bisphenol A (commercially available from Shell Chemical Company as EPON 880), dimethylol propionic acid, and diethanolamine in a 0.6 to 5.0:0.05 to 5.5:1 mole ratio. Other suitable resinous binders may include water soluble and water dispersible polyacrylic acids as disclosed in U.S. Pat. Nos. 3,912,548 and 5,328,525; phenol formaldehyde resins as described in U.S. Pat. No. 5,662,746; water soluble polyamides such as those disclosed in WO 95/33869; copolymers of maleic or acrylic acid with allyl ether as described in Canadian patent application 2,087,352; and water soluble and dispersible resins including epoxy resins, aminoplasts, phenol-formaldehyde resins, tannins, and polyvinyl phenols as discussed in U.S. Pat. No. 5,449,415.

According to the present invention, the resinous binder may be present in the Group IVB metal pretreatment composition in an amount of 0.005 percent to 30 percent by weight, such as 0.5 to 3 percent by weight, based on the total weight of the Group IVB metal pretreatment composition.

According to the present invention, the Group IVB metal pretreatment composition may be substantially free or, in some cases, completely free of any resinous binder. As used herein, the term "substantially free", when used with reference to the absence of resinous binder in the Group IVB metal pretreatment composition, means that any resinous binder is present in the Group IVB metal pretreatment composition in a trace amount of less than 0.005 percent by weight based on the total weight of the pretreatment composition. As used herein, the term "completely free" means that there is no resinous binder in the pretreatment composition at all.

Optionally, according to the present invention, the Group IVB metal pretreatment composition also may further comprise a source of phosphate ions. For example, in some instances, phosphate ions may be present in an amount of greater than 5 ppm, based on a total weight of the Group IVB metal pretreatment composition, such as 10 ppm, such as 20 ppm. In some instances, phosphate ions may be present in an amount of no more than 60 ppm, based on a total weight of the Group IVB metal pretreatment composition, such as no more than 40 ppm, such as no more than 30 ppm. In some instances, phosphate ions may be present in an amount of 5 ppm to 60 ppm, based on a total weight of the Group IVB metal pretreatment composition, such as 10 ppm to 40 ppm, such as 20 ppm to 30 ppm.

Alternatively, according to the present invention, the Group IVB metal pretreatment composition may, in some instances, exclude phosphate ions or phosphate-containing compounds and/or the formation of sludge, such as aluminum phosphate, iron phosphate, and/or zinc phosphate, formed in the case of using a treating agent based on zinc phosphate. When a composition and/or a layer or coating comprising the same is substantially free, essentially free, or completely free of phosphate, this includes phosphate ions or compounds containing phosphate in any form.

Thus, according to the present invention, Group IVB metal pretreatment composition and/or layers deposited from the same may be substantially free, or in some cases may be essentially free, or in some cases may be completely free, of phosphate. The term "substantially free" means that the Group IVB metal pretreatment compositions and/or layers deposited from the same contain no more than 25 ppm of phosphate, based on total weight of the composition or the layer, respectively, if any at all. The term "essentially free" means that the Group IVB metal pretreatment compositions and/or layers comprising the same contain less than 10 ppm of phosphate. The term "completely free" means that the Group IVB metal pretreatment compositions and/or layers comprising the same contain less than 1 ppb of phosphate, if any at all.

According to the present invention, the Group IVB metal pretreatment composition may exclude chromium or chromium-containing compounds. As used herein, the term "chromium-containing compound" refers to materials that include hexavalent chromium. Non-limiting examples of such materials include chromic acid, chromium trioxide, chromic acid anhydride, dichromate salts, such as ammonium dichromate, sodium dichromate, potassium dichromate, and calcium, barium, magnesium, zinc, cadmium, and strontium dichromate. When a Group IVB metal pretreatment composition and/or a coating or a layer, respectively, deposited from the same is substantially free, essentially free, or completely free of chromium, this includes chromium in any form, such as, but not limited to, the hexavalent chromium-containing compounds listed above.

Thus, optionally, according to the present invention, the present Group IVB metal pretreatment compositions and/or coatings or layers, respectively, deposited from the same may be substantially free, may be essentially free, and/or may be completely free of one or more of any of the elements or compounds listed in the preceding paragraph. A Group IVB metal pretreatment composition and/or coating or layer, respectively, deposited from the same that is substantially free of chromium or derivatives thereof means that chromium or derivatives thereof are not intentionally added, but may be present in trace amounts, such as because of impurities or unavoidable contamination from the environment. In other words, the amount of material is so small that it does not affect the properties of the Group IVB metal pretreatment composition; in the case of chromium, this may further include that the element or compounds thereof are not present in the Group IVB metal pretreatment compositions and/or coatings or layers, respectively, deposited from the same in such a level that it causes a burden on the environment. The term "substantially free" means that the Group IVB metal pretreatment compositions and/or coating or layers, respectively, deposited from the same contain less than 10 ppm of any or all of the elements or compounds listed in the preceding paragraph, based on total weight of the composition or the layer, respectively, if any at all. The term "essentially free" means that the Group IVB metal pretreatment compositions and/or coatings or layers, respectively, deposited from the same contain less than 1 ppm of any or all of the elements or compounds listed in the preceding paragraph, if any at all. The term "completely free" means that the Group IVB metal pretreatment compositions and/or coatings or layers, respectively, deposited from the same contain less than 1 ppb of any or all of the elements or compounds listed in the preceding paragraph, if any at all.

According to the present invention, the pH of the Group IVB metal pretreatment composition may be, in some instances, 6.5 or less, such as 5.5 or less, such as 4.5 or less, such as 3.5 or less. According to the present invention, the pH of the Group IVB metal pretreatment composition may, in some instances, range from 2.5 to 6.5, such as from 3.0 to 5.5, and may be adjusted and/or maintained by using, for example, any acid and/or base as is necessary. For example, according to the present invention, the pH of the composition may be maintained through the inclusion of an acidic material, including water soluble and/or water dispersible acids, such as nitric acid, sulfuric acid, and/or phosphoric acid. According to the present invention, the pH of the composition may be maintained through the inclusion of a basic material, including water soluble and/or water dispersible bases, such as sodium hydroxide, sodium carbonate, potassium hydroxide, ammonium hydroxide, ammonia, and/or amines such as triethylamine, methylethyl amine, or mixtures thereof.

The Group IVB metal pretreatment composition may comprise a carrier, often an aqueous medium, so that the composition is in the form of a solution or dispersion of the Group IVB metal in the carrier. According to the present invention, the solution or dispersion may be brought into contact with the substrate by any of a variety of known techniques, such as dipping or immersion, spraying, intermittent spraying, dipping followed by spraying, spraying followed by dipping, brushing, or roll-coating. According to the invention, the solution or dispersion when applied to the metal substrate is at a temperature ranging from 60 to 185° F. (15 to 85° C.). For example, the pretreatment process may be carried out at ambient or room temperature. The contact time is often from 10 seconds to 5 minutes, such as 30 seconds to 2 minutes. The coating that results on the substrate following contacting the substrate with the Group IVB metal pretreatment composition may have a thickness of 20 nm to 400 nm and a coating weight of 10 mg/ft$^2$ to 250 mg/ft$^2$, expressed as elemental Group IVB metal. Coating weights may be determined by removing the film from the substrate and determining the elemental composition using a variety of analytical techniques (such as XRF, ICP, etc.). Pretreatment thickness can be determined using a handful of analytical techniques including, but not limited to XPS depth profiling or TEM.

Following the contacting with the Group IVB metal pretreatment composition, the substrate may be rinsed with tap water, deionized water, and/or an aqueous solution of rinsing agents in order to remove any residue. The substrate optionally may be dried, for example air dried or dried with hot air, for example, by using an air knife, by flashing off the water by brief exposure of the substrate to a high temperature, such as by drying the substrate in an oven at 15° C. to 200° C. or in a heater assembly using, for example, infrared heat, such as for 10 minutes at 70° C., or by passing the substrate between squeegee rolls. It has been surprisingly discovered that cleaning a substrate with the cleaning composition of the present invention followed by pretreatment with a Group IVB metal pretreatment composition produces a substrate that has a significantly increased fracture energy relative to a substrate cleaned with a cleaning composition that does not include iron and/or cobalt followed by pretreatment with a Group IVB metal pretreatment composition, such as, for example a substrate that has a fracture energy of at least 1500 J/m2, such as at least 1750 J/m2, such as at least 2000 J/m2, as tested according to the protocol set forth in the examples. For example, cleaning a substrate with the cleaning composition of the present invention followed by pretreatment with a Group IVB metal pretreatment composition produces a substrate that has at least a 1× increase in fracture energy relative to a substrate cleaned with a cleaning composition that does not include iron and/or cobalt followed by pretreatment with a Group IVB metal pretreatment composition, such as at least a 1.5× increase in fracture energy, such at least a 2× increase in fracture energy, as tested according to the protocol set forth in the examples.

Furthermore, it has been surprisingly discovered that cleaning a substrate with the cleaner composition of the present invention followed by pretreatment with a Group IVB metal pretreatment composition produces a substrate that has a significantly improved corrosion resistance as demonstrated by the reduced scribe creep relative to a substrate cleaned with a cleaning composition that does not include iron and/or cobalt followed by pretreatment with a Group IVB metal pretreatment composition, such as, for example a substrate that less than 10 mm scribe creep, such as less than 9 mm scribe creep, such as less than 8 mm scribe creep, such as less than 7 mm scribe creep, such as less than 6 mm scribe creep, as tested according to the protocol set forth in the examples. For example, cleaning a substrate with the cleaning composition of the present invention followed by pretreatment with a Group IVB metal pretreatment composition produces a substrate that has at least a 10% reduction in scribe creep relative to a substrate cleaned with a cleaning composition that does not include iron and/or cobalt followed by pretreatment with a Group IVB metal pretreatment composition, such as at least a 25% decrease in scribe creep, such as at least a 50% decrease in scribe creep, such as at least a 70% decrease in scribe creep, such as at least a 80% decrease in scribe creep, as tested according to the protocol set forth in the examples. It also has been surprisingly discovered that these results are enhances by inclusion of molybdenum and lithium in the Group IVB metal pretreatment composition, as demonstrated by the reduced scribe creep relative to a substrate cleaned with a cleaning composition that does not include iron and/or cobalt followed by pretreatment with a Group IVB metal pretreatment composition that contains molybdenum and lithium, such as, for example a substrate that less than 8 mm scribe creep, such as less than 5 mm scribe creep, such as less than 4 mm scribe creep, such as less than 3 mm scribe creep, as tested according to the protocol set forth in the examples.

Furthermore, it has been surprisingly discovered that cleaning a substrate with the cleaner composition of the present invention including molybdenum and/or iron followed by pretreatment with a Group IVB metal pretreatment composition produces a substrate that has a scribe creep of less than 6 mm, such as less than 5 mm, such as less than 4 mm, as tested according to the protocol set forth in the examples, which is at least as good or an improvement relative to a substrate cleaned with a cleaning composition that does not include molybdenum and/or iron followed by pretreatment with a Group IVB metal pretreatment composition. Notably, inclusion of molybdenum alone or in combination with iron produces a substrate that has a scribe creep that is at least good or an improvement relative to a substrate cleaned with a cleaner of the present invention comprising cobalt and/or iron, which is a significant result in view of the environmental and health concerns with cobalt-containing compositions.

Furthermore, it has been surprisingly discovered that the fracture energy can significantly change based on the identity of phosphonates, bisphosphonates, polyphosphonates and/or phosphonic acids used in the cleaner composition. Some of the cleaners produced with combinations of the aforementioned molecules showed large improvements in fracture energy for cleaner compositions containing iron and cobalt. The chemical nature of the phosphonate, polyphosphonate, bisphosphonate or phosphonic acid can be adjusted to yield large gains in primer adhesion. Molecules containing a P-C ratio in the ranges described herein were found to be especially effective in creating the increase in fracture energy.

According to the present invention, after contacting the substrate with the pretreatment composition, the substrate may be contacted with a second pretreatment composition. The second pretreatment composition may be a Group IIIB pretreatment composition (described below) and/or Group IVB metal pretreatment composition as described above. For example, after contacting the substrate with the metal phosphate pretreatment composition, the substrate may then be contacted with a second pretreatment composition comprising a thin-film pretreatment composition.

Activating Rinse

Optionally, according to the present invention, the treatment system may include an activating rinse for treating at least a portion of the substrate. As used herein, the phrase "activating rinse" refers to a continuous aqueous medium having dispersed and/or suspended therein metal phosphate particles that is applied onto at least a portion of a substrate and/or into which at least a portion of a substrate is immersed to "activate" or "condition" the substrate in order to promote the formation of a metal phosphate coating on at least a portion of the substrate that was treated with the activating rinse. As used herein, to "activate" or "condition" the substrate surface means to create nucleation sites on the substrate surface. While not wishing to be bound by theory, it is believed that such nucleation sites promote the formation of metal phosphate crystals on the substrate surface when the substrate surface is treated with a metal phosphate pretreatment composition afterwards. For example, activation of the substrate surface is believed to create nucleation sites that promote the formation of zinc and zinc/iron phosphate crystals on the substrate surface when the substrate surface is pretreated with a zinc phosphate pretreatment composition.

According to the present invention, the metal phosphate particles of the dispersion of metal phosphate particles of divalent or trivalent metals or combinations thereof may have a $D_{90}$ particle size that is not greater than 10 μm, such as not greater than 8 μm, such as not greater than 5 μm, such as not greater than 2 μm, such as not greater than 1 μm and in some cases may be at least 0.06 μm, such as at least 0.1 μm, such as at least 0.2 μm. According to the present invention, the metal phosphate particles of the dispersion of phosphate particles of divalent or trivalent metals or combinations thereof may have a $D_{90}$ particle size of 0.06 μm to 8 μm, such as 0.1 μm to 5 μm, such as 0.2 μm to 2 μm.

As used herein, the term "$D_{90}$" particle size refers to a volume-weighted particle distribution in which 90% of the particles in the particle distribution have a diameter smaller than the "$D_{90}$" value. According to the present invention, particle size may be measured using an instrument such as a Mastersizer 2000, available from Malvern Instruments, Ltd., of Malvern, Worcestershire, UK, or an equivalent instrument. The Mastersizer 2000 directs a laser beam (0.633 mm diameter, 633 nm wavelength) through a dispersion of particles (in distilled, deionized or filtered water to 2-3% obscuration), and measures the light scattering of the dispersion (measurement parameters 25° C., 2200 RPM, 30 sec premeasurement delay, 10 sec background measurement, 10 sec sample measurement). The amount of light scattered by the dispersion is inversely proportional to the particle size. A series of detectors measure the scattered light and the data are then analyzed by computer software (Malvern Mastersizer 2000 software, version 5.60) to generate a particle size distribution, from which particle size can be routinely determined. According to the present invention, the sample of dispersion of particles optionally may be sonicated prior to analysis.

According to the present invention, the metal phosphate particles may be substantially pulverized, such that more than 50% of the metal phosphate particles in the activating rinse composition are pulverized, such as more than 60%, such as more than 70%, such as more than 80%, such as more than 90%. According to the present invention, the metal phosphate particles may be completely pulverized, such that 100% of the particles are pulverized. As used herein, the term "pulverized" refers to particles having a non-uniform shape.

According to the present invention, the metal phosphate (as total metal compound) may be present in the activating rinse in an amount of at least 50 ppm, based on total weight of the activating rinse, such as at least 150 ppm, and in some instances may be present in the activating rinse in an amount of no more than 5,000 ppm, based on total weight of the activating rinse, such as no more than 1,500 ppm. According to the present invention, the metal phosphate (as total metal compound) may be present in the activating rinse in an amount of 50 ppm to 5,000 ppm of total metal phosphate based on the total weight of the activating rinse, such as of 150 ppm to 1,500 ppm.

According to the present invention, the divalent or trivalent metal of the metal phosphate may comprise zinc, iron, calcium, manganese, aluminum, or combinations thereof. If combinations of different metal phosphates are employed, they may comprise the same or different metals, and may be selected from the particular zinc, iron, calcium, manganese and aluminum phosphates mentioned in the following.

Suitable zinc phosphates useful in the activating rinse bath include, without limitation $Zn_3(PO_4)_2$, $Zn_2Fe(PO_4)_2$, $Zn_2Ca(PO_4)_2$, $Zn_2Mn(PO_4)_2$, or combinations thereof.

Suitable iron phosphates useful in the activating rinse bath include, without limitation $FePO_4$, $Fe_3(PO_4)_2$, or combinations thereof.

Suitable calcium phosphates useful in the activating rinse bath include, without limitation $CaHPO_4$, $Ca_3(PO_4)_2$, or combinations thereof.

Suitable manganese phosphates useful in the activating rinse bath include, without limitation $Mn_3(PO_4)_2$, $MnPO_4$, or combinations thereof.

Suitable aluminum phosphates useful in the activating rinse bath include, without limitation $AlPO_4$.

According to the present invention, the activating rinse may further comprise a dispersant. The dispersant may be ionic or non-ionic. Suitable ionic dispersants useful in the activating rinse may comprise an aromatic organic acid, a phenolic compound, a phenolic resin, or combinations thereof. Suitable non-ionic dispersants useful in the activating rinse may include non-ionic polymers, in particular those comprised of monomers (or residues thereof) including propylene oxide, ethylene oxide, styrene, a monoacid such as (meth)acrylic acid, a diacid such as maleic acid or itaconic acid, an acid anhydride such as acrylic anhydride or maleic anhydride, or combinations thereof. Examples of suitable commercially available non-ionic dispersants include DISPERBYK®-190 available from BYK-Chemie GmbH and ZetaSperse® 3100 available from Air Products Chemicals Inc.

According to the present invention, the activating rinse may include a metal sulfate salt. The metal of the metal sulfate may be the same as or different from the metal of the metal phosphate particles. According to the present invention, the metal of the metal sulfate salt may comprise a divalent metal, a trivalent metal or combinations thereof, such as, for example, nickel, copper, zinc, iron, magnesium, cobalt, aluminum or combinations thereof.

According to the present invention, the sulfate ion of the metal sulfate salt may be present in the activating rinse in an amount of at least 10 ppm based on the total weight of the activating rinse, such as at least 25 ppm, such as at least 50 ppm, such as at least 100 ppm, such as at least 200 ppm, such as at least 500 ppm, and in some cases, no more than the solubility limit of the metal sulfate salt in the activating rinse, such as no more than 5,000 ppm, such as no more than 1,000 ppm, such as no more than 500 ppm, such as no more than 200 ppm, such as no more than 100 ppm. According to the present invention, the sulfate ion of the metal sulfate salt may be present in an amount of 10 ppm to 5,000 ppm based on a total weight of the activating rinse, such as 25 ppm to 5,000 ppm, such as 50 ppm to 1,000 ppm, such as 200 ppm to 500 ppm.

According to the present invention, the activating rinse may include a wetting agent. According to the present invention, wetting agents may be present at amounts of up to 2 percent by weight, such as up to 0.5 percent by weight, based on the total weight of the activating rinse. In some instances, wetting agents may be present in amounts of 0.1 percent by weight to 2 percent by weight, based on the total weight of the activating rinse, such as 0.3 percent by weight to 0.5 percent by weight. As used herein, a "wetting agent" reduces the surface tension at the interface between the surface of the particles of the dispersed phase and the aqueous medium to allow the aqueous medium to more evenly contact or "wet" the surface of the particles of the dispersed phase.

According to the present invention, the activating rinse may have a pH of 6 to 12, such as 6.5 to 9, such as 7.5 to 8.5, such as 7 to 8. An alkaline component may be present in the activating rinse in an amount sufficient to adjust the pH of the activating rinse. Suitable alkaline components may include, for example, sodium hydroxide, sodium carbonate, sodium tripolyphosphate, potassium orthophosphate, or combinations thereof.

According to the present invention, the activating rinse may also include a biocide. Suitable biocides include, for example, methyl chloro isothiazolinone, methyl isothiazolinone, or combinations thereof. When utilized, the biocide may be present in an amount of at least 10 ppm based on the total weight of the activating rinse, such as at least 20 ppm, such as at least 80 ppm, such as at least 100 ppm, and in some instances, no more than 140 ppm, such as no more than 120 ppm, such as no more than 40 ppm, such as no more than 30 ppm. According to the present invention, the biocide may be present in an amount of 10 ppm to 140 ppm based on the total weight of the activating rinse, such as 10 ppm to 40 ppm, such as 20 ppm to 30 ppm, such as 80 ppm to 140 ppm, such as 100 ppm to 120 ppm. The skilled artisan will recognize that biocides may be included in the activating rinse in amounts based on manufacturer instructions.

According to the present invention, the activating rinse may further comprise silica. According to the present invention, the silica may be a precipitated silica, such as a synthetic amorphous precipitated silica. According to the present invention, the silica may be friable under shear. As used herein, "friable under shear" means that particle size may be reduced with shear. According to the present invention, the silica may comprise, for example, Hi-Sil™ EZ 160G silica (commercially available from PPG Industries, Inc.). According to the present invention, if present, the silica may be present in an amount of at least 50 ppm, based on the total weight of the activating rinse, such as at least 100 ppm, such as at least 150 ppm, and in some instances, no more than 5000 ppm, based on the total weight of the activating rinse, such as no more than 1000 ppm, such as no more than 500 ppm. According to the present invention, the silica may be present in the activating rinse in an amount of 50 ppm to 5,000 ppm based on the total weight of the activating rinse, such as 100 ppm to 1,000 ppm, such as from 150 ppm to 500 ppm.

The activating rinse may optionally further comprise components in addition to the dispersant (i.e., components different than the dispersant), such as nonionic surfactants and auxiliaries conventionally used in the art. Such additional optional components include surfactants that function as defoamers. Amphoteric and/or nonionic surfactants may be used. Defoaming surfactants may be present, if at all, in amounts of at least at least 0.1 percent by weight, based on the total weight of the activating rinse, such as at least 0.5 weight percent by weight, and in some instances, may be present in amounts of no more than 1 weight percent, such as no more than 0.7 percent by weight, based on the total weight of the activating rinse. In some instances, defoaming surfactants may be present, if at all, in amounts of 0.1 weight percent to 1 weight percent, such as 0.5 weight percent to 0.7 percent by weight, based on the total weight of the activating rinse.

According to the present invention, the activating rinse may further comprise a rheology modifier in addition to the dispersant (i.e., different than the dispersant). The rheology modifier may comprise, for example, polyurethanes, acrylic polymers, latices, styrene/butadiene, polyvinylalcohols, clays such as attapulgite, bentonite, and other montmorillonite, cellulose based materials such as carboxymethyl cellulose, methyl cellulose, (hydroxypropyl)methyl cellulose or gelatin, gums such as guar and xanthan, or combinations thereof.

According to the present invention, the activating rinse may, in some instances, be substantially or, in some cases, completely, free of titanium-phosphate particles. As used herein, the term "substantially free," when used in reference to the absence of titanium-phosphate particles in the activating rinse, means that any titanium-phosphate particles present in the activating rinse are not purposefully added and are present in a trace amount of less than 5 ppm, based on the total weight of the activating rinse. As used herein, the term "completely free," when used in reference to the absence of titanium-phosphate particles, means that there are no titanium-phosphate particles at all.

According to the present invention, optionally, the activating rinse may, in some instances, comprise colloidal titanium-phosphate particles. According to the present invention, the titanium may be present in the activating rinse, if at all, in an amount of at least 1 ppm based on total weight of the activating rinse, such as at least 2 ppm, and in some instances may be present in an amount of no more than 6 ppm based on total weight of the activating rinse, such as no more than 3.5 ppm. According to the present invention, the titanium may be present in the activating rinse, if at all, in an amount of 1 ppm to 6 ppm, such 2 ppm to 3.5 ppm, and the pH may be 7.5 to 10, such as 8 to 9.5.

The activating rinse bath can be prepared by mixing the activating rinse as a concentrate with an aqueous medium such as water. According to the present invention, the activating rinse bath may comprise a chelator. The chelator may comprise, for example, carboxylates such as tartrates, citrates or gluconates, acetate based complexes such as ethylenediaminetetraacetate or nitrilotriacetate, phosphates such as pentasodium triphosphate or tetrapotassium pyrophosphate, phosphonates, polycarboxylates, the acids, esters, or salts of any of the aforementioned, or combinations thereof.

According to the present invention, the activating rinse can be applied to the substrate surface by spray, roll-coating or immersion techniques. The activating rinse may be applied onto the substrate at a temperature of, for example, 15° C. to 50° C., such as 25° C. to 35° C. for any suitable period of time, such as at least 1 second, such as at least 10 seconds, such as at least 2 minutes, such as at least 5 minutes.

Prerinse Composition

Optionally, according to the present invention, the treatment system may further comprise a pre-rinse composition for treating a substrate. According to the present invention, the pre-rinse composition may comprise a fluoride source. As used herein the amount of fluoride disclosed or reported in the pre-rinse composition is referred to a "total fluoride," as measured in part per millions of fluoride.

Often, the pre-rinse composition may comprise a carrier, often an aqueous medium, so that the pre-rinse composition may be in the form of a solution or dispersion of the pre-rinse composition in the carrier. In such instances, the solution or dispersion may be brought into contact with the substrate by any of a variety of known techniques, such as dipping or immersion, spraying, intermittent spraying, dipping followed by spraying, spraying followed by dipping, brushing, or roll-coating. According to the present invention, the solution or dispersion when applied to the metal substrate is at a temperature ranging from 50 to 200° F., such as from 75-125° F. For example, the pre-rinse process may be carried out at ambient or room temperature. The contact time is often from 15 seconds to 10 minutes, such as 30 seconds to 2 minutes.

The fluoride present in the pre-rinse composition may reported in total fluoride, expressed in ppm. The total fluoride can be measured or calculated as described above. The total fluoride in the pre-rinse composition can be supplied by hydrofluoric acid, as well as alkali metal and ammonium fluorides or hydrogen fluorides. Additionally, total fluoride in the pre-rinse composition may be derived from Group IVB metals present in the pretreatment composition, including, for example, hexafluorozirconic acid or hexafluorotitanic acid. Other complex fluorides, such as $H_2SiF_6$ or $HBF_4$, can be added to the pre-rinse composition to supply total fluoride.

The total fluoride source may be present in the pre-rinse composition in an amount of at least 10 ppm, based on a total weight of the pre-rinse composition, such as at least 100 ppm, measured as described above. The total fluoride source may be present in the pre-rinse composition in an amount of no more than 5,000 ppm, based on a total weight of the pre-rinse composition, such as at least 2,000 ppm. The total fluoride source may be present in the pre-rinse composition in an amount of 10 ppm to 5,000 ppm, based on a total weight of the pre-rinse composition, such as 100 ppm to 2,000 ppm.

The pH of the pre-rinse composition may be below 7, such as 2.5 to 5, and may be adjusted by varying the amount of the dissolved complex metal fluoride ion present in the composition, or may be adjusted using, for example, any acid or base as is necessary. For example, the pH of the pre-rinse composition may be maintained through the inclusion of a basic material, including water soluble and/or water dispersible bases, such as sodium hydroxide, sodium carbonate, potassium hydroxide, ammonium hydroxide, ammonia, and/or amines such as triethylamine, methylethyl amine, or combinations thereof.

The total fluoride in the pre-rinse composition can be supplied by hydrofluoric acid, as well as alkali metal and ammonium fluorides or hydrogen fluorides. Additionally, total fluoride in the pre-rinse composition may be derived from Group IVB metals present in the pretreatment composition, including, for example, hexafluorozirconic acid or hexafluorotitanic acid. Other complex fluorides, such as $H_2SiF_6$ or $HBF_4$, can be added to the pre-rinse composition to supply total fluoride.

The free fluoride source may be present in the pre-rinse composition in an amount of at least 10 ppm, based on a total weight of the pre-rinse composition, such as at least 100 ppm, measured as described above. The free fluoride source may be present in the pre-rinse composition in an amount of no more than 5,000 ppm, based on a total weight of the pre-rinse composition, such as at least 2,000 ppm. The free fluoride source may be present in the pre-rinse composition in an amount of 10 ppm to 5,000 ppm, based on a total weight of the pre-rinse composition, such as 100 ppm to 2,000 ppm.

Plating Solution

According to the present invention, the treatment system may optionally comprise a plating solution for treating the substrate prior to treating the substrate with the Group IVB metal pretreatment composition. According to the present invention, the plating solution may deposit an electropositive metal onto the substrate surface by contacting the substrate with a plating solution of a soluble metal salt, such as a soluble copper salt, wherein the metal of the substrate dissolves while the metal in the solution, such as copper, is plated out onto the substrate surface.

The plating solution referenced above may be an aqueous solution of a water soluble metal salt. According to the present invention, the water soluble metal salt may be a water soluble copper compound. Specific examples of water soluble copper compounds, which are suitable for use in the present invention include, but are not limited to, copper cyanide, copper potassium cyanide, copper sulfate, copper nitrate, copper pyrophosphate, copper thiocyanate, disodium copper ethylenediaminetetraacetate tetrahydrate, copper bromide, copper oxide, copper hydroxide, copper chloride, copper fluoride, copper gluconate, copper citrate, copper lauroyl sarcosinate, copper formate, copper acetate, copper propionate, copper butyrate, copper lactate, copper oxalate, copper phytate, copper tartarate, copper malate, copper succinate, copper malonate, copper maleate, copper benzoate, copper salicylate, copper aspartate, copper glutamate, copper fumarate, copper glycerophosphate, sodium copper chlorophyllin, copper fluorosilicate, copper fluoroborate and copper iodate, as well as copper salts of carboxylic acids in the homologous series formic acid to decanoic acid, copper salts of polybasic acids in the series oxalic acid to suberic acid, and copper salts of hydroxycarboxylic acids, including glycolic, lactic, tartaric, malic and citric acids.

When copper ions supplied from such a water-soluble copper compound are precipitated as an impurity in the form of copper sulfate, copper oxide, etc., it may be preferable to add a complexing agent that suppresses the precipitation of copper ions, thus stabilizing them as a copper complex in the solution.

According to the present invention, the copper compound may be added as a copper complex salt such as $K_3Cu(CN)_4$ or Cu-EDTA, which can be present stably in the plating solution on its own, but it is also possible to form a copper complex that can be present stably in the plating solution by combining a complexing agent with a compound that is difficultly soluble on its own. Examples thereof include a copper cyanide complex formed by a combination of CuCN and KCN or a combination of CuSCN and KSCN or KCN, and a Cu-EDTA complex formed by a combination of $CuSO_4$ and EDTA-$Na_2$.

With regard to the complexing agent, a compound that can form a complex with copper ions can be used; examples thereof include inorganic compounds, such as cyanide compounds and thiocyanate compounds, and polycarboxylic acids, and specific examples thereof include ethylenediaminetetraacetic acid, salts of ethylenediaminetetraacetic acid, such as dihydrogen disodium ethylenediaminetetraacetate dihydrate, aminocarboxylic acids, such as nitrilotriacetic acid and iminodiacetic acid, oxycarboxylic acids, such as citric acid and tartaric acid, succinic acid, oxalic acid, ethylenediaminetetramethylenephosphonic acid, and glycine.

According to the present invention, the electropositive metal, such as copper, is included in the plating solution in an amount of at least 1 ppm, such as at least 50 ppm, or, in some cases, at least 100 ppm of total metal (measured as elemental metal), and may be included in the plating solution in an amount of no more than 5,000 ppm, such as no more than 1,000 ppm, or, in some cases, no more than 500 ppm of total metal (measured as elemental metal). The amount of electropositive metal in the plating solution may be 1 ppm to 5,000 ppm, such as 50 ppm to 1,000 ppm, such as 100 ppm, to 500 ppm.

In addition to the water soluble metal salt and optional complexing agent, the plating solution may also include other additives. For example, a stabilizer, such as 2-mercaptobenzothiazole, may be used. Other optional materials include surfactants that function as defoamers or substrate wetting agents. Anionic, cationic, amphoteric, or nonionic surfactants may be used. Compatible mixtures of such materials are also suitable. Defoaming surfactants are often present at levels up to 1 percent, such as up to 0.1 percent by volume, and wetting agents are often present at levels up to 2 percent, such as up to 0.5 percent by volume, based on the total volume of the solution.

According to the present invention, the aqueous plating solution may have a pH at application of less than 7, and, in some cases, the pH may be 1 to 4, such as 1.5 to 3.5. According to the present invention, the pH of the solution is maintained through the inclusion of an acid. The pH of the solution may be adjusted using mineral acids, such as hydrofluoric acid, fluoroboric acid and phosphoric acid, including mixtures thereof; organic acids, such as lactic acid, acetic acid, citric acid, sulfamic acid, or mixtures thereof; and water soluble or water dispersible bases, such as sodium hydroxide, ammonium hydroxide, ammonia, or amines such as triethylamine, methylethyl amine, or mixtures thereof.

According to the present invention, the plating solution may be brought into contact with the substrate by any of a variety of techniques, including, for example, dipping or immersion, spraying, intermittent spraying, dipping followed by spraying, spraying followed by dipping, brushing, or roll-coating. According to the present invention, a dipping or immersion technique may be used and the solution, when applied to the metal substrate, is at a temperature of 60 to 185° F. (15 to 85° C.). The contact time is may be from 10 seconds to five minutes, such as 30 seconds to 2 minutes. After removal of the substrate from the plating solution, the substrate may, if desired, be rinsed with water and dried.

According to the present invention, the residue of the plating solution, i.e., the electropositive metal, may be present on the substrate in an amount ranging from 1 to 1,000 milligrams per square meter ($mg/m^2$), such as 10 to 400 $mg/m^2$. The thickness of the residue of the plating solution can vary, but it is generally very thin, often having a thickness of less than 1 micrometer, such as 1 to 500 nanometers, such as 10 to 300 nanometers.

Post-Rinse Composition

According to the present invention, the treatment system may optionally include a post-rinse composition for treating at least a portion of the substrate after the substrate has been treated with the pretreatment composition. The post-rinse composition may comprise an organic or inorganic post-rinse or sealer, such as a chromate or non-chromate sealer, or an epoxy resin rinse, as is generally known in the art. Exemplary post-rinse compositions include Chemseal 19, Chemseal 59 and Chemseal 100, commercially available from PPG. Alternatively, the post-rinse composition may comprise a zirconium-based post-rinse composition, such as a composition comprising zirconium, zirconium and triethanolamine, or zirconium and a resin.

Optionally, the treatment system may be substantially free, essentially free, or completely free of phosphate. The term "substantially free" with respect to the treatment system means that each component of the treatment system, such as the aqueous alkaline composition and the Group IVB metal pretreatment composition, as described above, contains less than 25 ppm of phosphate, based on total weight of each component of the treatment system, respectively, if any at all. The term "essentially free" with respect to the treatment system means that each component of the treatment system contains less than 10 ppm of phosphate, respectively, if any at all. The term "completely free" with respect to the treatment system means that each component of the treatment system contains less than 1 ppb of phosphate, respectively, if any at all.

Electrodepositable Coating Composition

According to the present invention, the treatment system may optionally comprise an electrodepositable coating composition for coating the treated substrate.

Electrodeposition baths are typically supplied as two components: (i) a resin blend and (ii) a paste. According to the present invention, the resin blend may comprise (a) a main film-forming polymer (e.g., an active hydrogen-containing cationic salt group-containing resin) having reactive functional groups, (b) a curing agent that is reactive with functional groups on the film-forming polymer, and (c) any additional water-dispersible non-pigmented components.

Wide varieties of main film-forming polymers are known and can be used in the electrodeposition baths of the invention so long as the polymers are "water dispersible." As used herein, "water dispersible" will mean that a material is adapted to be solubilized, dispersed, and/or emulsified in water. The main film-forming polymers used in the invention are cationic in nature. In other words, the main film-forming polymer comprises cationic salt groups, generally prepared by neutralizing a functional group on the film-forming polymer with an acid, which enables the main film-forming polymer to be electrodeposited onto a cathode.

Examples of main film-forming polymers suitable for use in cationic electrocoating coating compositions include, without limitation, cationic polymers derived from a polyepoxide, an acrylic, a polyurethane, and/or polyester, hydroxyl group-containing polymers, amine salt group-containing polymers, or combinations thereof. According to the present invention, the main film-forming polymer may be a copolymer of the polymers listed in the preceding sentence.

According to the present invention, the main film-forming polymer may be a cationic polymer (cationic resin) that is derived from a polyepoxide. For example, the main film-forming polymer can be prepared by reacting together a polyepoxide and a polyhydroxyl group-containing material selected from alcoholic hydroxyl group-containing materials and phenolic hydroxyl group-containing materials to chain extend or build the molecular weight of the polyepoxide. As will be discussed in greater detail below, the reaction product can then be reacted with a cationic salt group former to produce the cationic polymer.

According to the present invention, a chain extended polyepoxide typically is prepared as follows: the polyepoxide and polyhydroxyl group-containing material are reacted together "neat" or in the presence of an inert organic solvent such as a ketone, including methyl isobutyl ketone and methyl amyl ketone, aromatics such as toluene and xylene, and glycol ethers such as the dimethyl ether of diethylene glycol. The reaction typically is conducted at a temperature of 80° C. to 160° C. for 30 to 180 minutes until an epoxy group-containing resinous reaction product is obtained.

According to the present invention, the equivalent ratio of reactants (i.e., epoxy:polyhydroxyl group-containing material) ranges from 1.00:0.50 to 1.00:2.00.

According to the present invention, the polyepoxide typically has at least two 1,2-epoxy groups. The epoxy compounds may be saturated or unsaturated, cyclic or acyclic, aliphatic, alicyclic, aromatic or heterocyclic. Moreover, the epoxy compounds may contain substituents such as halogen, hydroxyl, and ether groups.

Examples of polyepoxides are those having a 1,2-epoxy equivalency greater than one and/or two; that is, polyepoxides which have on average two epoxide groups per molecule. Suitable polyepoxides include polyglycidyl ethers of polyhydric alcohols such as cyclic polyols and polyglycidyl ethers of polyhydric phenols such as Bisphenol A. These polyepoxides can be produced by etherification of polyhydric phenols with an epihalohydrin or dihalohydrin such as epichlorohydrin or dichlorohydrin in the presence of alkali. Besides polyhydric phenols, other cyclic polyols can be used in preparing the polyglycidyl ethers of cyclic polyols. Examples of other cyclic polyols include alicyclic polyols, particularly cycloaliphatic polyols such as hydrogenated bisphenol A, 1,2-cyclohexane diol and 1,2-bis(hydroxymethyl)cyclohexane.

According to the present invention, the polyepoxides have epoxide equivalent weights ≥180. According to the present invention, the polyepoxides may have epoxide equivalent weights ≤2000. According to the present invention, the polyepoxides may have epoxide equivalent weights that range between any combination of values, which were recited in the preceding sentences, inclusive of the recited values. For example, the polyepoxides may have epoxide equivalent weights ranges from 186 to 1200.

Epoxy group-containing acrylic polymers may also be used in the present invention. According to the present invention, epoxy group-containing acrylic polymers have an epoxy equivalent weight ≥750, such as an epoxy equivalent weight of ≤2000. According to the present invention, the epoxy group-containing acrylic polymer has an epoxy equivalent weight that ranges between any combination of values, which were recited in the preceding sentences, inclusive of the recited values.

Examples of polyhydroxyl group-containing materials used to chain extend or increase the molecular weight of the polyepoxide (i.e., through hydroxyl-epoxy reaction) include alcoholic hydroxyl group-containing materials and phenolic hydroxyl group-containing materials. Examples of alcoholic hydroxyl group-containing materials are simple polyols such as neopentyl glycol; polyester polyols such as those described in U.S. Pat. No. 4,148,772; polyether polyols such as those described in U.S. Pat. No. 4,468,307; and urethane diols such as those described in U.S. Pat. No. 4,931,157. Examples of phenolic hydroxyl group-containing materials are polyhydric phenols such as Bisphenol A, phloroglucinol, catechol, and resorcinol. Mixtures of alcoholic hydroxyl group-containing materials and phenolic hydroxyl group-containing materials may also be used.

The main film-forming polymer can contain cationic salt groups, which can be incorporated into the resin molecule as follows: The resinous reaction product prepared as described above is further reacted with a cationic salt group former. By "cationic salt group former" is meant a material which is reactive with epoxy groups and which can be acidified before, during, or after reaction with the epoxy groups to form cationic salt groups. Examples of suitable materials include amines such as primary or secondary amines which can be acidified after reaction with the epoxy groups to form amine salt groups, or tertiary amines which can be acidified prior to reaction with the epoxy groups and which after reaction with the epoxy groups form quaternary ammonium salt groups. Examples of other cationic salt group formers are sulfides which can be mixed with acid prior to reaction with the epoxy groups and form ternary sulfonium salt groups upon subsequent reaction with the epoxy groups.

When amines are used as the cationic salt formers, monoamines, hydroxyl-containing amines, polyamines, or combinations thereof may be used.

Tertiary and secondary amines are used more often than primary amines because primary amines are polyfunctional with respect to epoxy groups and have a greater tendency to gel the reaction mixture. If polyamines or primary amines are used, they can be used in a substantial stoichiometric excess to the epoxy functionality in the polyepoxide so as to prevent gelation and the excess amine can be removed from the reaction mixture by vacuum stripping or other technique at the end of the reaction. The epoxy may be added to the amine to ensure excess amine.

Examples of hydroxyl-containing amines include, but are not limited to, alkanolamines, dialkanolamines, alkyl alkanolamines, and aralkyl alkanolamines containing from 1 to 18 carbon atoms, such as 1 to 6 carbon atoms, in each of the alkanol, alkyl and aryl groups. Specific examples include ethanolamine, N-methylethanolamine, diethanolamine, N-phenylethanolamine, N,N-dimethylethanolamine, N-methyldiethanolamine, 3-aminopropyldiethanolamine, and N-(2-hydroxyethyl)-piperazine.

Amines such as mono, di, and trialkylamines and mixed aryl-alkyl amines which do not contain hydroxyl groups or amines substituted with groups other than hydroxyl which do not negatively affect the reaction between the amine and the epoxy may also be used. Specific examples include ethylamine, methylethylamine, triethylamine, N-benzyldimethylamine, dicocoamine, 3-dimethylaminopropylamine, and N,N-dimethylcyclohexylamine.

Mixtures of the above mentioned amines may also be used in the present invention.

The reaction of a primary and/or secondary amine with the polyepoxide takes place upon mixing of the amine and polyepoxide. The amine may be added to the polyepoxide or vice versa. The reaction can be conducted neat or in the presence of a suitable solvent such as methyl isobutyl ketone, xylene, or 1-methoxy-2-propanol. The reaction is generally exothermic and cooling may be desired. However, heating to a moderate temperature ranging from 50° C. to 150° C. may be done to hasten the reaction.

The reaction product of the primary and/or secondary amine and the polyepoxide is made cationic and water dispersible by at least partial neutralization with an acid. Suitable acids include organic and inorganic acids. Non-limiting examples of suitable organic acids include formic acid, acetic acid, methanesulfonic acid, and lactic acid. Non-limiting examples of suitable inorganic acids include phosphoric acid and sulfamic acid. By "sulfamic acid" is meant sulfamic acid itself or derivatives thereof such as those having the formula:

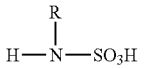

wherein R is hydrogen or an alkyl group having 1 to 4 carbon atoms.

It is noted that mixtures of the above mentioned acids may also be used may be used in the present invention.

The extent of neutralization of the cationic electrodepositable coating composition varies with the particular reaction product involved. However, sufficient acid should be used to disperse the electrodepositable coating composition in water. Typically, the amount of acid used provides at least 20 percent of all of the total neutralization. Excess acid may also be used beyond the amount required for 100 percent total neutralization. For example, the amount of acid used to neutralize the electrodepositable coating composition may be ≥1% based on the total amines in the electrodepositable coating composition, and the amount of acid used to neutralize the electrodepositable coating composition may be ≤100% based on the total amines in the electrodepositable coating composition. According to the present invention, the total amount of acid used to neutralize the electrodepositable coating composition ranges between any combination of values, which were recited in the preceding sentences, inclusive of the recited values. For example, the total amount of acid used to neutralize the electrodepositable coating composition can be 20%, 35%, 50%, 60%, or 80% based on the total amines in the electrodepositable coating composition.

In the reaction of a tertiary amine with a polyepoxide, the tertiary amine can be pre-reacted with the neutralizing acid to form the amine salt and then the amine salt reacted with the polyepoxide to form a quaternary salt group-containing resin. The reaction is conducted by mixing the amine salt with the polyepoxide in water. Typically, the water is present in an amount ranging from 1.75% to 20% by weight based on total reaction mixture solids.

In forming the quaternary ammonium salt group-containing resin, the reaction temperature can be varied from the lowest temperature at which the reaction will proceed, generally room temperature or slightly thereabove, to a maximum temperature of 100° C. (at atmospheric pressure). At higher pressures, higher reaction temperatures may be used. The reaction temperature may range from 60° C. to 100° C. Solvents such as a sterically hindered ester, ether, or sterically hindered ketone may be used, but their use is not necessary.

In addition to the primary, secondary, and tertiary amines disclosed above, a portion of the amine that is reacted with the polyepoxide can be a ketimine of a polyamine, such as is described in U.S. Pat. No. 4,104,147, column 6, line 23 to column 7, line 23. The ketimine groups decompose upon dispersing the amine-epoxy resin reaction product in water. n, at least a portion of the active hydrogens present in the resin (a) comprise primary amine groups derived from the reaction of a ketimine-containing compound and an epoxy group-containing material such as those described above.

In addition to resins containing amine salts and quaternary ammonium salt groups, cationic polymers containing ternary sulfonium groups may be used in the composition of the present invention. Examples of these resins and their method of preparation are described in U.S. Pat. Nos. 3,793,278 and 3,959,106.

Suitable active hydrogen-containing, cationic salt group-containing resins can include copolymers of one or more alkyl esters of acrylic acid or (meth)acrylic acid optionally together with one or more other polymerizable ethylenically unsaturated monomers. Suitable alkyl esters of acrylic acid or (meth)acrylic acid include methyl (meth)acrylate, ethyl (meth)acrylate, butyl (meth)acrylate, ethyl acrylate, butyl acrylate, and 2-ethyl hexyl acrylate. Suitable other copolymerizable ethylenically unsaturated monomers include nitriles such acrylonitrile and (meth)acrylonitrile, vinyl and vinylidene halides such as vinyl chloride and vinylidene fluoride and vinyl esters such as vinyl acetate. Acid and anhydride functional ethylenically unsaturated monomers such as acrylic acid, (meth)acrylic acid or anhydride, itaconic acid, maleic acid or anhydride, or fumaric acid may be used. Amide functional monomers including acrylamide, (meth)acrylamide, and N-alkyl substituted (meth)acrylamides are also suitable. Vinyl aromatic compounds such as styrene and vinyl toluene can be used so long as a high level of photodegradation resistance of the polymer is not required.

Functional groups such as hydroxyl and amino groups can be incorporated into the acrylic polymer by using functional monomers such as hydroxyalkyl acrylates and methacrylates or aminoalkyl acrylates and methacrylates. Epoxide functional groups (for conversion to cationic salt groups) may be incorporated into the acrylic polymer by using functional monomers such as glycidyl acrylate and methacrylate, 3,4-epoxycyclohexylmethyl(meth)acrylate, 2-(3,4-epoxycyclohexyl)ethyl(meth)acrylate, or allyl glycidyl ether. Alternatively, epoxide functional groups may be incorporated into the acrylic polymer by reacting carboxyl groups on the acrylic polymer with an epihalohydrin or dihalohydrin such as epichlorohydrin or dichlorohydrin.

The acrylic polymer can be prepared by traditional free radical initiated polymerization techniques, such as solution or emulsion polymerization, as known in the art, using suitable catalysts which include organic peroxides and azo type compounds and optionally chain transfer agents such as alpha-methyl styrene dimer and tertiary dodecyl mercaptan. Additional acrylic polymers which are suitable for forming the active hydrogen-containing, cationic polymer and which can be used in the electrodepositable coating compositions of the present invention include those resins described in U.S. Pat. Nos. 3,455,806 and 3,928,157.

As stated above, the main film-forming polymer can also be derived form a polyurethane. Among the polyurethanes which can be used are polymeric polyols which are prepared by reacting polyester polyols or acrylic polyols such as those mentioned above with a polyisocyanate such that the OH/NCO equivalent ratio is greater than 1:1 so that free hydroxyl groups are present in the product. Smaller polyhydric alcohols such as those disclosed above for use in the preparation of the polyester may also be used in place of or in combination with the polymeric polyols.

Additional examples of polyurethane polymers suitable for forming the active hydrogen-containing, cationic polymer include the polyurethane, polyurea, and poly(urethane-urea) polymers prepared by reacting polyether polyols and/or polyether polyamines with polyisocyanates. Such polyurethane polymers are described in U.S. Pat. No. 6,248,225.

Epoxide functional groups may be incorporated into the polyurethane by methods well known in the art. For example, epoxide groups can be incorporated by reacting glycidol with free isocyanate groups.

Sulfonium group-containing polyurethanes can also be made by at least partial reaction of hydroxy-functional sulfide compounds, such as thiodiglycol and thiodipropanol, which results in incorporation of sulfur into the backbone of the polymer. The sulfur-containing polymer is then reacted with a monofunctional epoxy compound in the presence of acid to form the sulfonium group. Appropriate monofunctional epoxy compounds include ethylene oxide, propylene oxide, glycidol, phenylglycidyl ether, and CARDURA E, available from Resolution Performance Products.

In addition to being derived from a polyepoxide or a polyurethane, the main film-forming polymer can also be derived from a polyester. Such polyesters can be prepared in a known manner by condensation of polyhydric alcohols and polycarboxylic acids. Suitable polyhydric alcohols include, for example, ethylene glycol, propylene glycol, butylene glycol, 1,6-hexylene glycol, neopentyl glycol, diethylene glycol, glycerol, trimethylol propane, and pentaerythritol. Examples of suitable polycarboxylic acids used to prepare the polyester include succinic acid, adipic acid, azelaic acid, sebacic acid, maleic acid, fumaric acid, phthalic acid, tetrahydrophthalic acid, hexahydrophthalic acid, and trimellitic acid. Besides the polycarboxylic acids mentioned above, functional equivalents of the acids such as anhydrides where they exist or lower alkyl esters of the acids such as the methyl esters may be used. Moreover, hydroxy acids and/or lactones, such as caprolactone and/or 12-hydroxystearic acid, may also be used as components of the polyester.

The polyesters contain a portion of free hydroxyl groups (resulting from the use of excess polyhydric alcohol and/or higher polyols during preparation of the polyester) which are available for cure reactions.

Epoxide functional groups may be incorporated into the polyester by reacting carboxyl groups on the polyester with an epihalohydrin or dihalohydrin such as epichlorohydrin or dichlorohydrin. Alternatively, an acid functional polyester may be incorporated into an epoxy polymer by reaction of carboxyl groups with an excess of polyepoxide.

Sulfonium salt groups can be introduced by the reaction of an epoxy group-containing polymer of the types described above with a sulfide in the presence of an acid, as described in U.S. Pat. Nos. 3,959,106 and 4,715,898. Sulfonium groups can be introduced onto the polyester backbones described using similar reaction conditions.

According to the present invention, the main film-forming polymer may be present in the electrodepositable coating composition in an amount of ≥40% by weight based on the weight of total resin blend solids present in the electrodepositable coating composition. According to the present invention, the main film-forming polymer may be present in the electrodepositable coating composition in an amount of ≤95% by weight based on the weight of total resin blend solids present in the electrodepositable coating composition. According to the present invention, the weight percent of the main film-forming polymer in the electrodepositable coating composition may range between any combination of values that were recited in the preceding sentences, inclusive of the recited values. For example, the main film-forming polymer may be present in the electrodepositable coating composition in an amount ranging from 50% to 75% by weight based on the weight of total resin blend solids present in the electrodepositable coating composition.

As stated above, in addition to the (a) main film-forming polymer, the resin blend further comprises (b) a curing agent (crosslinker) that is reactive with reactive functional groups, such as active hydrogen groups, on the main film-forming polymer. It is understood that one skilled in the art can determine an appropriate curing agent for a particular main film-forming polymer based on the functionality of the main film-forming polymer. For example, the curing agents that may be used with the present invention include, but are not limited to, urethane, isocyanate, ester, or combinations thereof.

It will be understood that non-limiting examples of urethane curing agents include the products of (i) an amine-carbonate reaction and/or (ii) an isocyanate-alcohol reaction.

Non-limiting examples of suitable cyclic carbonates that may be utilized to form the urethane curing agent include, without limitation, propylene carbonate, ethylene carbonate, butylene carbonate, or combinations thereof. Non-limiting examples of suitable acyclic carbonates that may be utilized to form the urethane, include, without limitation, dimethyl carbonate, diethyl carbonate, methylethyl carbonate, dipropyl carbonate, methylpropyl carbonate, dibutyl carbonate, or combinations thereof. According to the present invention, the acyclic carbonate may comprise dimethyl carbonate. Non-limiting examples of suitable amines that may be utilized to form the urethane, include, without limitation, diethylene triamine, dipropylene triamine, bis-hexamethylene triamine, isophorone diamine, 4'-bis-aminocyclohexylamine, xylylene diamine, N-hydroxyethyl ethylene diamine, hexamethylene triamine, trisaminoethylamine, or combinations thereof. According to the present invention, the curing agent may be a reaction product of a polyamine and a cyclic carbonate, and the primary amines of the polyamine may be reacted with the cyclic carbonate. According to the present invention, the reaction product of the polyamine and the cyclic carbonate may then be reacted with an epoxy functional polymer such as those used to prepare the main vehicle and/or grind vehicle. Specifically, the secondary amine of the reaction product may be reacted with the epoxy functional group of the epoxy functional polymer.

Non-limiting examples of suitable isocyanates that can be utilized to form the urethane curing agent include, without limitation, toluene diisocyanate, methylene diphenyl 4,4'-diisocyanate, isophorone diisocyanate, hexamethylene diisocyanate, xylyleuediisocyanate, tetramethylxylylene diisocyanate, straight chain aliphatic diisocyanates such as 1,4-tetramethylene diisocyanate, norbornane diisocyanate, and 1,6-hexamethylene diisocyanate, isophorone diisocyanate and 4,4'-methylene-bis-(cyclohexyl isocyanate), aromatic diisocyanates such as p-phenylene diisocyanate, diphenylmethane-4,4'-diisocyanate and 2,4- or 2,6-toluene diisocyanate, higher polyisocyanates such as triphenylmethane-4,4',4"-triisocyanate, 1,2,4-benzene triisocyanate and polymethylene polyphenyl isocyanate, and trimers of 1,6-hexamethylene diisocyanate, or combinations thereof. It should be noted that the dimers, trimers and higher functional materials of these isocyanates may also be utilized in the present invention. Non-limiting examples of suitable alcohols that can be utilized to form the urethane include, without limitation, methanol, ethanol, propanol, isopropanol, butanol, glycol ethers, and other alcohols.

As stated above, suitable curing agents for amine salt group-containing polymers, cationic acrylic polymers, and/or hydroxyl group-containing polymers include isocyanates as well as blocked isocyanates. It should be noted that as used herein, "isocyanates" also includes polyisocyanates and vice versa. The polyisocyanate curing agent may be a fully blocked polyisocyanate with substantially no free isocyanate groups, or it may be partially blocked and reacted with the resin backbone as described in U.S. Pat. No. 3,984,299. The polyisocyanate can be an aliphatic, an aromatic polyisocyanate, or combinations thereof. According to the present invention, diisocyanates may be utilized, although in other higher polyisocyanates may be used in place of or in combination with diisocyanates.

Isocyanate prepolymers, for example, reaction products of polyisocyanates with polyols such as neopentyl glycol and trimethylol propane or with polymeric polyols such as polycaprolactone diols and triols (NCO/OH equivalent ratio greater than one) may also be used. A mixture of diphenylmethane-4,4'-diisocyanate and polymethylene polyphenyl isocyanate may be used.

Any suitable alcohol or polyol can be used as a blocking agent for the polyisocyanate in the electrodepositable coating composition of the present invention provided that the agent will deblock at the curing temperature and provided a gelled product is not formed.

For example, suitable alcohols include, without limitation, methanol, ethanol, propanol, isopropyl alcohol, butanol, 2-ethylhexanol, butoxyethanol, hexyloxyethanol, 2-ethylhexyloxyethanol, n-butanol, cyclohexanol phenyl carbinol, methylphenyl carbinol, ethylene glycol monobutyl ether, diethylene glycol monobutylether, ethylene glycol monomethylether, propylene glycol monomethylether, or combinations thereof.

According to the present invention, the blocking agent comprises one or more 1,3-glycols and/or 1,2-glycols. According to the present invention, the blocking agent may comprise one or more 1,2-glycols, typically one or more $C_3$ to $C_6$ 1,2-glycols. For example, the blocking agent may be selected from at least one of 1,2-propanediol, 1,3-butanediol, 1,2-butanediol, 1,2-pentanediol, trimethylpentane diol, and/or 1,2-hexanediol.

According to the present invention, the polyisocyanate curing agents may be utilized in conjunction with the cationic main film-forming polymers in amounts of ≥5% by weight based on the total weight of the resin blend solids of the electrodeposition bath. According to the present invention, the polyisocyanate curing agents may be utilized in conjunction with the cationic main film-forming polymers in amounts of ≤60% by weight based on the total weight of the resin blend solids of the electrodeposition bath. According to the present invention, the amount of main film-forming polymer can range between any combination of values, which were recited in the preceding sentences, inclusive of the recited values. For example, the polyisocyanate curing agents may be utilized in conjunction with the cationic main film-forming polymers in an amount ranting from 20% to 50% by weight based on the total weight of the resin blend solids of the electrodeposition bath.

Other suitable blocking agents include oximes such as methyl ethyl ketoxime, acetone oxime and cyclohexanone oxime and lactams such as epsilon-caprolactam.

As stated above, the curing agent that is used in the present invention may be an ester curing agent. It should be noted that as used herein, "ester" also includes polyesters. Accordingly, the ester curing agent may be a polyester curing agent. Suitable polyester curing agents include materials having greater than one ester group per molecule. The ester groups are present in an amount sufficient to effect cross-linking, for example, at temperatures up to 250° C., and curing times of up to 90 minutes. It should be understood that acceptable cure temperatures and cure times will be dependent upon the substrates to be coated and their end uses.

Compounds generally suitable as the polyester curing agent may be polyesters of polycarboxylic acids. Non-limiting examples include bis(2-hydroxyalkyl)esters of dicarboxylic acids, such as bis(2-hydroxybutyl) azelate and bis(2-hydroxyethyl)terephthalate; tri(2-ethylhexanoyl)trimellitate; and poly(2-hydroxyalkyl)esters of acidic half-esters prepared from a dicarboxylic acid anhydride and an alcohol, including polyhydric alcohols. The latter type is suitable to provide a polyester with a final functionality of more than 2. One suitable example includes a polyester prepared by first reacting equivalent amounts of the dicarboxylic acid anhydride (e.g., succinic anhydride or phthalic anhydride) with a trihydric or tetrahydric alcohol, such as glycerol, trimethylolpropane or pentaerythritol, at temperatures below 150° C., and then reacting the acidic polyester with at least an equivalent amount of an epoxy alkane, such as 1,2-epoxy butane, ethylene oxide, or propylene oxide. The polyester curing agent (ii) may comprise an anhydride. Another suitable polyester comprises a lower 2-hydroxy-akylterminated poly-alkyleneglycol terephthalate.

According to the present invention, the polyester curing agent may comprise at least one ester group per molecule in which the carbon atom adjacent to the esterified hydroxyl has a free hydroxyl group.

Also suitable is the tetrafunctional polyester prepared from the half-ester intermediate prepared by reacting trimellitic anhydride and propylene glycol (molar ratio 2:1), then reacting the intermediate with 1,2-epoxy butane and the glycidyl ester of branched monocarboxylic acids.

According to the present invention, where the active hydrogen-containing resin comprises cationic salt groups, the polyester curing agent may be substantially free of acid. For purposes of the present invention, "substantially free of acid" means having less than 0.2 meq/g acid. For aqueous systems, for example for cathodic electrocoating, coating compositions, suitable polyester curing agents may include non-acidic polyesters prepared from a polycarboxylic acid anhydride, one or more glycols, alcohols, glycol monoethers, polyols, and/or monoepoxides.

Suitable polycarboxylic anhydrides may include dicarboxylic acid anhydrides, such as succinic anhydride, phthalic anhydride, tetrahydrophthalic anhydride, trimellitic anhydride, hexahydrophthalic anhydride, methylhexahydrophthalic anhydride, 3,3',4,4'-benzophenonetetracarboxylic dianhydride, and pyromellitic dianhydride. Mixtures of anhydrides may be used.

Suitable alcohols may include linear, cyclic or branched alcohols. The alcohols may be aliphatic, aromatic or araliphatic in nature. As used herein, the terms glycols and mono-epoxides are intended to include compounds containing not more than two alcohol groups per molecule which can be reacted with carboxylic acid or anhydride functions below the temperature of 150° C.

Suitable mono-epoxides may include glycidyl esters of branched monocarboxylic acids. Further, alkylene oxides, such as ethylene oxide or propylene oxide may be used. Suitable glycols can include, for example ethylene glycol and polyethylene glycols, propylene glycol and polypropylene glycols, and 1,6-hexanediol. Mixtures of glycols may be used.

Non-acidic polyesters may be prepared, for example, by reacting, in one or more steps, trimellitic anhydride (TMA) with glycidyl esters of branched monocarboxylic acids in a molar ratio of 1:1.5 to 1:3, if desired with the aid of an esterification catalyst such as stannous octoate or benzyl dimethyl amine, at temperatures of 50-150° C. Additionally, trimellitic anhydride may be reacted with 3 molar equivalents of a monoalcohol such as 2-ethylhexanol.

Alternatively, trimellitic anhydride (1 mol) may be reacted first with a glycol or a glycol monoalkyl ether, such as ethylene glycol monobutyl ether in a molar ratio of 1:0.5 to 1:1, after which the product is allowed to react with 2 moles of glycidyl esters of branched monocarboxylic acids. Furthermore, the polycarboxylic acid anhydride i.e., those containing two or three carboxyl functions per molecule) or a mixture of polycarboxylic acid anhydrides may be reacted simultaneously with a glycol, such as 1,6-hexane diol and/or glycol mono-ether and monoepoxide, after which the product can be reacted with mono-epoxides, if desired. For aqueous compositions these non-acid polyesters may also be modified with polyamines such as diethylene triamine to form amide polyesters. Such "amine-modified" polyesters may be incorporated in the linear or branched amine adducts described above to form self-curing amine adduct esters.

The non-acidic polyesters of the types described above typically are soluble in organic solvents, and typically may be mixed readily with the main film forming resin described above.

Polyesters suitable for use in an aqueous system or mixtures of such materials disperse in water typically in the presence of resins comprising cationic salt groups.

According to the present invention, the curing agent used in the electrocoating composition may be a carbamate-functional curing agent, such as described in U.S. Pat. No. 5,902,473, which is incorporated herein by reference.

According to the present invention, at least a portion of the curing agent may be chemically bound to the main film-forming polymer. According to the present invention, the curing agent may not be chemically bound to the main film-forming polymer and is added as an additive to the electrodepositable coating composition.

The pigment paste may have one or more pigments, a water dispersible polymer, and, optionally, additives such as surfactants, wetting agents, catalysts, dispersing aids, or combinations thereof. It should be noted that the water dispersible polymer of the pigment paste can either be the same or different from the main film-forming polymer in the resin blend. The pigment composition used in the pigment paste may be of the conventional type comprising pigments of, for example, iron oxides, strontium chromate, carbon black, coal dust, titanium dioxide, talc, barium sulfate, as well as color pigments such as cadmium yellow, cadmium red, chromium yellow and the like. According to the present invention, the pigment composition may comprise effect pigments such as, but not limited to, electroconductive and/or photo chromic pigments. The pigment content of the dispersion is usually expressed as a pigment-to-resin ratio. In the practice of the invention, when pigment is employed, the pigment-to-resin ratio is usually within the range of about 0.02:1 to 1:1. The other additives mentioned above are usually in the dispersion in amounts of about 0.01% to 3% by weight based on the total weight of the resin blend solids.

The first and second components of the electrodeposition bath are dispersed together in an aqueous medium which comprises water and, usually, coalescing solvents to form the electrodeposition bath. Useful coalescing solvents that can be used in the electrodeposition bath include, but are not limited to, hydrocarbons, alcohols, esters, ethers and/or ketones. According to the present invention, the coalescing solvents include alcohols, polyols and ketones. Specific coalescing solvents include isopropanol, butanol, 2-ethylhexanol, isophorone, 2-methoxypentanone, ethylene and propylene glycol and the monoethyl, monobutyl and mono-hexyl ethers of ethylene glycol. According to the present invention, the amount of coalescing solvent used in the electrodeposition bath may be ≥0.01% by weight based on the total weight of the aqueous medium used to make the electrodeposition bath. According to the present invention, the amount of coalescing solvent used in the electrodeposition bath may be ≤25% by weight based on the total weight of the aqueous medium used to make the electrodeposition bath. According to the present invention, the amount of coalescing solvent used in the electrodeposition bath may range between any combination of values, which were recited in the preceding sentences, inclusive of the recited values. For example, the amount of coalescing solvent used in the electrodeposition bath may range from 0.05% to 5% by weight based on the total weight of the aqueous medium used to make the electrodeposition bath.

As previously mentioned, the present disclosure also is directed to systems and methods for treating a variety of substrates. Suitable substrates that may be used in the treatment systems and methods of the present invention include metal substrates, metal alloy substrates, and/or substrates that have been metallized, such as nickel plated plastic. According to the present invention, the metal or metal alloy can comprise or be cold rolled steel, hot rolled steel, steel coated with zinc metal, zinc compounds, or zinc alloys, such as electrogalvanized steel, hot-dipped galvanized steel, galvanealed steel, and steel plated with zinc alloy. Aluminum alloys of the 2XXX, 5XXX, 6XXX, or 7XXX series as well as clad aluminum alloys and cast aluminum alloys of the A356 series also may be used as the substrate. Magnesium alloys of the AZ31B, AZ91C, AM60B, or EV31A series also may be used as the substrate. The substrate used in the present invention may also comprise titanium and/or titanium alloys. Other suitable non-ferrous metals include copper and magnesium, as well as alloys of these materials. Suitable metal substrates for use in the present invention include those that are often used in the assembly of vehicular bodies (e.g., without limitation, door, body panel, trunk deck lid, roof panel, hood, roof and/or stringers, rivets, landing gear components, and/or skins used on an aircraft), a vehicular frame, vehicular parts, motorcycles, wheels, small metal parts, including fasteners, i.e., nuts, bolts, screws, pins, nails, clips, buttons, and the like, industrial structures and components such as appliances, including washers, dryers, refrigerators, stoves, dishwashers, and the like, agricultural equipment, lawn and garden equipment, air conditioning units, heat pump units, lawn furniture, and other articles. As used herein, "vehicle" or variations thereof includes, but is not limited to, civilian, commercial and military aircraft, and/or land vehicles such as cars, motorcycles, and/or trucks. Moreover, the metal substrate being treated by the methods of the present invention may be a cut edge of a substrate that is otherwise treated and/or coated over the rest of its surface. The metal substrate treated in accordance with the methods of the present invention may be in the form of, for example, a sheet of metal or a fabricated part.

The electrodepositable coating composition of the present invention may be applied onto a number of substrates, such as those described above. Accordingly, the present invention is further directed to a substrate that is coated, at least in part, with the electrodepositable coating composition described herein. It will be understood that the electrocoating coating composition can be applied onto a substrate as a monocoat or as a coating layer in a multi-layer coating composite. According to the present invention, at least a portion of the surface of the metallic surface onto which the coating is applied may be pretreated with phosphate pretreatment composition, such as zinc phosphate pretreatment composition, or a Group IVB metal pretreatment composition.

Moreover, the electrodepositable coating composition of the present invention may be applied onto the substrate to impart a wide variety of properties such as, but not limited to, corrosion resistance, chip resistance, filling (i.e., ability to hide underlying substrate roughness), abrasion resistance, impact damage, flame and/or heat resistance, chemical resistance, UV light resistance, and/or structural integrity.

The electrodepositable coating composition may be applied by immersing the substrate into an electrodeposition bath with the substrate serving as an electrode in electrical communication with a counter-electrode, and applying an electrical potential to the system to deposit the electrodepositable coating composition onto the substrate surface. Depending on the substrate, the electrodepositable coating composition may be applied (i.e., electrodeposited) onto a substrate using a voltage that can range from 1 volt to several thousand volts. According to the present invention, the voltage that is used ranges from 50 volts to 500 volts. Moreover, the current density may be between 0.5 ampere and 5 amperes per square foot. It will be understood, however, that the current density tends to decrease during electrodeposition which is an indication of the formation of an insulating film.

After the coating has been applied onto the substrate via electrodeposition, the coating may be cured by baking the substrate at an elevated temperature ranging from 90° C. to 260° C. for a time period ranging from 1 minute to 40 minutes.

The electrodepositable coating composition of the present invention may be utilized in an electrocoating layer that is part of a multi-layer coating composite comprising a substrate with various coating layers. The coating layers could include a pretreatment layer, such as a phosphate layer (e.g., zinc phosphate layer) or a Group IVB metal pretreatment layer, as described above, an electrocoating layer which results from the electrodepositable coating composition of the present invention, and suitable top coat layers (e.g., base coat, clear coat layer, pigmented monocoat, and color-plus-clear composite compositions). It is understood that suitable topcoat layers include any of those known in the art, and each independently may be waterborne, solventborne, in solid particulate form (i.e., a powder coating composition), or in the form of a powder slurry. The top coat typically includes a film-forming polymer, crosslinking material and, if a colored base coat or monocoat, one or more pigments. According to the present invention, the primer layer is disposed between the electrocoating layer and the base coat layer. According to the present invention, one or more of the topcoat layers are applied onto a substantially uncured underlying layer. For example, a clear coat layer may be applied onto at least a portion of a substantially uncured basecoat layer (wet-on-wet), and both layers may be simultaneously cured in a downstream process.

Moreover, the top coat layers may be applied directly onto the electrodepositable coating layer. In other words, the substrate lacks a primer layer. For example, a basecoat layer may be applied directly onto at least a portion of the electrodepositable coating layer.

It will also be understood that the top coat layers may be applied onto an underlying layer despite the fact that the underlying layer has not been fully cured. For example, a clearcoat layer may be applied onto a basecoat layer even though the basecoat layer has not been subjected to a curing step. Both layers may then be cured during a subsequent curing step thereby eliminating the need to cure the basecoat layer and the clearcoat layer separately.

According to the present invention, additional ingredients such as colorants and fillers can be present in the various coating compositions from which the top coat layers result. Any suitable colorants and fillers may be used. For example, the colorant may be added to the coating in any suitable form, such as discrete particles, dispersions, solutions and/or flakes. A single colorant or a mixture of two or more colorants can be used in the coatings of the present invention. It should be noted that, in general, the colorant can be present in a layer of the multi-layer composite in any amount sufficient to impart the desired property, visual and/or color effect.

Example colorants include pigments, dyes and tints, such as those used in the paint industry and/or listed in the Dry Color Manufacturers Association (DCMA), as well as special effect compositions. A colorant may include, for example, a finely divided solid powder that is insoluble but wettable under the conditions of use. A colorant may be organic or inorganic and may be agglomerated or non-agglomerated. Colorants may be incorporated into the coatings by grinding or simple mixing. Colorants may be incorporated by grinding into the coating by use of a grind vehicle, such as an acrylic grind vehicle, the use of which will be familiar to one skilled in the art.

Example pigments and/or pigment compositions include, but are not limited to, carbazole dioxazine crude pigment, azo, monoazo, disazo, naphthol AS, salt type (lakes), benzimidazolone, condensation, metal complex, isoindolinone, isoindoline and polycyclic phthalocyanine, quinacridone, perylene, perinone, diketopyrrolo pyrrole, thioindigo, anthraquinone, indanthrone, anthrapyrimidine, flavanthrone, pyranthrone, anthanthrone, dioxazine, triarylcarbonium, quinophthalone pigments, diketo pyrrolo pyrrole red ("DPP red BO"), titanium dioxide, carbon black, zinc oxide, antimony oxide, etc. and organic or inorganic UV opacifying pigments such as iron oxide, transparent red or yellow iron oxide, phthalocyanine blue and mixtures thereof. The terms "pigment" and "colored filler" can be used interchangeably.

Example dyes include, but are not limited to, those that are solvent and/or aqueous based such as acid dyes, azoic dyes, basic dyes, direct dyes, disperse dyes, reactive dyes, solvent dyes, sulfur dyes, mordant dyes, for example, bismuth vanadate, anthraquinone, perylene, aluminum, quinacridone, thiazole, thiazine, azo, indigoid, nitro, nitroso, oxazine, phthalocyanine, quinoline, stilbene, and triphenyl methane.

Example tints include, but are not limited to, pigments dispersed in water-based or water miscible carriers such as AQUA-CHEM 896 commercially available from Degussa, Inc., CHARISMA COLORANTS and MAXITONER INDUSTRIAL COLORANTS commercially available from Accurate Dispersions division of Eastman Chemical, Inc.

As noted above, the colorant may be in the form of a dispersion including, but not limited to, a nanoparticle dispersion. Nanoparticle dispersions can include one or more highly dispersed nanoparticle colorants and/or colorant particles that produce a desired visible color and/or opacity and/or visual effect. Nanoparticle dispersions may include colorants such as pigments or dyes having a particle size of less than 150 nm, such as less than 70 nm, or less than 30 nm. Nanoparticles may be produced by milling stock organic or inorganic pigments with grinding media having a particle size of less than 0.5 mm. Example nanoparticle dispersions and methods for making them are identified in U.S. Pat. No. 6,875,800 B2, which is incorporated herein by reference. Nanoparticle dispersions may also be produced by crystallization, precipitation, gas phase condensation, and chemical attrition (i.e., partial dissolution). In order to minimize re-agglomeration of nanoparticles within the coating, a dispersion of resin-coated nanoparticles may be used. As used herein, a "dispersion of resin-coated nanoparticles" refers to a continuous phase in which is dispersed discreet "composite microparticles" that comprise a nanoparticle and a resin coating on the nanoparticle. Example dispersions of resin-coated nanoparticles and methods for making them are identified in U.S. application Ser. No. 10/876,031 filed Jun. 24, 2004, which is incorporated herein by reference, and U.S. Provisional Application No. 60/482,167 filed Jun. 24, 2003, which is also incorporated herein by reference.

According to the present invention, special effect compositions that may be used in one or more layers of the multi-layer coating composite include pigments and/or compositions that produce one or more appearance effects such as reflectance, pearlescence, metallic sheen, phosphorescence, fluorescence, photochromism, photosensitivity, thermochromism, goniochromism and/or color-change. Additional special effect compositions may provide other perceptible properties, such as reflectivity, opacity or texture. For example, special effect compositions may produce a color shift, such that the color of the coating changes when the coating is viewed at different angles. Example color effect compositions are identified in U.S. Pat. No. 6,894,086, incorporated herein by reference. Additional color effect compositions may include transparent coated mica and/or synthetic mica, coated silica, coated alumina, a transparent liquid crystal pigment, a liquid crystal coating, and/or any composition wherein interference results from a refractive index differential within the material and not because of the refractive index differential between the surface of the material and the air.

According to the present invention, a photosensitive composition and/or photochromic composition, which reversibly alters its color when exposed to one or more light sources, can be used in a number of layers in the multi-layer composite. Photochromic and/or photosensitive compositions can be activated by exposure to radiation of a specified wavelength. When the composition becomes excited, the molecular structure is changed and the altered structure exhibits a new color that is different from the original color of the composition. When the exposure to radiation is removed, the photochromic and/or photosensitive composition can return to a state of rest, in which the original color of the composition returns. For example, the photochromic and/or photosensitive composition may be colorless in a non-excited state and exhibit a color in an excited state. Full color-change may appear within milliseconds to several minutes, such as from 20 seconds to 60 seconds. Example photochromic and/or photosensitive compositions include photochromic dyes.

According to the present invention, the photosensitive composition and/or photochromic composition may be associated with and/or at least partially bound to, such as by covalent bonding, a polymer and/or polymeric materials of a polymerizable component. In contrast to some coatings in which the photosensitive composition may migrate out of the coating and crystallize into the substrate, the photosensitive composition and/or photochromic composition associated with and/or at least partially bound to a polymer and/or polymerizable component in accordance with the present invention, have minimal migration out of the coating. Example photosensitive compositions and/or photochromic compositions and methods for making them are identified in U.S. application Ser. No. 10/892,919 filed Jul. 16, 2004 and incorporated herein by reference.

According to the present invention, it has been surprisingly discovered that treatment of a substrate with an aqueous alkaline composition comprising an iron salt and an alkaline component results in significantly improved adhesion of a subsequently applied coating, as tested according to the protocol set forth in the examples. This result was not expected.

For purposes of the detailed description, it is to be understood that the invention may assume various alternative variations and step sequences, except where expressly specified to the contrary. Moreover, other than in any operating examples, or where otherwise indicated, all numbers such as those expressing values, amounts, percentages, ranges, subranges and fractions may be read as if prefaced by the word "about," even if the term does not expressly appear. Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques. Where a closed or open-ended numerical range is described herein, all numbers, values, amounts, percentages, subranges and fractions within or encompassed by the numerical range are to be considered as being specifically included in and belonging to the original disclosure of this application as if these numbers, values, amounts, percentages, subranges and fractions had been explicitly written out in their entirety.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

As used herein, the "resin blend solids" include a curing agent, a resin used in preparation of the main film-forming polymer and/or pigment paste, and any additional water-dispersible non-pigmented component(s).

As used herein, unless indicated otherwise, a plural term can encompass its singular counterpart and vice versa, unless indicated otherwise. For example, although reference is made herein to "an" iron salt, "an" alkaline component, "a" cobalt salt, "a" pretreatment composition, a combination (i.e., a plurality) of these components can be used. In addition, in this application, the use of "or" means "and/or" unless specifically stated otherwise, even though "and/or" may be explicitly used in certain instances.

As used herein, "including," "containing" and like terms are understood in the context of this application to be synonymous with "comprising" and are therefore open-ended and do not exclude the presence of additional undescribed or unrecited elements, materials, ingredients or method steps. As used herein, "consisting of" is understood in the context of this application to exclude the presence of any unspecified element, ingredient or method step. As used herein, "consisting essentially of" is understood in the context of this application to include the specified elements, materials, ingredients or method steps "and those that do not materially affect the basic and novel characteristic(s)" of what is being described.

As used herein, the terms "on," "onto," "applied on," "applied onto," "formed on," "deposited on," "deposited onto," mean formed, overlaid, deposited, or provided on but not necessarily in contact with the surface. For example, an electrodepositable coating composition "deposited onto" a substrate does not preclude the presence of one or more other intervening coating layers of the same or different composition located between the electrodepositable coating composition and the substrate.

Unless otherwise disclosed herein, the term "substantially free," when used with respect to the absence of a particular material, means that such material, if present at all in a composition, a bath containing the composition, and/or layers formed from and comprising the composition, only is present in a trace amount of 5 ppm or less based on a total weight of the composition, bath and/or layer(s), as the case may be. Unless otherwise disclosed herein, the term "essentially free," when used with respect to the absence of a particular material, means that such material, if present at all in a composition, a bath containing the composition, and/or layers formed from and comprising the composition, only is present in a trace amount of 1 ppm or less based on a total weight of the composition, bath and/or layer(s), as the case may be. Unless otherwise disclosed herein, the term "completely free," when used with respect to the absence of a particular material, means that such material, if present at all in a composition, a bath containing the composition, and/or layers formed from and comprising the composition, is absent from the composition, the bath containing the composition, and/or layers formed from and comprising same (i.e., the composition, bath containing the composition, and/or layers formed from and comprising the composition contain 0 ppm of such material). When a composition, bath containing a composition, and/or a layer(s) formed from and comprising the same is substantially free, essentially free, or completely free of a particular material, this means that such material is excluded therefrom, except that the material may be present as a result of, for example, carry-over from prior treatment baths in the processing line, municipal water sources, substrate(s), and/or dissolution of equipment.

As used herein, the term "Group IVB metal" refers to an element that is in group IVB of the CAS version of the Periodic Table of the Elements as is shown, for example, in the Handbook of Chemistry and Physics, 63$^{rd}$ edition (1983), corresponding to Group 4 in the actual IUPAC numbering.

As used herein, the term "Group IVB metal compound" refers to compounds that include at least one element that is in Group IVB of the CAS version of the Periodic Table of the Elements.

As used herein, a "salt" refers to an ionic compound made up of metal cations and non-metallic anions and having an overall electrical charge of zero. Salts may be hydrated or anhydrous.

As used herein, "aqueous composition" refers to a solution or dispersion in a medium that comprises predominantly water. For example, the aqueous medium may comprise water in an amount of more than 50 wt. %, or more than 70 wt. % or more than 80 wt. % or more than 90 wt. % or more than 95 wt. %, based on the total weight of the medium. The aqueous medium may for example consist substantially of water.

Whereas specific aspects of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof. In view of the foregoing description the present invention thus relates in particular, without being limited thereto, to the following Aspects 1-26.

ASPECTS

1. An aqueous alkaline cleaner composition comprising:
   an iron cation, a molybdenum cation, a cobalt cation, or combinations thereof; and
   an alkaline component;
   wherein the pH of the aqueous alkaline composition is at least 10, and the aqueous alkaline composition includes no more than 50 ppm of phosphate based on a total weight of the composition.

2. The cleaner composition of Aspect 1, wherein the iron cation is present in an amount of 50 ppm to 500 ppm based on the total weight of the composition.

3. The cleaner composition of Aspect 1 or Aspect 2, wherein the molybdenum cation is present in an amount of 10 ppm to 400 ppm based on the total weight of the composition.

4. The cleaner composition of any of the preceding Aspects, wherein the cobalt cation is present in an amount of 50 ppm to 5800 ppm based on the total weight of the composition.

5. The cleaner composition of any of the preceding Aspects, further comprising a chelator, an oxidizer, a surfactant, a depositable species or combinations thereof.

6. The cleaner composition of Aspect 5, wherein the surfactant is anionic, non-ionic, cationic, or amphoteric.

7. The cleaner composition of any of the preceding Aspects, further comprising a phosphonate.

8. The cleaner composition of any of the preceding Aspects, wherein the phosphonate has a P-C ratio of at least 0.10.

9. The cleaner composition of Aspect 7 or Aspect 8, wherein the phosphonate comprises a polydentate phosphonate.

10. The cleaner composition of any of the preceding Aspects, wherein the composition is substantially free, essentially free, or completely free of phosphate.

11. A treatment system for treating metal substrates, comprising:
   a) the aqueous alkaline cleaner composition of any of the preceding Aspects; and:
   b) a pretreatment composition for treating at least a portion of the substrate, comprising a Group IVB metal cation.

12. The system of Aspect 11, wherein the pretreatment composition further comprises an electropositive metal, a lithium cation, a molybdenum cation, or combinations thereof.

13. The system of Aspect 11 or Aspect 12, wherein the system is substantially free, essentially free, or completely free of phosphate.

14. The system of any of Aspects 11 to 13, further comprising at least one of a prerinse composition, a postrinse composition, a plating solution, an electrodepositable coating composition, a powder coat composition, and a liquid composition.

15. A method of treating a metal substrate comprising contacting at least a portion of a substrate with the cleaner composition according to any of Aspects 1 to 10.

16. The method of Aspect 15, wherein the contacting is for 60 seconds to 120 seconds.

17. A substrate obtainable by the system of any of Aspects 10 to 14.

18. A substrate obtainable by the method of Aspect 15 or 16.

19. A treatment system for treating metal substrates, comprising:
   a) the cleaner composition of any of Aspects 1 to 10;
   b) optionally, an activating rinse for treating at least a portion of a substrate; and
   c) a pretreatment composition for treating at least a portion of the substrate, comprising a metal phosphate.

20. The system of Aspect 19, wherein the activating rinse comprises a dispersion of metal phosphate particles having a $D_{90}$ particle size of no greater than 10 μm, wherein the metal phosphate comprises divalent or trivalent metals or combinations thereof.

21. The system of Aspect 19, wherein the activating rinse comprises a dispersion of metal phosphate particles have a $D_{90}$ particle size of no more than 1 μm, wherein the metal phosphate comprises divalent or trivalent metals or combinations thereof.

22. The system of Aspect 19, wherein the activating rinse comprises colloidal titanium-phosphate particles.

23. The system of any of Aspects 19 to 22, wherein the activating rinse further comprises a metal sulfate salt, wherein the metal of the metal sulfate salt comprises nickel, copper, zinc, iron, magnesium, cobalt, aluminum or combinations thereof.

24. The system of any of Aspects 19 to 23, wherein the pretreatment composition is substantially free of nickel.

25. The system of any of Aspects 19 to 24, further comprising at least one of:
   a second pretreatment composition for treating at least a portion of the substrate, comprising a Group IIIB and/or Group IVB metal compound;
   a post-rinse composition; and
   an electrodepositable coating composition for coating at least a portion of the substrate.

26. A substrate treated with the treatment system of any of Aspects 19 to 25.

EXAMPLES

Example 1: Zinc Phosphate Pretreatment

Alkaline Cleaner Baths

Phosphate-free alkaline cleaner baths were prepared as follows:

A standard alkaline cleaner bath was prepared at 1.25% v/v concentration of Chemkleen 2010LP (a phosphate-free alkaline cleaner available from PPG) and 0.125% of Chemkleen 181 ALP (a phosphate-free blended surfactant additive, available from PPG). For spray cleaning, a 10 gallon bath was prepared. For immersion cleaning, a five-gallon bath was prepared. The baths were prepared in deionized water. The pH of each bath was 12.

Modified cleaner #1: To five gallons of the above standard alkaline cleaner bath were added 28.5 g D-gluconic acid sodium salt (available from Sigma Aldrich Corporation), 17.7 g cobalt nitrate hexahydrate (available from Fisher Scientific, Inc.) and 23.5 g ferric nitrate (available from Sigma Aldrich Corporation). The calculated cobalt and iron concentrations of this bath were 190 ppm and 172 ppm, respectively. The pH of the resulting bath was 11.8.

Modified cleaner #2: To five gallons of the above standard alkaline cleaner bath were added 28.5 g D-gluconic acid sodium salt (available from Sigma Aldrich Corporation) and 47.0 g ferric nitrate (available from Sigma Aldrich Corporation). The calculated iron concentration of this bath was 344 ppm. The pH of the resulting bath was 11.8.

Activator Preparation

A zinc phosphate-based activating rinse was prepared as follows: 4717.6 grams of zinc phosphate pigment was sifted into a pre-blended mixture of 1700.18 grams deionized water, 1735.92 grams of dispersant (Disperbyk-190, commercially available from BYK-Chemie GmbH), and 56.36 grams of defoamer (BYK-011, commercially available from BYK-Chemie GmbH) and mixed for 30 minutes using a Fawcett Air Mixer, model LS-103A with a type 1 angled tooth/Cowles style blade. An additional 680.47 grams of deionized water, as well as 2590.25 grams Disperbyk-190 and 55.5 grams of BYK-011, were added and mixed for an additional 20 minutes. This mixture was then milled in recirculation mode through an HM 1.5 L horizontal mill (manufactured by Premier Mill Corp.) containing 0.5 mm zirconium oxide media for 60 minutes of residence time. An additional 1180 grams of deionized water were added throughout the milling process. Several interim process samples were taken throughout the milling, such that a final yield of 10,455.62 grams was obtained. This material had a concentration of 36.78% by weight of zinc phosphate. The final product had a volume-weighted $D_{90}$ particle size of 0.26 μm (sonicated). As used herein, the term "$D_{90}$" particle size refers to a volume-weighted particle distribution in which 90% of the particles in the particle distribution have a diameter smaller than the "$D_{90}$" value. According to the present invention, particle size was measured using a Mastersizer 2000, available from Malvern Instruments, Ltd., of Malvern, Worcestershire, UK. The Mastersizer 2000 directs a laser beam (0.633 mm diameter, 633 nm wavelength) through a dispersion of particles (in distilled, deionized or filtered water to 2-3% obscuration), and measures the light scattering of the dispersion (measurement parameters 25° C., 2200 RPM, 30 sec premeasurement delay, 10 sec background measurement, 10 sec sample measurement). The amount of light scattered by the dispersion is inversely proportional to the particle size. A series of detectors measure the scattered light and the data are then analyzed by computer software (Malvern Mastersizer 2000 software, version 5.60) to generate a particle size distribution, from which particle size can be routinely determined.

The activating rinse bath was prepared by adding 1.36 grams of the above dispersion of zinc phosphate per liter of deionized water, to give an activator bath with a zinc phosphate concentration of 0.5 grams per liter.

Chemfos 700LT Zinc Phosphate Bath Preparation

A five gallon vessel was filled approximately three-fourths full with deionized water. To this was added 760 ml of Chemfos 700A, 1.5 ml Chemfos FE, and 42 ml Chemfos AFL (all available from PPG). To this was added 29.5 g zinc nitrate (available from Fischer Scientific), 9.5 ml Chemfos F (available from PPG), 136.8 ml Zetaphos N (available from PPG), and 130 ml NaOH solution (5% w/v NaOH, available from Fisher Scientific, dissolved in deionized water). The free acid of the bath was operated at 0.7-0.8 points of free acid, 15.8-16.0 points of total acid, and 2.6-2.7 gas points of nitrite. The amount of nitrite in solution was measured using a fermentation tube using the protocol described in the technical data sheet for Chemfos Liquid Additive (PPG Industries, Inc., Cleveland, Ohio). A fermentation tube was filled with a 70 mL sample of the pretreatment bath to just below the mouth of the tube. Approximately 2.0 g of sulfamic acid was added to the tube, and the tube was inverted to mix the sulfamic acid and pretreatment solution. Gas evolution occurred, which displaced the liquid in the top of the fermentation tube, and the level was read and recorded. The level corresponded to the gas points measured in the solution in milliliters.

Test Panel Preparation

For each run, two hot dipped galvanized steel panels (4"×6" from ACT Test Panels, LLC) were first cleaned as follows: the control panels were spray cleaned in a stainless steel spray cabinet using V-jet nozzles and 10 to 15 psi, using the standard alkaline cleaner bath detailed above for two minutes at 49° C., followed by immersion rinse in DI water for 15 seconds and spray rinse with DI water for 15 seconds. Test panel sets #1 and #2 were spray cleaned using the standard alkaline cleaner bath detailed above for 30 seconds at 49° C., then immediately immersed in modified cleaner #1 or #2, respectively, at 49° C. for two minutes, followed by immersion rinse in DI water for 15 seconds and spray rinse with DI water for 15 seconds. The panels were then immersed in the above-described activating bath (20° C.-25° C.) for one minute. The panels were then immersed into the Chemfos 700 LT bath at 30° C. or 35° C. for two minutes, with agitation. All panels then were spray rinsed with DI water for 20-30 seconds. Panels were warm air dried using a Hi-Velocity handheld blow-dryer made by Oster® (model number 078302-300-000) on high-setting at a temperature of about 50-55° C. until the panel was dry (about 1-5 minutes).

After drying, the panels were electrocoated with EPIC 200 cathodic electrocoat, available from PPG. The electrocoat was applied to target a 0.69 mil thickness. The rectifier (Xantrex Model XFR600-2) was set to the "Coulomb Controlled" setting. The conditions were set with 27 coulombs, no amp limit, voltage set point of 220 V, and a ramp time of 30 s. The electrocoat bath was maintained at 90° F., with a stir speed of 340 rpms. After the electrocoat was applied, the panels were baked in an oven (Despatch Model LFD-1-42) at 177° C. for 25 minutes. The coating thickness was measured using a film thickness gauge (Fischer Technology Inc. Model FMP40C).

Panel Testing

Panels were tested for adhesion using the T-peel test method, to measure fracture energy required to pull the coating from the substrate.

The coatings on the panels were first stressed by subjecting them to a 24 hour soak in DI water at 60° C. After the panels were removed from the water bath, they were allowed to recover at ambient temperature for two to three hours. The electrocoated panels were then cut lengthwise into four equal 1"×6" panel strips. The peel specimens were prepared by first bending one end of each strip panel at 90°; the test surfaces were cleaned with isopropyl alcohol and were plasma-treated (Diener Electronic model ATTO B with Duo 2.5 pump) for 5 minutes (after pumping down to 0.17 mbar pressure, using $N_2$ gas supply for 1 minute prior to the plasma). Then pairs of panels from each set were joined together using a quick-setting adhesive (3M Scotch-Weld DP 460), to make a T-shaped joint. The adhesive was allowed to cure under ambient conditions for 24 hours prior to testing. The test was conducted by pulling the joint apart at a nominal crosshead speed of 250 mm/min using an Instron 5567. The fracture energy $G_C$ was calculated by the formula:

$$G_C = \frac{1}{b}\left(\frac{dU_e}{da} - \frac{dU_s}{da} - \frac{dU_{dt}}{da} - \frac{dU_{db}}{da}\right)$$

where a is the crack length, b is the width, $dU_e$ is the potential energy of the external load, $dU_s$ is the strain energy stored in the substrate, $dU_{dt}$ is the energy dissipated in tensile deformation and $dU_{db}$, is the energy dissipated in plastic bending of the substrate. The results appear in Table 2, below.

TABLE 2

Fracture Energy (J/m$^2$)

| Cleaner | Zinc Phosphate Temperature | Fracture Energy (J/m$^2$) |
|---|---|---|
| Standard | 30° C. | 201 |
| Modified #1 (added Co/Fe) | 30° C. | 2244 |
| Modified #2 (added Fe) | 30° C. | 1092 |
| Standard | 35° C. | 285 |
| Modified #1 (added Co/Fe) | 35° C. | 1252 |
| Modified #2 (added Fe) | 35° C. | 1388 |

The panels treated with the iron-containing cleaners showed considerably higher fracture energy values, indicating significantly better adhesion.

Example 2: Zirconium Pretreatment

Alkaline Cleaner Baths

The alkaline cleaner baths were identical to those used in Example 1.

Zirconium Pretreatment (ZircoBond 1.5)

A five-gallon solution of ZircoBond 1.5 ((“ZB 1.5”) a zirconium-containing pretreatment composition commercially available from PPG Industries, Inc.) was prepared according to the manufacturer’s instructions. The solution had a pH of 4.72 and contained 175 ppm of zirconium, 30 ppm of copper, and 101 ppm of free fluoride.

Test Panel Preparation

For each run, two hot dipped galvanized steel panels (4"×6" from ACT Test Panels, LLC) were first cleaned as follows: Test panels for the standard alkaline cleaner as well as modified cleaners #1 and #2 were spray cleaned using the standard alkaline cleaner bath detailed above for 30 seconds at 49° C., then immediately immersed in the standard alkaline cleaner, modified cleaner #1, or modified cleaner #2, respectively, at 49° C. for two minutes, followed by immersion rinse in DI water for 15 seconds and spray rinse with DI water for 15 seconds. The panels were then immersed into the zirconium pretreatment bath for two minutes, with agitation. All panels then were spray rinsed with DI water for 20-30 seconds. Panels were warm air dried using a Hi-Velocity handheld blow-dryer made by Oster® (model number 078302-300-000) on high-setting at a temperature of about 50-55° C. until the panel was dry (about 1-5 minutes).

After drying, the panels were electrocoated with EPIC 200 cathodic electrocoat. The electrocoat was applied to target a 0.66-0.72 mil thickness. The rectifier (Sorensen by Ametek, Model XG300-5.6) was set to the “Coulomb Controlled” setting. The conditions were set with 24 coulombs, no amp limit, voltage set point of 200 V, and a ramp time of 30 s. The electrocoat bath was maintained at 90° F., with a stir speed of 340 rpms. After the electrocoat was applied, the panels were baked in an oven (Despatch Model LFD-1-42) at 177° C. for 25 minutes. The coating thickness was measured using a film thickness gauge (Fischer Technology Inc. Model FMP40C).

Panel Testing

The coated panels were tested using the same procedure as described in Example 1. The results are shown in Table 3 below.

TABLE 3

Fracture Energy (J/m$^2$)

| Cleaner | Fracture Energy (J/m$^2$) |
|---|---|
| Standard | 1135 |
| Modified #1 (added Co/Fe) | 1863 |
| Modified #2 (added Fe) | 1995 |

Example 3: Zirconium Pretreatment (ZB 1.5) with Iron Modified Cleaners Improving Corrosion Performance Alkaline Cleaner Baths The alkaline cleaner baths were identical to those used in Example 1.

Control Zinc Phosphate Pretreatment

An activator was prepared by adding 1.1 g/L of Versabond RC (also known as RC30, commercially available from PPG Industries, Inc.) to a filled 5 gallon (18.79 liters) vessel of deionized water to be utilized immediately prior to the use of the zinc phosphate bath described below.

A 1,500 g solution of Chemfos 700A/AL/M zinc phosphate composition concentrate preparation was prepared by combining the ingredients listed in the table below.

TABLE 3

| Chemical | Quantity |
|---|---|
| Deionized Water | 439.5 g |
| Phosphoric Acid (85% Fisher Scientific) | 595.6 g |
| Nitric Acid (Reagent Fisher Scientific) | 28.7 g |
| Nickel Nitrate Solution (CF-N) (PPG Product) | 262.5 g |
| Acetaldehyde Oxime 50% in Water (Sigma-Aldrich) | 1.95 g |
| Ferrous Sulfate (Fisher Chemical) | 3.75 g |
| Zinc Oxide (Umicore Zinc Chemicals) | 62.25 g |
| Manganese (II) Oxide 76-78% (Alfa Aesar) | 32.7 g |
| Dowfax 2A1 Surfactant (Dow Chemical) | 1.05 g |
| Sodium Hydroxide 50% (Di Water and Fisher Chemical NaOH pellets) | 72 g |

A Chemfos 700A/AL/M Zinc Phosphate Pretreatment composition was prepared by filling a five gallon vessel approximately three-fourths full with deionized water. To this was added 756 g of CF700A/AL/M Control Concentrate from above, 56.7 g CF-F (PPG), 122.85 g CF-F/F (PPG) 15.4 g CF-AZN (PPG), 321.3 g Buffer M(PPG), and 8.5 g AAO (Sigma-Aldrich). The free acid and total acid were adjusted with Buffer M (commercially available from PPG Industries, Inc.) to achieve produce a free acid of 0.85 points and a total acid of 17.2 points. 35 ppm of hydrogen peroxide solution as added to be used as an accelerator (35% from Alfa Aesar).

Zirconium Pretreatment (ZircoBond 1.5)

A five-gallon solution of ZircoBond 1.5 ((“ZB 1.5”) a zirconium-containing pretreatment composition commercially available from PPG Industries, Inc.) was prepared according to the manufacturer’s instructions. The solution had a pH of 4.73 and contained 175 ppm of zirconium, 30 ppm of copper, and 107 ppm of free fluoride.

Test Panel Preparation for Zirconium Based Pretreatment

The test panels were prepared using the same method as described for the zirconium pretreated panels in Example 2.

Test Panel Preparation for Control Zinc Phosphate Pretreatment

For each run, two hot dipped galvanized steel panels (4"×6" from ACT Test Panels, LLC) were first cleaned as follows: Test panels entered the spray cleaning using the standard alkaline cleaner bath detailed above for 30 seconds at 49° C., then immediately immersed in the standard alkaline cleaner at 49° C. for two minutes, followed by immersion rinse in DI water for 15 seconds and spray rinse with DI water for 15 seconds. Panels then entered the Versabond RC (activator bath) for 1 minute at a bath temperature of 80° F. Next, the panels were then directly placed into the Zinc Phosphate bath solution detailed above for three minutes at 50° C. with agitation. Finally, panels then were spray rinsed with DI water for 20-30 seconds. Panels were warm air dried using a Hi-Velocity handheld blow-dryer made by Oster® (model number 078302-300-000) on high-setting at a temperature of about 50-55° C. until the panel was dry (about 1-5 minutes).

Electrocoat

After drying, all zirconium and zinc phosphate pretreated panels were electrocoated with EnviroPrime 2010 cathodic electrocoat. The electrocoat was applied to target of 0.71-0.86 mil thickness. After the electrocoat was applied, the panels were baked in an oven (Despatch Model LFD-1-42) at 177° C. for 25 minutes. The coating thickness was measured using a film thickness gauge (Fischer Technology Inc. Model FMP40C).

Panel Testing

Panels were tested for scribe creep blistering using the GMW 14872 Cyclic Corrosion testing. Scribe creep was measured from affected paint to affected paint to the left and right of the scribe. The scribe was placed into the panel prior to being placed into the cabinet for a length of 30 cycles. The scribe creep measurements for each test is shown in Table 4 below.

Measurement of Scribe Creep—Two testing panels were used to obtain the average. The length of Scribe was 4 Inches (10.16 cm). A reading of affected paint to affected paint was done at 8 points along the scribe. From this the average of the two panels led to average scribe creep noted below in Table 4. In addition, the Maximum Average Scribe creep was measured. This means that the maximum scribe creep distance along the entire length scribe was measured, one to the left and one to the right of the scribe. Max left and Max right were added to create Maximum Scribe Creep. The average of the two panels is denoted in the table below as Maximum Average Scribe Creep. The measurements were taken by the use of a Fowler Sylvac digital caliper Model S 235.

TABLE 4

Scribe Creep

| Pretreatment | Average Scribe Creep | Max Average Scribe Creep |
|---|---|---|
| Zinc Phosphate Control | 3.61 mm | 8.61 mm |
| Zirconium | 5.49 mm | 10.19 mm |
| Zirconium with Mod. Cleaner 1 (Fe/Co) | 3.24 mm | 5.62 mm |
| Zirconium with Mod. Cleaner 2 (Fe Only) | 4.21 mm | 9.05 mm |

Example 4: Zirconium Based Pretreatment

Alkaline Cleaner Baths

The alkaline cleaner baths were identical to those used in Example 1.

Control Zinc Phosphate Pretreatment

An activator was prepared by adding 1.1 g/L of Versabond RC (also known as RC30, commercially available from PPG Industries, Inc.) to a filled 5 gallon (18.79 liters) vessel of deionized water to be utilized immediately prior to the use of the zinc phosphate bath described below.

A Chemfos 700AL (CF 700AL) zinc phosphate pretreatment bath was produced according to manufacturer's instructions by filling a five-gallon vessel approximately three-fourths full with deionized water. To this was added 700 ml of Chemfos 700A, 1.5 ml Chemfos FE, 51 ml Chemfos AFL, and 350 ml of Chemfos 700B (all commercially available from PPG). To this was added 28.6 g zinc nitrate hexahydrate and 2.5 grams of Sodium Nitrite (both available from Fischer Scientific), and the free acid of the bath was operated at 0.7-0.8 points of free acid, 15-19 points of total acid, and 2.2-2.7 gas points of Sodium Nitrite. To adjust to obtain the correct amounts of free and total acid, Chemfos 700B was utilized to adjust according to product data sheet.

The temperature of the bath was 125° F. and panels were immersed in the bath for 2 minutes.

Zirconium Pretreatment (ZircoBond 2.0)

A five-gallon solution of ZircoBond 2.0 (a zirconium-containing pretreatment composition commercially available from PPG Industries, Inc.) was prepared according to the manufacturer's instructions. The bath had a pH of 4.6 and contained 175 ppm of zirconium, 30 ppm of copper, 5 ppm lithium, 85 ppm molybdenum, and 85 ppm of free fluoride.

Test Panel Preparation for Zirconium Pretreatment

For each run, two Hot Dipped Galvanized Exposed Panels from ACT Test Panels Code (HDG60G60E) were first cleaned as follows:

Panels entered the alkaline cleaning solutions described above for two minutes at a temperature of 120° F. for 2 Minutes. The panels were then rinsed with deionized water first using an immersion rinse for 10-15 seconds and then spray rinse for 15-30 seconds using deionized water.

After cleaning in the respective cleaning solutions, the panels entered into the Zirconium Baths for runs 1-3 for two minutes with low agitation. The temperature was maintained at 80° F. Once the panels were completed in the ZircoBond 2.0 bath, the panels were spray rinsed with DI water for 20-30 seconds. Panels were warm air dried using a Hi-Velocity handheld blow-dryer made by Oster® (model number 078302-300-000) on high-setting at a temperature of about 50-55° C. until the panel was dry (about 1-5 minutes). For run #4 the panels were cleaned and rinsed the same way prior to a pretreatment step. The panels were then placed into the Versabond Rinse Conditioner solution for 1 minute at ambient temperature. From this the panels were directly added into the CF700AL bath for 2 minutes at a temperature of 125° F. From this the panels were rinsed and dried as described above.

Test Panel Preparation for Control Zinc Phosphate Pretreatment

For each run, two hot dipped galvanized steel panels (4"×6" from ACT Test Panels, LLC) were first cleaned as follows: Test panels entered the spray cleaning using the standard alkaline cleaner bath detailed above for two minutes at 49° C., then immediately immersed in the standard alkaline cleaner at 49° C. for two minutes, followed by immersion rinse in DI water for 15 seconds and spray rinse with DI water for 15 seconds. Panels then entered the Versabond RC (activator bath) for 1 minute at a bath temperature of 80° F. Next, the panels were then directly placed into the Zinc Phosphate bath solution detailed above for three minutes at 50° C. with agitation. Finally, panels then were spray rinsed with DI water for 20-30 seconds. Panels were warm air dried using a Hi-Velocity handheld blow-dryer made by Oster® (model number 078302-300-000) on high-setting at a temperature of about 50-55° C. until the panel was dry (about 1-5 minutes).

Electrocoat

After drying, the panels were electrocoated with ED7200 electrocoat, available from PPG. The electrocoat was applied to target a 0.60 mil thickness. The rectifier (Xantrex Model XFR600-2) was set to the "Coulomb Controlled" setting. The conditions were set to 20 coulombs for, 0.5 amp limit, voltage set point of 220 V for Zinc Phosphate and 180V for Zirconium Based Pretreatments, and a ramp time of 30 s. The electrocoat was maintained at 90° F., with a stir speed of 360 rpms. After the electrocoat was applied, the panels were baked in an oven (Despatch Model LFD-1-42) at 177° C. for 25 minutes. The coating thickness was measured using a film thickness gauge (Fischer Technology Inc. Model FMP40C).

Panel Testing

Panels were tested for scribe creep blistering using Honda Salt Dip to measure scribe creep. Scribe creep was measured from affected paint to affected paint to the left and right of the scribe. An X-shaped scribe was placed into the panel prior to being placed into the immersion cabinet for a length of 15 days. The immersion solution was a 5% NaCl Salt Solution at a temperature of 55° C.

After testing the scribe was tape pulled after room temperature drying with Scotch Brand 898 Fiber Tape to pull corrosion products and any loose adhering paint along the scribe away to allow for measuring affected to affected paint to the left and right of the scribe.

Measurement of Scribe Creep—The length of scribe was 8 cm per leg of the X scribe. A reading of affected paint to affected paint was measured at each cm except centimeter mark of the point of intersection. This then creates a total of 14 points of measurement for both the right and left leg of the X scribe. From this the average of both legs of the X scribe, of the three panels led to average scribe creep noted below in Table 5. The measurements were taken by the use of a Fowler Sylvac digital caliper Model S 235.

TABLE 5

| Run | Cleaner | Pretreatment | Average Scribe Creep (mm) |
|---|---|---|---|
| 1 | Standard | ZicroBond 2.0 | 3.68 |
| 2 | Modified #1 (added Co/Fe) | ZicroBond 2.0 | 2.76 |
| 3 | Modified #2 (added Fe) | ZircoBond 2.0 | 7.73 |
| 4 | Standard | Versabond + Zinc Phosphate | 3.32 |

Example 5: Zinc Phosphate Pretreatment

Alkaline Cleaner Baths

The alkaline cleaner baths were identical to those used in Example 1.

Activator #1

Versabond Rinse Conditioner (PPG Commercial Product): The activating rinse bath was prepared by adding 1.1 grams of Versabond RC per liter of deionized water, to give an activator bath with a zinc phosphate concentration of 0.5 grams per liter.

Activator #2

A zinc phosphate-based activating rinse was prepared as follows: 4717.6 grams of zinc phosphate pigment was sifted into a pre-blended mixture of 1700.18 grams deionized water, 1735.92 grams of dispersant (Disperbyk-190, commercially available from BYK-Chemie GmbH), and 56.36 grams of defoamer (BYK-011, commercially available from BYK-Chemie GmbH) and mixed for 30 minutes using a Fawcett Air Mixer, model LS-103A with a type 1 angled tooth/Cowles style blade. An additional 680.47 grams of deionized water, as well as 2590.25 grams Disperbyk-190 and 55.5 grams of Byk-011, were added and mixed for an additional 20 minutes. This mixture was then milled in recirculation mode through an HM 1.5 L horizontal mill (manufactured by Premier Mill Corp.) containing 0.5 mm zirconium oxide media for 60 minutes of residence time. An additional 1180 grams of deionized water were added throughout the milling process. Several interim process samples were taken throughout the milling, such that a final yield of 10,455.62 grams was obtained. This material had a concentration of 36.78% by weight of zinc phosphate. The final product had a volume-weighted $D_{90}$ particle size of 0.26μ (sonicated).

The activating rinse bath was prepared by adding 1.36 grams of the above dispersion of zinc phosphate per liter of deionized water, to give an activator bath with a zinc phosphate concentration of 0.5 grams per liter.

Chemfos 700A/AL/M Zinc Phosphate Concentrate Preparation (Control)

A 1,500 gram concentrate solution was prepared by combining the following ingredients:

| Chemical | Quantity |
|---|---|
| Deionized Water | 439.5 g |
| Phosphoric Acid (85% Fisher Scientific) | 595.6 g |
| Nitric Acid (Reagent Fisher Scientific) | 28.7 g |
| Nickel Nitrate Solution (CF-N) (PPG Product) | 262.5 g |
| Acetaldehyde Oxime 50% in Water (Sigma-Aldrich) | 1.95 g |
| Ferrous Sulfate (Fisher Chemical) | 3.75 g |
| Zinc Oxide (Umicore Zinc Chemicals) | 62.25 g |
| Manganese (II) Oxide 76-78% (Alfa Aesar) | 32.7 g |
| Dowfax 2A1 Surfactant (Dow Chemical) | 1.05 g |
| Sodium Hydroxide 50% (Di Water and Fisher Chemical NaOH pellets) | 72 g |

Zinc Phosphate Bath #1: CF 700A/AL/M Zinc Phosphate Bath Preparation (Control)

CF 700A/AL/M Zinc Phosphate Bath was prepared as follows: A five-gallon vessel was filled approximately three-fourths full with deionized water. To this was added 756 g of CF700A/AL/M Control Concentrate from above, 56.7 g CF-F (PPG), 122.85 g CF-F/F (PPG) 15.4 g CF-AZN (PPG), 321.3 g Buffer M(PPG), and 8.5 g AAO (Sigma-Aldrich). The free acid and total acid were adjusted with Buffer M to achieve a free acid of 0.85 gas points and total acid of 17.2 gas points. 35 ppm of hydrogen peroxide was added to be used as an accelerator (35% solution from Alfa Aesar).

Chemfos 700A/AL/M Zinc Phosphate Concentrate Preparation (Nickel Free)

A nickel-free Chemfos 700A/AL/M Zinc Phosphate Concentrate was prepared by combining the same ingredients listed above, with the exception that the nickel nitrate solution was replaced with an equal amount of deionized water.

Zinc Phosphate Bath #2: CF 700A/AL/M Zinc Phosphate Bath Preparation (Nickel Free)

CF 700A/AL/M Zinc Phosphate Bath Preparation (Nickel Free) was prepared as follows: A five-gallon vessel was filled approximately three-fourths full with deionized water. To this was added 756 g of CF700A/AL/M Nickel Free Concentrate from above, 56.7 g CF-F (PPG), 122.85 g CF-F/F (PPG) 15.4 g CF-AZN (PPG), 321.3 g Buffer M(PPG), and 8.5 g AAO (Sigma-Aldrich). The free acid and total acid were adjusted with Buffer M to achieve a free acid of 0.75 gas points and total acid of 17.3 gas points. 35 ppm of hydrogen peroxide was added to be used as an accelerator (35% solution from Alfa Aesar).

Matrix of Testing

| Run | Cleaner | Activator | Zinc Phosphate |
|---|---|---|---|
| 1 (Control) | Standard CK2010LP/181ALP | Versabond (#1) | CF 700A/AL/M |
| 2 (Control) | Standard CK2010LP/181ALP | M3 (#2) | CF 700A/AL/M Nickel Free |
| 3 | Modified Cleaner #1 | M3 (#2) | CF 700A/AL/M Nickel Free |
| 4 | Modified Cleaner #2 | M3 (#2) | CF 700A/AL/M Nickel Free |

Test Panel Preparation

For each run, two Electrogalvanized MBZE 8 Steel panels (available from Chemetall) were first cleaned as follows: the control panels were spray cleaned in a stainless steel spray cabinet using V-jet nozzles and 10 to 15 psi, using the standard Chemkleen 2010LP bath detailed above for two minutes at 49° C., followed by immersion rinse in DI water for 15 seconds and spray rinse with DI water for 15 seconds. Test panel sets #3 and #4 were spray cleaned using the standard Chemkleen 2010LP bath detailed above for 30 seconds minutes at 49° C., then immediately immersed in modified cleaner #1 or #2, respectively, at 49° C. for two minutes, followed by immersion rinse in DI water for 15 seconds and spray rinse with DI water for 15 seconds. The panels were then immersed in activating bath #1 or #2, described above, (20° C.-25° C.) for one minute. The panels were then immersed into the control or nickel-free zinc phosphate bath at 50° C. for three minutes, with agitation. All panels then were spray rinsed with DI water for 20-30 seconds. Panels were warm air dried using a Hi-Velocity handheld blow-dryer made by Oster® (model number 078302-300-000) on high-setting at a temperature of about 50-55° C. until the panel was dry (about 1-5 minutes).

After drying, the panels were electrocoated with EnviroPrime 2010 cathodic electrocoat, available from PPG. The electrocoat was applied to target a 0.785 mil thickness. The rectifier (Xantrex Model XFR600-2) was set to the "Coulomb Controlled" setting. The conditions were set to the adjusted coulombs (25-35C) with a set 0.75 amp limit, voltage set point of 210 V, and a ramp time of 30 seconds. The electrocoat was maintained at 91° F., with a stir speed of 340 rpms. After the electrocoat was applied, the panels were baked in an oven (Despatch Model LFD-1-42) at 175° C. for 25 minutes. The coating thickness was measured using a film thickness gauge (Fischer Technology Inc. Model FMP40C).

After electrocoat a B1:B2 compact paint system and clear coat were applied via Spraymation. The product codes, dry film thickness ranges, and bake conditions are shown in the table below. Each of the paints are commercially available from PPG.

| Layer | Product Code | Dry Film Thickness Target (microns) | Bake (Temperature/Time) |
|---|---|---|---|
| B1 | BIP1U300P | 18 (1 coat) | 5-minute ambient flash |
| B2 | BIP2WA29 | 12 (2 coats with 60-minute ambient flash between coats) | 7 minutes at 70° C. |
| Clear coat | ApO | 48 (2 coats with 10 minutes ambient flash between coats) | 30 minutes at 141° C. |

Once panels were fully Top Coated and Clear Coated, panels were scribed on Corrocutter 639 (Supplier:Erichsen) Scribe Table with a Sikkens 1 mm scribe in two places along the face of the panel and placed into a VDA 233-102 cyclic testing cabinet for 12 weeks. The results are reported in Table 6 below. The results are reported as U/2 (average scribe creep)=(d−1)/2 where d=average of total delamination at scribe (after tape removal).

TABLE 6

| | | | | corrosion (mm) | | |
|---|---|---|---|---|---|---|
| Code | Cleaner | Rinse Conditioner | Zinc Phosphate | left scribe | right scribe | Average |
| 1 | Standard | Versabond RC (#1) | CF700A/AL/M | 1.5 | 1.8 | 1.7 |
| | | | Control | 1.5 | 1 | 1.3 |
| 2 | Standard | #2 | CF700A/AL/M | 3.7 | 3.5 | 3.6 |
| | | | NF | 3.8 | 3 | 3.4 |
| 3 | Modified #1 | #2 | CF700A/AL/M | 1.1 | 1.1 | 1.1 |
| | | | NF | 1.0 | 1.2 | 1.1 |
| 4 | Modified #2 | #2 | CF700A/AL/M | 1.3 | 1.2 | 1.3 |
| | | | NF | 1 | 1 | 1.0 |

Example 6: Addition of Mo to Alkaline Cleaner with Group IVB

Preparation of Alkaline Cleaner I:

A clean five gallon bucket was filled with 18.93 liters of deionized water. To this was added 250 mL of Chemkleen 2010LP (a phosphate-free alkaline cleaner available from PPG Industries, Inc.) and 25 mL of Chemkleen 181ALP (a phosphate-free blended surfactant additive available from PPG Industries, Inc.). A 10 mL sample of the alkaline cleaner was titrated with 0.100 N sulfuric acid to measure the free and total alkalinity. The free alkalinity was measured using a phenolphthalein end point (pink to colorless color change) and the total alkalinity was measured to a bromocresol green end point (blue to yellow color change). The measured pH of alkaline cleaner I was 12.0.

Preparation of Alkaline Cleaner II:

This cleaner was prepared in the same manner as alkaline cleaner I, except cobalt nitrate hexahydrate (17.70 g) purchased from Thermofisher Acros Organics (Gel, Belgium) and sodium D-gluconate (28.50 g) purchased from Thermofisher Acros Organics (Geel, Belgium) were added to the mixture of CK2010LP and CK181ALP. The pH of the solution was adjusted to 12.0 using sodium hydroxide. The concentration of Co was calculated to be 189 ppm based on the entire weight of the composition.

Preparation of Alkaline Cleaner III:

This cleaner was prepared from alkaline cleaner II by the addition of ferric nitrate nonahydrate (23.53 g) commercially available from Fisher Scientific (Hampton, N.H.). The pH of the solution was adjusted to 12.0 using sodium hydroxide. The concentration of Co was calculated to be 189 ppm and the concentration of iron was calculated to be 172 ppm based on the entire weight of the composition.

Preparation of Alkaline Cleaner IV:

This cleaner was prepared in the same manner as alkaline cleaner I except 9.50 g of sodium molybdate dihydrate available from Thermofisher Acros Organics (Geel, Belgium) and 28.50 g sodium D-gluconate were added to the mixture of CK2010LP and CK181ALP. The pH of the solution was adjusted to 12.0 using sodium hydroxide. The calculated concentration of Mo was 199 ppm based on the weight of the entire composition.

Preparation of Alkaline Cleaner V:

This cleaner was prepared from alkaline cleaner IV by the addition of ferric nitrate nonahydrate (23.53 g) commercially available from Fisher Scientific (Hampton, N.H.). The pH of the solution was adjusted to 12.0 using sodium hydroxide. The concentration of Mo was calculated to be 199 ppm and the concentration of iron was calculated to be 172 ppm based on the entire weight of the composition.

Preparation of Alkaline Cleaner VI:

This cleaner was prepared in the same manner as alkaline cleaner I except 3.50 g of sodium molybdate dihydrate available from Thermofisher Acros Organics (Geel, Belgium) and 28.50 g sodium D-gluconate were added to the mixture of CK2010LP and CK181ALP. The pH of the solution was adjusted to 12.0 using sodium hydroxide. The calculate concentration of Mo was 73 ppm based on the weight of the entire composition.

General Monitoring of the Pretreatment Baths:

After all of the ingredients were added to the pretreatment bath, the pH of the bath was measured using a pH meter (interface, DualStar pH/ISE Dual Channel Benchtop Meter, available from ThermoFisher Scientific, Waltham, Mass., USA; pH probe, Fisher Scientific Accumet pH probe (Ag/AgCl reference electrode) by immersing the pH probe in the pretreatment solution. Free fluoride was measured using a DualStar pH/ISE Dual Channel Benchtop Meter (ThermoFisher Scientific) equipped with a fluoride selective electrode (Orion ISE Fluoride Electrode, solid state, available from ThermoFisher Scientific) by immersing the ISE in the pretreatment solution and allowing the measurement to equilibrate. Then, the pH was adjusted as needed to the specified pH range with Chemfil buffer (an alkaline buffering solution, commercially available from PPG Industries, Inc. or hexaflurozirconic acid (45 wt. % in water, available from Honeywell International, Inc., Morristown, N.J.). The free fluoride was adjusted as needed to range of 25 to 150 ppm with Chemfos AFL (a partially neutralized aqueous ammonium bifluoride solution, commercially available from PPG Industries, Inc. and prepared according to supplier instructions). The amount of copper in each Bath was measured using a DR/890 Colorimeter (available from HACH, Loveland, Colo., USA) using an indicator (CuVerl Copper Reagent Powder Pillows, available from HACH).

Preparation of Bath A:

Bath A was prepared according to manufacturer's instructions for Zircobond 1.5. Zirconium was supplied to the pretreatment baths by adding hexafluorozirconic acid (45 wt. % in water) available from Honeywell International, Inc. (Morristown, N.J.) and copper was supplied by adding a 2 wt. % Cu solution, which was prepared by dilution of a copper nitrate solution (18 wt. % Cu in water) available from Shepherd Chemical Company (Cincinnati, Ohio). The pretreatment bath was prepared in a five gallon bucket (18.93 liter scale). The pH and free fluoride were adjusted with 39.0 g Chemfil buffer and 21.0 g Chemfos AFL, respectively. The final bath parameters were: pH 5.1, 34 ppm Cu, 200 ppm Zr, and 92 ppm free fluoride.

Preparation of Bath B:

Bath B was prepared according to manufacturer's instructions for Zircobond 1.5 using the materials described in the preparation of bath A. The pretreatment bath was prepared in a five gallon bucket (18.93 liter scale). The pH and free fluoride were adjusted with 47.0 g Chemfil buffer and 15.0 g Chemfos AFL, respectively. The final bath parameters were: pH 4.8, 34 ppm Cu, 200 ppm Zr, and 93 ppm free fluoride.

Hot dip galvanized steel panels (Gardobond MBZ1/EA, 105 mm×190 mm×0.75 mm, oiled, without treatment, available from Chemetall) were cut in half prior to application of the alkaline cleaner yielding 5.25 cm×9.5 cm panels.

Panels were treated using either Treatment Method A or B, outlined in Tables 7 and 8 below. For panels treated according to Treatment Method A, panels were immersion cleaned and degreased for 120 seconds in a five-gallon bucket (125° F.) and rinsed with deionized water by immersing in a deionized water bath (75° F.) for 30 seconds followed by a deionized water spray rinse using the nozzle described above (75° F.) for 30 seconds. All panels were immersed in the Group IVB pretreatment composition for 120 seconds (80° F.), rinsed by a deionized water spray rinse (75° F.) for 30 seconds, and dried with hot air (140° F.) for 120 seconds using a Hi-Velocity handheld blow-dryer made by Oster® (model number 078302-300-000) on high-setting.

For panels treated according to Treatment Method B, panels were cleaned, pretreated, and rinsed as in Method A, except the alkaline cleaner was modified by the addition of Fe, Co, and/or Mo.

TABLE 7

| Treatment Method A | |
|---|---|
| Step 1A | Alkaline cleaner (120 seconds, 125° F., immersion application) |
| Step 2A | Deionized water rinse (30 seconds, 75° F., immersion application) |
| Step 3A | Deionized water rinse (30 seconds, 75° F., spray application) |
| Step 4A | Zirconium Pretreatment (120 seconds, 80° F., immersion application) |
| Step 5A | Deionized water rinse (30 seconds, 75° F., spray application) |
| Step 6A | Hot Air Dry (120 seconds, 140° F.) |

TABLE 8

| Treatment Method B | |
|---|---|
| Step 1B | Metal-Modified Alkaline cleaner (120 seconds, 125° F., immesion application) |
| Step 2B | Deionized water rinse (30 seconds, 75° F., immersion application) |
| Step 3B | Deionized water rinse (30 seconds, 75° F., spray application) |
| Step 4B | Zirconium Pretreatment (120 seconds, 80° F., immersion application) |
| Step 5B | Deionized water rinse (30 seconds, 75° F., spray application) |
| Step 6B | Hot Air Dry (120 seconds, 140° F.) |

Following completion of Treatment Methods A or B, all panels were electrocoated with ED7000Z (a cathodic electrocoat with components commercially available from PPG) prepared by mixing E6433Z resin (51.0 wt. %), E6434Z paste (8.9 wt. %), and deionized water (40.1 wt. %). The paint was ultrafiltered removing 25% of the material, which was replenished with fresh deionized water. The rectifier (Xantrax Model XFR600-2, Elkhart, Ind., or Sorensen XG 300-5.6, Ameteck, Berwyn, Pa.) was DC power supplied. The electrocoat application conditions were voltage set point of 180V-200V, a ramp time of 30 s, and a current density of 1.6 mA/cm$^2$. The electrocoat was maintained at 90° F. The film thickness was time-controlled to deposit a target film thickness of 0.6±0.1 mils. The DFT was controlled by changing the amount of charge (coulombs) that passed through the panels. Following deposition of the electrocoat, panels were baked in an oven (Despatch Model LFD-1-42) at 177° C. for 25 minutes. Panels were then submitted for corrosion testing or submitted for topcoating prior to adhesion testing.

Electrocoated panels were scribed with a vertical line in the middle of the panel down to the metal (steel) substrate. Scribed panels were exposed to GM cyclic corrosion test GMW14872 for cycles. Panels were subjected to media blasting (MB-2, an irregular granular plastic particle with a Moh's hardness of 3.5 and size range of 0.58 mm-0.84 mm available from Maxi-Blast, Inc., South Bend, Ind.) using an In Line Conveyor System IL-885 Sandblaster (incoming air pressure of 85 psi, Empire Abrasive Equipment Company, model information: IL885-M9655) after corrosion testing to remove loosely adhered paint and corrosion products. Panels for each condition were run in triplicate. The average scribe creep of three panels is shown in Table 10 below. Scribe creep refers to the area of paint loss around the scribe either through corrosion or disbondment (e.g.: affected paint to affected paint).

White topcoat was also applied to the electrocoated panels (not tested in corrosion). The topcoat is available from PPG Industries, Inc. as a three part system composed of a primer, basecoat, and clearcoat. The product codes, dry film thickness ranges, and bake conditions are shown in Table 9 below.

TABLE 9

Three Part Topcoat System

| Layer | Product Code | Dry Film Thickness Range (mils) | Bake (Temperature/Time) |
|---|---|---|---|
| Primer | SCP6534 | 0.95 ± 0.15 | 141° C./30 minutes |
| Basecoat | UDCT6466 | 1.1 ± 0.1 | None |
| Clearcoat | TMAC9000 | 1.9 ± 0.1 | 82° C./7 minutes then 141° C./30 minutes |

The paint adhesion for panels treated according to each Treatment Method A and B was then tested under dry (unexposed) and wet (exposed) conditions. Three panels were tested and the average adhesion value is shown in Table 10 for unexposed and exposed conditions. For the dry adhesion test, a razor blade was used to scribe eleven lines parallel and perpendicular to the length of the one of the electrocoated panels. The resultant grid area of the scribed lines was 0.5"×0.5" to 0.75" to 0.75" square. Dry adhesion was assessed by using 3M's Fiber 898 tape, which was firmly adhered over the scribed grid area by finger rubbing it multiple times prior to pulling it off. The crosshatch area was evaluated for paint loss on a scale from 0 to 10, with 0 being total paint loss and 10 being absolutely no paint loss (see below). An adhesion value of 8 is considered acceptable in the automotive industry. For the exposed adhesion test, following topcoat application, the panel was immersed in deionized water (40° C.) for ten days, at which time the panels were removed, wiped with a towel to dry and allowed to sit at ambient temperature for forty five minutes prior to crosshatching and tape-pulling to evaluate paint adhesion as described above.

TABLE 10

Corrosion and Adhesion Results

| Condition | Treatment Protocol | Pretreatment Bath | Alkaline Cleaner (Metal/s added) | Avg. Scribe Creep (mm) GMW14872 | Dry Cross Hatch Rating* | Wet Cross Hatch Rating* |
|---|---|---|---|---|---|---|
| Control | Method A | Bath A | Alkaline Cleaner I | 6.0 | 6.5 | 7.5 |
| B | Method B | Bath A | Alkaline Cleaner II (Co) | 5.7 | 8.8 | 9.2 |
| C | Method B | Bath A | Alkaline Cleaner III (Fe and Co) | 5.4 | 8.8 | 8.8 |
| D | Method B | Bath B | Alkaline Cleaner IV (Mo, high level) | 4.3 | 8.0 | 9.2 |
| E | Method B | Bath B | Alkaline Cleaner V (Fe and Mo) | 5.3 | 9.3 | 9.2 |
| F | Method B | Bath B | Alkaline Cleaner VI (Mo, low level) | 6.1 | 8.8 | 8.8 |

*Average of three separate panels

The rating scale used in Example 6 was as follows in Table 11 and defined by a high rating indicative of greater adhesion between the substrate surface, pretreatment film, and the organic coating layer (e.g.: electrocoat, topcoat, or powdercoat).

TABLE 11

| Crosshatch Rating Description | |
|---|---|
| Rating | Percent Paint Loss |
| 10 | Perfect Paint Adhesion (0% Paint Loss) |
| 9 | 5% Paint Loss |
| 8 | 10% Paint Loss |
| 7 | 25% Paint Loss |
| 6 | 50% Paint Loss |
| 5 | 60% Paint Loss |
| 4 | 70% Paint Loss |
| 3 | 80% Paint Loss |
| 2 | 90% Paint Loss |
| 1 | Greater than 95% Paint Loss |
| 0 | 100% Paint Loss |

Exposed cross-hatch testing is an important evaluation because poor cross-hatch adhesion indicates there is a weakness within automotive coating stack. This is especially important on HDG substrates where paint adhesion is an identified challenge. The adhesion problem is further exacerbated because the exterior skin of automotive construction is often HDG because it provides excellent corrosion resistance.

These data demonstrate that application of the cleaner composition of the present invention significantly improved corrosion and adhesion compared to the control. The cleaner containing molybdenum at high levels or molybdenum+iron showed the best improvement in performance when used with Group IVB metal pretreatment composition, demonstrating that molybdenum can replace cobalt in an alkaline cleaner to improve performance and also eliminating the potential regulatory issues associated with the use of cobalt.

Example 7

Alkaline Cleaner Baths

The alkaline cleaner baths were identical to those used in Example 1.

Zirconium Pretreatment:

A ZircoBond ZB4200 DM (available from PPG Industries) zirconium pretreatment bath was prepared according to the manufacturer's instructions. The bath had a pH of 4.5 and contained 190 ppm of zirconium, 20 ppm copper, and 75 ppm free fluoride. Temperature of the bath was 80° F. and when panels were run through the bath it was utilized for 2 minutes with low agitation with an immersion mixer (Poly Science Sous Vide).

Iron Phosphate Pretreatment:

Chemfos 158 was prepared as follows: To a 10 gallon bath of Tap/City Water a 4% volume (1.5 Liters) of Chemfos 158 concentrate (available from PPG) was added to the bath. The bath is in a stainless steel spray tank for pretreatment and cleaning applications. The bath was adjusted to a pH of 5.06 using ChemFil Buffer. When in use the temperature of the bath was 140° F. and used for a duration of 90 seconds. Additionally, the tank uses a series of vee jet nozzles for application purposes and the pressure used was of 15-20 psi.

Panel Preparation

For each set 3 panels of ACT Hot Dipped Galvanized (Exposed Grade) 60G60U were cleaned in one of the above cleaner compositions for 2 minutes at a temperature of 120° F., rinsed in a deionized water bath for 10-15 seconds, followed by a spray rinse with the 7 type selector nozzle with it set to "shower". Next the panels entered one of the two types of pretreatment baths described above. After the pretreatment step the panels were again spray rinsed for 10-15 seconds and finally panels were warm air dried using a Hi-Velocity handheld blow-dryer made by Oster® (model number 078302-300-000) on high-setting at a temperature of about 50-55° C. until the panel was dry (about 1-5 minutes). The sets were as follows:

Set 1—Standard Chemkleen 2010—ZB4200

Set 2—Standard Chemkleen 2010—Chemfos 158

Set 3—Modified Cleaner 1—Chemfos 158

Set 4—Modified Cleaner 2—Chemfos 158

After drying, the panels were electrocoated with 1K AdvantEdge Industrial cathodic electrocoat, available from PPG. The electrocoat was applied to target of 1.00 mil thickness. The rectifier (Xantrex Model XFR600-2) was set to the "Time Controlled" setting. The conditions were set to the adjusted time of (90 seconds) with a set 0.50 amp limit, voltage set point of 200 V, and a ramp time of 30 seconds. The electrocoat was maintained at 90° F., with a stir speed of 340 rpms. After the electrocoat was applied, the panels were baked in an oven (Despatch Model LFD-1-42) at 160° C. for 30 minutes. The coating thickness was measured using a film thickness gauge (Fischer Technology Inc. Model FMP40C).

Electrocoated panels were scribed with a 10.2 cm vertical line in the middle of the panel down to the metal substrate. Scribed panels were exposed to GM cyclic corrosion test GMW14872 for 30 days. Panels were subjected to media blasting (MB-2, an irregular granular plastic particle with a Moh's hardness of 3.5 and size range of 0.58 mm-0.84 mm available from Maxi-Blast, Inc., South Bend, Ind.) using an In Line Conveyor System IL-885 Sandblaster (incoming air pressure of 85 psi regulated to 40 psi for application from Empire Abrasivr Equipment Company, model information: IL885-M9655) after corrosion testing to remove loosely adhered paint and corrosion products. A reading of affected paint to affected paint was measured at each cm along the scribe creating a total of 10 points of measurement. From this the average of the three panels was used to calculate the average scribe creep reported in Table 12 below. The measurements were made by the use of a Fowler Sylvac digital caliper Model S 235.

TABLE 12

| Set Identification Number | Average Scribe Creep |
|---|---|
| Set 1 (ZB4200 Control) | 4.01 mm |
| Set 2 (Standard Clean-CF158) | 12.04 mm |
| Set 3 (Fe Clean-CF158) | 4.47 mm |
| Set 4 (Fe/Co Clean-CF158 | 3.68 mm |

Example 8

Alkaline Cleaner Bath Preparation

Phosphate-free alkaline cleaner baths were prepared as follows:

Standard Chemkleen 2010LP bath was prepared at 1.25% v/v concentration of Chemkleen 2010LP (a phosphate-free alkaline cleaner available from PPG) and 0.125% of Chemkleen 181 ALP (a phosphate-free blended surfactant additive, available from PPG). A five gallon bath was prepared in deionized water.

Modified cleaners: For each modified cleaner, a five gallon bath of Chemkleen 2010LP bath was prepared as above. To these baths were added 28.5 g D-gluconic acid sodium salt (available from Sigma Aldrich Corporation), 17.7 g cobalt nitrate hexahydrate (available from Fisher Scientific, Inc.) and 23.5 g ferric nitrate (available from Sigma Aldrich Corporation). The calculated cobalt and iron concentrations of these baths were 190 ppm and 172 ppm, respectively. Various phosphonate materials were then added, as detailed in the table below.

Activator Preparation

The activating rinse bath was prepared by adding 1.36 grams of the zinc phosphate dispersion described above per liter of deionized water, to give an activator bath with a zinc phosphate concentration of 0.5 grams per liter.

Zinc Phosphating Bath Preparation

A nickel-free zinc phosphate concentrate was prepared by blending the following ingredients in order, and mixing thoroughly until clear:

| | |
|---|---|
| Deionized water | 840.12 g |
| Zinc Oxide, available from Umicore Zinc Chemicals | 28.92 g |
| Phosphoric acid, 85%, available from Fisher Scientific | 238.32 g |
| Acetaldehyde oxime, 50%, available from Sigma-Aldrich Corporation | 2.4 g |
| Manganese oxide, available from Sigma-Aldrich Corporation | 31.32 g |
| Nitric Acid, 70%, available from Fisher Scientific | 21.6 g |
| Dowfax 2A1, Available from The Dow Chemical Co. | 0.6 g |
| KF, 40% solution, available from AWSM INDUSTRIES | 34.2 g |
| Ammonium bifluoride, available from Fisher Scientific | 2.52 g |

This zinc phosphate concentrate was used to prepare a zinc phosphating bath by diluting to a concentration of 3.7% by volume with deionized water, and adjusting the acidity to a free acid value of 0.7-0.9 gas points with Chemfos Make-up B, available from PPG Industries. Sodium nitrite was added to maintain a value of 2.3-2.7 gas points.

Zirconium Pretreatment

To 5 gallons of deionized water was added 16.75 grams 45% hexafluorozirconic acid (available from Honeywell International Inc.), 30 grams of a 2% by weight copper solution (prepared by dissolving copper nitrate hemipentahydrate, available from Fisher Scientific, in deionized water), and 15.4 grams of Chemfos AFL (available from PPG). The bath was adjusted to operate at a pH range of 4.5 to 5.0 with Chemfil Buffer (available from PPG).

Test Panel Preparation

For each run, two hot dipped galvanized steel panels (4"×6" from ACT Test Panels, LLC) were first cleaned as follows: Test panels were immersed in the selected cleaner bath at 49° C. for two minutes, followed by immersion rinse in DI water for 15 seconds and spray rinse with DI water for 15 seconds. At this point, panels for zinc phosphate pretreatment were immersed in the activator solution for 60 seconds at ambient temperature, and then immediately immersed into the phosphate bath at 52° C. for 120 seconds. The panels for zirconium pretreatment were immersed into the zirconium pretreatment bath for two minutes at 27° C. After pretreating (zinc phosphate or zirconium), all panels then were spray rinsed with DI water for 20-30 seconds. Panels were warm air dried using a Hi-Velocity handheld blow-dryer made by Oster® (model number 078302-300-000) on high-setting at a temperature of about 50-55° C. until the panel was dry (about 1-5 minutes).

After drying, the panels were electrocoated with EPIC 200 cathodic electrocoat. The electrocoat was applied to target a 0.66-0.72 mil thickness. The rectifier (Sorensen by Ametek, Model XG300-5.6) was set to the "Coulomb Controlled" setting. The conditions were set with 24 coulombs, no amp limit, voltage set point of 220 V, OVP of 300V, and a ramp time of 30 s. The electrocoat was heated to 90° F., with a stir speed of 340 rpms. After the electrocoat was applied, the panels were baked in an oven (Despatch Model LFD-1-42) at 177° C. for 25 minutes. The coating thickness was measured using a film thickness gauge (Fischer Technology Inc. Model FMP40C).

Panel Testing

The electrocoated panels were cut lengthwise into 15 mm×110 mm panel strips. The peel specimens were prepared by first bending one end of each strip panel at 90°; the test surfaces were cleaned with isopropyl alcohol and were plasma-treated (Diener Electronic model ATTO B with Duo 2.5 pump) for 5 minutes (after pumping down to 0.17 mbar pressure, using $N_2$ gas supply for 1 minute prior to the plasma). Then pairs of panels from each set were joined together using a quick-setting adhesive (3M Scotch-Weld DP 460), to make a T-shaped joint. The adhesive was allowed to cure under ambient conditions for 24 hours prior to testing. The test was conducted by pulling the joint apart at a nominal crosshead speed of 250 mm/min using an Instron 5567. The fracture energy $G_C$ was calculated by the formula:

$$G_C = \frac{1}{b}\left(\frac{dU_e}{da} - \frac{dU_s}{da} - \frac{dU_{dt}}{da} - \frac{dU_{db}}{da}\right)$$

where a is the crack length, b is the width, $dU_e$ is the potential energy of the external load, $dU_s$ is the strain energy stored in the substrate, $dU_{dt}$ is the energy dissipated in tensile deformation and $dU_{db}$ is the energy dissipated in plastic bending of the substrate. The results appear in the table below.

| | Fracture Energy (J/m$^2$) | |
|---|---|---|
| Cleaner Additive | Zinc Phosphate Pretreatment | Zirconium Pretreatment |
| None (Standard cleaner) | 1432 | 1849 |
| Dequest 2010, 0.8 g/L (60% active material) | 2734 | 2628 |
| Dequest 2000, 0.92 g/L (50% active material) | 2030 | 2942 |
| Iminodi(methylphosphonic acid), 0.48 g/L | 2207 | 2690 |
| N,N-Bis(phosphonomethyl)glycine, 0.61 g/L | 3559 | 2289 |

It will be appreciated by skilled artisans that numerous modifications and variations are possible in light of the above disclosure without departing from the broad inventive concepts described and exemplified herein. Accordingly, it is therefore to be understood that the foregoing disclosure is merely illustrative of various exemplary aspects of this application and that numerous modifications and variations can be readily made by skilled artisans which are within the spirit and scope of this application and the accompanying claims. It will be appreciated by skilled artisans that numerous modifications and variations are possible in light of the above disclosure without departing from the broad inventive concepts described and exemplified herein. Accordingly, it is therefore to be understood that the foregoing disclosure is merely illustrative of various exemplary aspects of this application and that numerous modifications and variations can be readily made by skilled artisans which are within the spirit and scope of this application and the accompanying claims.

We claim:

1. An aqueous alkaline metal substrate cleaning composition comprising:

a molybdenum cation;

an alkaline component; and a phosphonate;

wherein the pH of the aqueous alkaline composition is at least 11, and the aqueous alkaline composition includes no more than 50 ppm of phosphate based on a total weight of the composition;

and wherein, when a metal substrate surface is treated with the aqueous alkaline composition, the molybdenum cation deposits onto the metal substrate surface.

2. The aqueous alkaline composition of claim 1, wherein the molybdenum cation is present in an amount of 10 ppm to 400 ppm based on the total weight of the composition.

3. The aqueous alkaline composition of claim 1, further comprising a cobalt cation present in an amount of 50 ppm to 5800 ppm based on the total weight of the composition.

4. The aqueous alkaline composition of claim 1, further comprising a chelator, an oxidizer, a surfactant, a depositable species or combinations thereof.

5. The aqueous alkaline composition of claim 1, wherein the phosphonate has a P-C ratio of at least 0.10.

6. The aqueous alkaline composition of claim 1, wherein the phosphonate comprises a polydentate phosphonate.

7. A treatment system for treating metal substrates, comprising:

a) an aqueous alkaline composition comprising:

a molybdenum cation;

a phosphonate; and an alkaline component;

wherein the pH of the aqueous alkaline composition is at least 11, and the aqueous alkaline composition includes no more than 50 ppm of phosphate based on a total weight of the composition; and b) a pretreatment composition for treating at least a portion of the substrate, comprising a Group IVB metal cation.

8. The system of claim 7, wherein the molybdenum cation is present in an amount of 10 ppm to 400 ppm based on the total weight of the composition.

9. The system of claim 7, wherein the aqueous alkaline composition further comprises a cobalt cation present in an amount of 50 ppm to 5800 ppm based on the total weight of the composition.

10. The system of claim 7, wherein the aqueous alkaline composition further comprises a chelator, an oxidizer, a surfactant, a depositable species or combinations thereof.

11. The system of claim 7, wherein the phosphonate has a P-H ratio of at least 0.10.

12. The system of claim 7, wherein the phosphonate comprises a polydentate phosphonate.

13. The system of claim 7, wherein the pretreatment composition further comprises an electropositive metal, a lithium cation, a molybdenum cation, or combinations thereof.

14. The system of claim 7, wherein the system is substantially free of phosphate.

15. A metal substrate treated with the system of claim 7.

16. A treatment system for treating metal substrates, comprising:

a) an aqueous alkaline composition comprising:

a molybdenum cation;

a phosphonate; and an alkaline component;

wherein the pH of the aqueous alkaline composition is at least 11, and the aqueous alkaline composition includes no more than 50 ppm of phosphate based on a total weight of the composition;

b) optionally, an activating rinse for treating at least a portion of a substrate; and c) a pretreatment composition for treating at least a portion of the substrate, comprising a metal phosphate.

17. The system of claim 16, wherein the molybdenum cation is present in an amount of 10 ppm to 400 ppm based on the total weight of the composition.

18. The system of claim 16, wherein the aqueous alkaline composition further comprises a cobalt cation present in an amount of 50 ppm to 5800 ppm based on the total weight of the composition.

19. The system of claim 16, wherein the aqueous alkaline composition further comprises a cobalt cation, a chelator, an oxidizer, a surfactant, a depositable species or combinations thereof.

20. The system of claim 16, wherein the phosphonate has a P-C ratio of at least 0.10.

21. The system of claim 16, wherein the phosphonate comprises a polydentate phosphonate.

22. The system of claim 16, wherein the activating rinse comprises a dispersion of metal phosphate particles having a $D_{90}$ particle size of no greater than 10 μm, wherein the metal phosphate comprises divalent or trivalent metals or combinations thereof.

23. The system of claim 16, wherein the activating rinse comprises a dispersion of metal phosphate particles having a $D_{90}$ particle size of no more than 1 μm, wherein the metal phosphate comprises divalent or trivalent metals or combinations thereof.

24. The system of claim 16, wherein the activating rinse comprises colloidal titanium-phosphate particles.

25. The system of claim 16, wherein the activating rinse further comprises a metal sulfate salt, wherein the metal of the metal sulfate salt comprises nickel, copper, zinc, iron, magnesium, cobalt, aluminum or combinations thereof.

26. The system of claim 16, wherein the pretreatment composition is substantially free of nickel.

27. The system of claim 16, further comprising at least one of:

a second pretreatment composition for treating at least a portion of the substrate, comprising a Group IIIB and/or Group IVB metal compound;

a post-rinse composition; and an electrodepositable coating composition for coating at least a portion of the substrate.

28. A metal substrate treated with the treatment system of claim 16.

29. The aqueous alkaline metal substrate cleaning composition of claim 1, further comprising iron.

30. The aqueous alkaline metal substrate cleaning composition of claim 29, wherein the iron is present in an amount of 100 ppm to 400 ppm based on a total weight of the composition.

31. The aqueous alkaline composition of claim 29, further comprising a chelator, an oxidizer, a surfactant, a depositable species or combinations thereof.

32. The aqueous alkaline composition of claim 29, wherein the phosphonate has a P-C ratio of at least 0.10.

33. The aqueous alkaline composition of claim 29, wherein the phosphonate comprises a polydentate phosphonate.

34. The aqueous alkaline composition of claim 29, further comprising a cobalt cation present in an amount of 50 ppm to 5800 ppm based on the total weight of the composition.

* * * * *